US012298051B2

(12) United States Patent
Lee et al.

(10) Patent No.: US 12,298,051 B2
(45) Date of Patent: May 13, 2025

(54) ICE MAKER AND REFRIGERATOR COMPRISING SAME

(71) Applicant: LG ELECTRONICS INC., Seoul (KR)

(72) Inventors: Donghoon Lee, Seoul (KR); Wookyong Lee, Seoul (KR); Seungseob Yeom, Seoul (KR); Sunggyun Son, Seoul (KR); Donghoon Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/532,020

(22) Filed: Dec. 7, 2023

(65) Prior Publication Data

US 2024/0102713 A1 Mar. 28, 2024

Related U.S. Application Data

(63) Continuation of application No. 17/282,600, filed as application No. PCT/KR2019/012882 on Oct. 1, 2019, now Pat. No. 11,874,044.

(30) Foreign Application Priority Data

Oct. 2, 2018 (KR) ..... 10-2018-0117785
Jul. 6, 2019 (KR) ..... 10-2019-0081688

(51) Int. Cl.
*F25C 1/18* (2006.01)
*F25C 1/24* (2018.01)
*F25C 5/08* (2006.01)

(52) U.S. Cl.
CPC ..... *F25C 1/18* (2013.01); *F25C 1/24* (2013.01); *F25C 5/08* (2013.01); *F25C 2400/10* (2013.01);
(Continued)

(58) Field of Classification Search
CPC ..... F25C 1/18; F25C 1/24; F25C 5/08; F25C 2400/10; F25C 2600/04; F25C 2700/12
See application file for complete search history.

(56) References Cited

U.S. PATENT DOCUMENTS 9,234,689 B2 1/2016 Son et al.
9,581,372 B2 2/2017 Lee et al.
(Continued)

FOREIGN PATENT DOCUMENTS

CN 102878743 B 7/2015
EP 0 326 144 A2 8/1989
(Continued)

OTHER PUBLICATIONS

International Search Report (with English Translation) and Written Opinion (with English Translation) dated Jan. 30, 2020 issued in Application No. PCT/KR2019/012882.
(Continued)

*Primary Examiner* — Elizabeth J Martin
(74) *Attorney, Agent, or Firm* — KED & ASSOCIATES, LLP

(57) ABSTRACT

An ice maker includes a first tray forming a part of an ice-making cell; a second tray forming another part of the ice-making cell; and a heater which is disposed so as to be adjacent to the first or the second tray, wherein the heater operates during a period when cold air is supplied to the first tray and the second tray and ice making takes place, and supplies heat to the first tray and/or the second tray.

20 Claims, 28 Drawing Sheets

(52) U.S. Cl.
CPC ..... *F25C 2600/04* (2013.01); *F25C 2700/12* (2013.01)

(56) References Cited

U.S. PATENT DOCUMENTS

| | | | | |
|---|---|---|---|---|
| 2012/0023996 | A1 | 2/2012 | Herrera et al. | |
| 2013/0014536 | A1* | 1/2013 | Son | F25C 1/25 62/340 |
| 2013/0081412 | A1 | 4/2013 | Son et al. | |
| 2014/0165599 | A1 | 6/2014 | Boarman et al. | |
| 2014/0182325 | A1 | 7/2014 | Lee et al. | |
| 2018/0187941 | A1* | 7/2018 | An | F25C 5/08 |
| 2018/0231294 | A1 | 8/2018 | Song et al. | |

FOREIGN PATENT DOCUMENTS

| | | |
|---|---|---|
| EP | 3059526 | 8/2016 |
| JP | S49 110349 U | 9/1974 |
| JP | H01 230969 | 9/1989 |
| JP | 04313662 | 11/1992 |
| JP | 05-203302 | 8/1993 |
| JP | 9-269172 | 10/1997 |
| JP | 2005-326035 | 11/2005 |
| JP | 2011-064373 | 3/2011 |
| JP | 2013-029285 | 2/2013 |
| KR | 10-2013-0009332 | 1/2013 |
| KR | 10-2014-0088321 | 7/2014 |
| KR | 10-1850918 | 5/2018 |
| KR | 10-2018-0093666 | 8/2018 |

OTHER PUBLICATIONS

Extended European Search Report dated Jun. 28, 2022 issued in Application No. 19868947.3.
Korean Office Action dated May 1, 2023 issued in Application No. 10-2018-0117785.
Korean Office Action dated May 8, 2023 issued in Application No. 10-2018-0117819.
Korean Office Action dated May 14, 2023 issued in Application No. 10-2018-0117821.
Korean Office Action dated May 15, 2023 issued in Application No. 10-2018-0117822.
U.S. Office Action dated May 17, 2023 issued in U.S. Appl. No. 17/282,600.

* cited by examiner (a)

(b)

(a)

(b)

ICE MAKER AND REFRIGERATOR COMPRISING SAME

CROSS-REFERENCE TO RELATED PATENT APPLICATIONS

This application is a Continuation of U.S. application Ser. No. 17/282,600, filed Apr. 2, 2021, which is a U.S. National Stage Application under 35 U.S.C. § 371 of PCT Application No. PCT/KR2019/012882, filed Oct. 1, 2019, which claims priority to Korean Patent Application Nos. 10-2018-0117785, filed Oct. 2, 2018 and 10-2019-0081688, filed Jul. 6, 2019, whose entire disclosures are hereby incorporated by reference.

TECHNICAL FIELD

The present invention relates to an ice maker and a refrigerator including the same.

BACKGROUND ART

Ice made using an ice maker applied to a general refrigerator is frozen in a manner in which the ice is freezes in all directions. Thus, since air is collected inside the ice, and a freezing rate is high, opaque ice is made.

In order to make transparent ice, there is a method of making ice by growing water in one direction while spilling water downward from an upper side or sprinkling water upward from a lower side. However, since ice has to be made at the sub-zero temperature in the refrigerator, water may not be spilled or sprinkled. As a result, this method may not be applied to the ice maker applied to the refrigerator.

Therefore, it is necessary to devise a new method in order to make ice having a spherical shape while being transparent in an ice maker used in a refrigerator.

DISCLOSURE

Technical Problem

Embodiments provide an ice maker capable of providing transparent and spherical ice, and a refrigerator including the same.

Technical Solution

A refrigerator according to one aspect may include: a first tray configured to form a portion of an ice making cell; a second tray configured to form the other portion of the ice making cell; and a heater disposed adjacent to any one of the first and second trays.

While cold air is supplied to the first tray and the second tray to make ice, the heater may be driven to supply heat to one or more trays of the first tray and the second tray.

The second tray may be disposed under the first tray. While ice is generated, the cold air may be supplied to the first tray so that the second tray has a temperature lower than that of the first tray.

The second tray may move to a water supply position so that water is supplied to the second tray. At the water supply position, the second tray may be disposed to be inclined at a predetermined angle with respect to the first tray, and at least a portion of the second tray may be spaced apart from the first tray.

The first tray and the second tray may form a plurality of ice making cells Water dropping into the second tray may be distributed into the ice making cell, which is formed by the second tray, through a gap between the first tray and the second tray.

The second tray may include a circumferential wall configured to surround the first tray at the water supply position.

When the water is completely supplied to the ice making cell, the second tray may move to an ice making position so that the first tray and the second tray are in contact with each other.

In an ice separation process, the second tray may move in a direction that is away from the first tray.

The refrigerator may further include a first pusher that passes through the first tray to press ice of the first tray in the ice separation process.

The first pusher may move by receiving rotational force of the second tray.

The refrigerator may further include a second pusher configured to press the second tray.

The heater may be in contact with the second tray in the ice separation process, and when the second tray is deformed by the second pusher, the heater may be spaced apart from the second tray.

A refrigerator according to another aspect includes: a storage chamber configured to store food; a cold air supply part configured to supply cold air to the storage chamber; a first tray configured to form a first cell that is a space in which water is changed into ice by the cold air; a second tray provided with a second cell to form an ice making cell together with the first cell; and a heater disposed adjacent to any one of the first and second trays, wherein, while the cold air is supplied to the first tray and the second tray to make ice, the heater is driven to supply heat to supply heat to one or more trays of the first tray and the second tray.

The second tray may move to a water supply position so that water is supplied to the second tray, and at the water supply position, the second tray may be disposed to be inclined at a predetermined angle with respect to the first tray so that the first cell and the second cell are spaced apart from each other.

When the water is completely supplied, the second tray may move to an ice making position, and at the ice making position, the first cell and the second cell may be aligned vertically to communicate with each other.

The second tray may be disposed under the first tray, and the first tray may be provided with an opening through which cold air passes. The heater may be in contact with the second tray.

The refrigerator may further include a heater configured to supply heat to the first tray so as to separate ice.

Advantageous Effects

According to the embodiment of the present invention, since the heater is in contact with the tray made of the soft material as necessary, the transparent ice having various shapes such as the spherical shape and the square shape may be implemented.

According to the embodiment of the present invention, in order to make the transparent ice, the ice making rate may decrease in the region, in which the high ice making rate is fast, by increasing in heat generation amount of the heater, and the ice making rate may increase in the region, in which the ice making rate is slow, by decreasing in heat generation amount of the heater. In conclusion, the ice making rate may be constantly maintained as a whole to provide the transparent ice to the user.

In addition, the heater may be controlled in multiple stages to reduce the heat generation amount of the heater and increase in amount of made ice.

According to the embodiment of the present invention, the heat may be supplied using the heater adjacent to the first tray to separate the ice from the tray, and after the second tray rotates a predetermined angle, the additional heating may be performed to secure the ice separation reliability. In addition, the ice already separated from the first tray may be prevented from being excessively melted due to the additional heating.

In addition, after separating the ice from the first tray, the second tray may stand by in the state of rotating by a predetermined angle to prevent the phenomenon in which the residual water generated when heating the first tray falls into the ice bin, thereby preventing the ice from being lumped.

According to an embodiment of the present invention, the ice may be detected by allowing the full ice detection lever to rotate in the swing type. In addition, when the ice is guided to the ice bin disposed under the tray, the ice may be guided to be sequentially accumulated in one direction inside the ice bin, thereby detecting whether the ice is full even in the ice bin having the low height.

MODE FOR INVENTION

Figure 1:
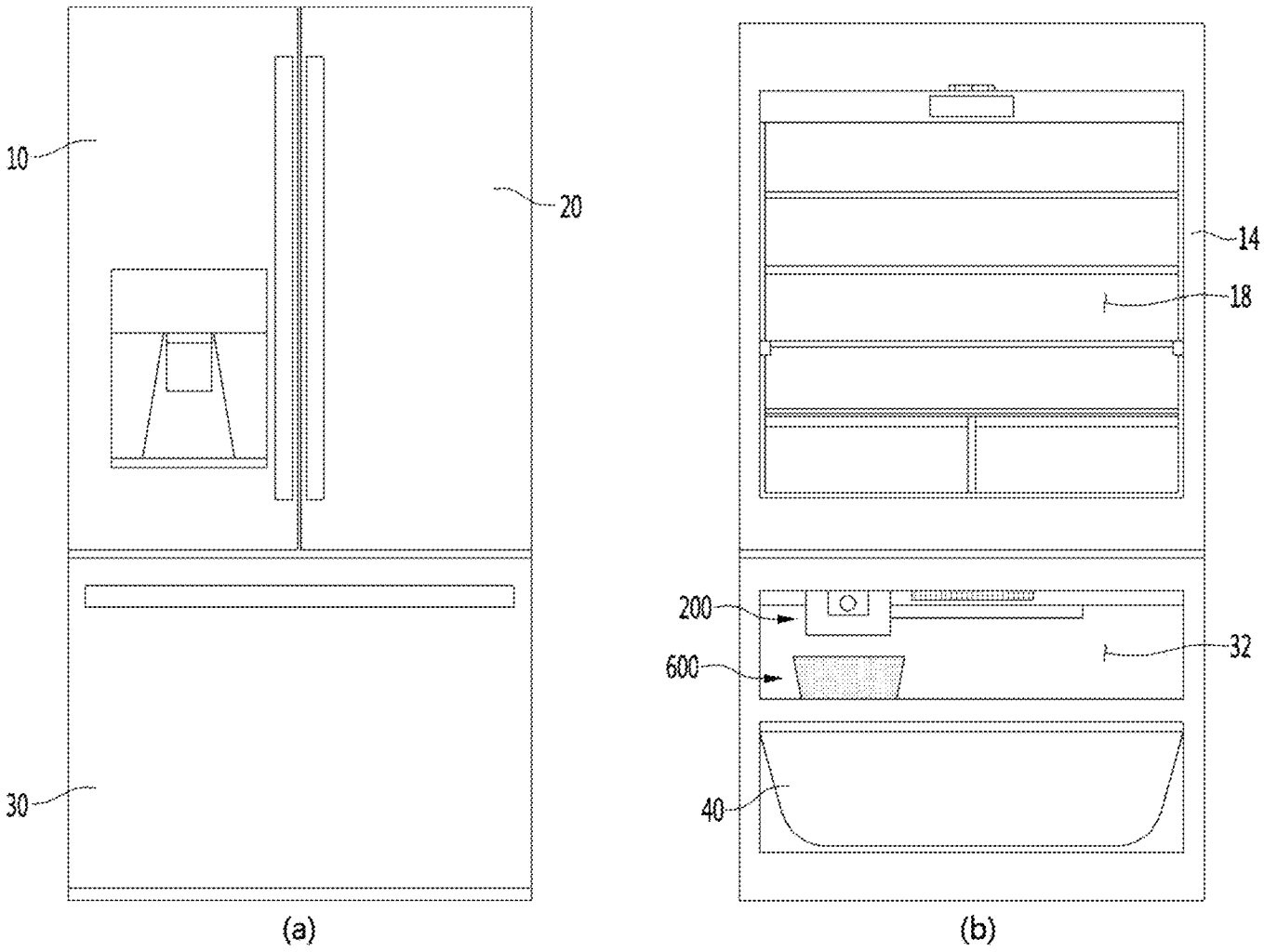
FIGS. 1(*a*) and (*b*) are front views of a refrigerator according to an embodiment of the present invention.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

The refrigerator according to an embodiment may include a tray assembly defining a portion of an ice making cell that is a space in which water is phase-changed into ice, a cooler supplying cold air to the ice making cell, a water supply part supplying water to the ice making cell, and a controller. The refrigerator may further include a temperature sensor detecting a temperature of water or ice of the ice making cell. The refrigerator may further include a heater disposed adjacent to the tray assembly. The refrigerator may further include a driver to move the tray assembly. The refrigerator may further include a storage chamber in which food is stored in addition to the ice making cell. The refrigerator may further include a cooler supplying cold to the storage chamber. The refrigerator may further include a temperature sensor sensing a temperature in the storage chamber. The controller may control at least one of the water supply part or the cooler. The controller may control at least one of the heater or the driver.

The controller may control the cooler so that cold is supplied to the ice making cell after moving the tray assembly to an ice making position. The controller may control the second tray assembly so that the second tray assembly moves to an ice separation position in a forward direction so as to take out the ice in the ice making cell when the ice is completely made in the ice making cell. The controller may control the tray assembly so that the supply of the water supply part after the second tray assembly moves to the water supply position in the reverse direction when the ice is completely separated. The controller may control the tray assembly so as to move to the ice making position after the water supply is completed.

According to an embodiment, the storage chamber may be defined as a space that is controlled to a predetermined temperature by the cooler. An outer case may be defined as a wall that divides the storage chamber and an external space of the storage chamber (i.e., an external space of the refrigerator). An insulation material may be disposed between the outer case and the storage chamber. An inner case may be disposed between the insulation material and the storage chamber.

According to an embodiment, the ice making cell may be disposed in the storage chamber and may be defined as a space in which water is phase-changed into ice. A circumference of the ice making cell refers to an outer surface of the ice making cell irrespective of the shape of the ice making cell. In another aspect, an outer circumferential surface of the ice making cell may refer to an inner surface of the wall defining the ice making cell. A center of the ice making cell refers to a center of gravity or volume of the ice making cell. The center may pass through a symmetry line of the ice making cell.

According to an embodiment, the tray may be defined as a wall partitioning the ice making cell from the inside of the storage chamber. The tray may be defined as a wall defining at least a portion of the ice making cell. The tray may be configured to surround the whole or a portion of the ice making cell. The tray may include a first portion that defines at least a portion of the ice making cell and a second portion extending from a predetermined point of the first portion. The tray may be provided in plurality. The plurality of trays may contact each other. For example, the tray disposed at the lower portion may include a plurality of trays. The tray disposed at the upper portion may include a plurality of trays. The refrigerator may include at least one tray disposed under the ice making cell. The refrigerator may further include a tray disposed above the ice making cell. The first portion and the second portion may have a structure inconsideration of a degree of heat transfer of the tray, a degree of cold transfer of the tray, a degree of deformation resistance of the tray, a recovery degree of the tray, a degree of supercooling of the tray, a degree of attachment between the tray and ice solidified in the tray, and coupling force between one tray and the other tray of the plurality of trays.

According to an embodiment, the tray case may be disposed between the tray and the storage chamber. That is, the tray case may be disposed so that at least a portion thereof surrounds the tray. The tray case may be provided in plurality. The plurality of tray cases may contact each other. The tray case may contact the tray to support at least a portion of the tray. The tray case may be configured to connect components except for the tray (e.g., a heater, a sensor, a power transmission member, etc.). The tray case may be directly coupled to the component or coupled to the component via a medium therebetween. For example, if the wall defining the ice making cell is provided as a thin film, and a structure surrounding the thin film is provided, the thin film may be defined as a tray, and the structure may be defined as a tray case. For another example, if a portion of the wall defining the ice making cell is provided as a thin film, and a structure includes a first portion defining the other portion of the wall defining the ice making cell and a second part surrounding the thin film, the thin film and the first portion of the structure are defined as trays, and the second portion of the structure is defined as a tray case.

According to an embodiment, the tray assembly may be defined to include at least the tray. According to an embodiment, the tray assembly may further include the tray case.

According to an embodiment, the refrigerator may include at least one tray assembly connected to the driver to move. The driver is configured to move the tray assembly in at least one axial direction of the X, Y, or Z axis or to rotate about the axis of at least one of the X, Y, or Z axis. The embodiment may include a refrigerator having the remaining configuration except for the driver and the power transmission member connecting the driver to the tray assembly in the contents described in the detailed description. According to an embodiment, the tray assembly may move in a first direction.

According to an embodiment, the cooler may be defined as a part configured to cool the storage chamber including at least one of an evaporator or a thermoelectric element.

According to an embodiment, the refrigerator may include at least one tray assembly in which the heater is disposed. The heater may be disposed in the vicinity of the tray assembly to heat the ice making cell defined by the tray assembly in which the heater is disposed. The heater may include a heater to be turned on in at least partial section while the cooler supplies cold so that bubbles dissolved in the water within the ice making cell moves from a portion, at which the ice is made, toward the water that is in a liquid state to make transparent ice. The heater may include a heater (hereinafter referred to as an "ice separation heater") controlled to be turned on in at least a section after the ice making is completed so that ice is easily separated from the tray assembly. The refrigerator may include a plurality of transparent ice heaters. The refrigerator may include a plurality of ice separation heaters. The refrigerator may include a transparent ice heater and an ice separation heater. In this case, the controller may control the ice separation heater so that a heating amount of ice separation heater is greater than that of transparent ice heater.

According to an embodiment, the tray assembly may include a first region and a second region, which define an outer circumferential surface of the ice making cell. The tray assembly may include a first portion that defines at least a portion of the ice making cell and a second portion extending from a predetermined point of the first portion.

For example, the first region may be defined in the first portion of the tray assembly. The first and second regions may be defined in the first portion of the tray assembly. Each of the first and second regions may be a portion of the one tray assembly. The first and second regions may be disposed to contact each other. The first region may be a lower portion of the ice making cell defined by the tray assembly. The second region may be an upper portion of an ice making cell defined by the tray assembly. The refrigerator may include an additional tray assembly. One of the first and second regions may include a region contacting the additional tray assembly. When the additional tray assembly is disposed in a lower portion of the first region, the additional tray assembly may contact the lower portion of the first region. When the additional tray assembly is disposed in an upper portion of the second region, the additional tray assembly and the upper portion of the second region may contact each other.

For another example, the tray assembly may be provided in plurality contacting each other. The first region may be disposed in a first tray assembly of the plurality of tray assemblies, and the second region may be disposed in a second tray assembly. The first region may be the first tray assembly. The second region may be the second tray assembly. The first and second regions may be disposed to contact each other. At least a portion of the first tray assembly may be disposed under the ice making cell defined by the first and second tray assemblies. At least a portion of the second tray assembly may be disposed above the ice making cell defined by the first and second tray assemblies.

The first region may be a region closer to the heater than the second region. The first region may be a region in which the heater is disposed. The second region may be a region closer to a heat absorbing part (i.e., a coolant pipe or a heat absorbing part of a thermoelectric module) of the cooler than the first region. The second region may be a region closer to the through-hole supplying cold to the ice making cell than the first region. To allow the cooler to supply the cold through the through-hole, an additional through-hole may be defined in another component. The second region may be a region closer to the additional through-hole than the first region. The heater may be a transparent ice heater. The heat insulation degree of the second region with respect to the cold may be less than that of the first region.

The heater may be disposed in one of the first and second tray assemblies of the refrigerator. For example, when the heater is not disposed on the other one, the controller may control the heater to be turned on in at least a section of the cooler to supply the cold air. For another example, when the additional heater is disposed on the other one, the controller may control the heater so that the heating amount of heater is greater than that of additional heater in at least a section of the cooler to supply the cold air. The heater may be a transparent ice heater.

The embodiment may include a refrigerator having a configuration excluding the transparent ice heater in the contents described in the detailed description.

The embodiment may include a pusher including a first edge having a surface pressing the ice or at least one surface of the tray assembly so that the ice is easily separated from the tray assembly. The pusher may include a bar extending from the first edge and a second edge disposed at an end of the bar. The controller may control the pusher so that a position of the pusher is changed by moving at least one of the pusher or the tray assembly. The pusher may be defined as a penetrating type pusher, a non-penetrating type pusher, a movable pusher, or a fixed pusher according to a view point.

A through-hole through which the pusher moves may be defined in the tray assembly, and the pusher may be configured to directly press the ice in the tray assembly. The pusher may be defined as a penetrating type pusher.

The tray assembly may be provided with a pressing part to be pressed by the pusher, the pusher may be configured to apply a pressure to one surface of the tray assembly. The pusher may be defined as a non-penetrating type pusher.

The controller may control the pusher to move so that the first edge of the pusher is disposed between a first point outside the ice making cell and a second point inside the ice making cell.

The pusher may be defined as a movable pusher. The pusher may be connected to a driver, the rotation shaft of the driver, or the tray assembly that is connected to the driver and is movable. The controller may control the pusher to move at least one of the tray assemblies so that the first edge of the pusher is disposed between the first point outside the ice making cell and the second point inside the ice making cell. The controller may control at least one of the tray assemblies to move to the pusher. Alternatively, the controller may control a relative position of the pusher and the tray assembly so that the pusher further presses the pressing part after contacting the pressing part at the first point outside the ice making cell. The pusher may be coupled to a fixed end. The pusher may be defined as a fixed pusher.

According to an embodiment, the ice making cell may be cooled by the cooler cooling the storage chamber. For example, the storage chamber in which the ice making cell is disposed may be a freezing compartment which is controlled at a temperature lower than 0 degree, and the ice making cell may be cooled by the cooler cooling the freezing compartment.

The freezing compartment may be divided into a plurality of regions, and the ice making cell may be disposed in one region of the plurality of regions.

According to an embodiment, the ice making cell may be cooled by a cooler other than the cooler cooling the storage chamber. For example, the storage chamber in which the ice making cell is disposed is a refrigerating compartment which is controlled to a temperature higher than 0 degree, and the ice making cell may be cooled by a cooler other than the cooler cooling the refrigerating compartment. That is, the refrigerator may include a refrigerating compartment and a freezing compartment, the ice making cell may be disposed inside the refrigerating compartment, and the ice maker cell may be cooled by the cooler that cools the freezing compartment.

The ice making cell may be disposed in a door that opens and closes the storage chamber.

According to an embodiment, the ice making cell is not disposed inside the storage chamber and may be cooled by the cooler. For example, the entire storage chamber defined inside the outer case may be the ice making cell. According to an embodiment, a degree of heat transfer indicates a degree of heat transfer from a high-temperature object to a low-temperature object and is defined as a value determined by a shape including a thickness of the object, a material of the object, and the like. In terms of the material of the object, a high degree of the heat transfer of the object may represent that thermal conductivity of the object is high. The thermal conductivity may be a unique material property of the object. Even when the material of the object is the same, the degree of heat transfer may vary depending on the shape of the object.

The degree of heat transfer may vary depending on the shape of the object. The degree of heat transfer from a point A to a point B may be influenced by a length of a path through which heat is transferred from the point A to the point B (hereinafter, referred to as a "heat transfer path"). The more the heat transfer path from the point A to the point B increases, the more the degree of heat transfer from the point A to the point B may decrease. The more the heat transfer path from the point A to the point B, the more the degree of heat transfer from the point A to the point B may increase.

The degree of heat transfer from the point A to the point B may be influenced by a thickness of the path through which heat is transferred from the point A to the point B. The more the thickness in a path direction in which heat is transferred from the point A to the point B decreases, the more the degree of heat transfer from the point A to the point B may decrease. The greater the thickness in the path direction from which the heat from point A to point B is transferred, the more the degree of heat transfer from point A to point B.

According to an embodiment, a degree of cold transfer indicates a degree of heat transfer from a low-temperature object to a high-temperature object and is defined as a value determined by a shape including a thickness of the object, a material of the object, and the like. The degree of cold transfer is a term defined in consideration of a direction in which cold flows and may be regarded as the same concept as the degree of heat transfer. The same concept as the degree of heat transfer will be omitted.

According to an embodiment, a degree of supercooling is a degree of supercooling of a liquid and may be defined as a value determined by a material of the liquid, a material or shape of a container containing the liquid, an external factor applied to the liquid during a solidification process of the liquid, and the like. An increase in frequency at which the liquid is supercooled may be seen as an increase in degree of the supercooling. The lowering of the temperature at which the liquid is maintained in the supercooled state may be seen as an increase in degree of the supercooling. Here, the supercooling refers to a state in which the liquid exists in the liquid phase without solidification even at a temperature below a freezing point of the liquid. The supercooled liquid has a characteristic in which the solidification rapidly occurs from a time point at which the supercooling is terminated. If it is desired to maintain a rate at which the liquid is solidified, it is advantageous to be designed so that the supercooling phenomenon is reduced.

According to an embodiment, a degree of deformation resistance represents a degree to which an object resists deformation due to external force applied to the object and is a value determined by a shape including a thickness of the object, a material of the object, and the like. For example, the external force may include a pressure applied to the tray assembly in the process of solidifying and expanding water in the ice making cell. In another example, the external force may include a pressure on the ice or a portion of the tray assembly by the pusher for separating the ice from the tray assembly. For another example, when coupled between the tray assemblies, it may include a pressure applied by the coupling.

In terms of the material of the object, a high degree of the deformation resistance of the object may represent that rigidity of the object is high. The degree of deformation resistance may be a unique material property of the object. Even when the material of the object is the same, the degree of deformation resistance may vary depending on the shape of the object. The degree of deformation resistance may be affected by a deformation resistance reinforcement part extending in a direction in which the external force is applied. The more the rigidity of the deformation resistance reinforcement part increases, the more the degree of deformation resistance may increase. The more the height of the extending deformation resistance reinforcement part increase, the more the degree of deformation resistance may increase.

According to an embodiment, a degree of restoration indicates a degree to which an object deformed by the external force is restored to a shape of the object before the external force is applied after the external force is removed and is defined as a value determined by a shape including a thickness of the object, a material of the object, and the like. For example, the external force may include a pressure applied to the tray assembly in the process of solidifying and expanding water in the ice making cell. In another example, the external force may include a pressure on the ice or a portion of the tray assembly by the pusher for separating the ice from the tray assembly. For another example, when coupled between the tray assemblies, it may include a pressure applied by the coupling force.

In view of the material of the object, a high degree of the restoration of the object may represent that an elastic modulus of the object is high. The elastic modulus may be a material property unique to the object. Even when the material of the object is the same, the degree of restoration may vary depending on the shape of the object. The degree of restoration may be affected by an elastic resistance reinforcement part extending in a direction in which the external force is applied. The more the elastic modulus of the elastic resistance reinforcement part increases, the more the degree of restoration may increase.

According to an embodiment, the coupling force represents a degree of coupling between the plurality of tray assemblies and is defined as a value determined by a shape including a thickness of the tray assembly, a material of the tray assembly, magnitude of the force that couples the trays to each other, and the like.

According to an embodiment, a degree of attachment indicates a degree to which the ice and the container are attached to each other in a process of making ice from water contained in the container and is defined as a value determined by a shape including a thickness of the container, a material of the container, a time elapsed after the ice is made in the container, and the like.

The refrigerator according to an embodiment includes a first tray assembly defining a portion of an ice making cell that is a space in which water is phase-changed into ice by cold, a second tray assembly defining the other portion of the ice making cell, a cooler supplying cold to the ice making cell, a water supply part supplying water to the ice making cell, and a controller. The refrigerator may further include a storage chamber in addition to the ice making cell. The storage chamber may include a space for storing food. The ice making cell may be disposed in the storage chamber. The refrigerator may further include a first temperature sensor sensing a temperature in the storage chamber. The refrigerator may further include a second temperature sensor sensing a temperature of water or ice of the ice making cell. The second tray assembly may contact the first tray assembly in the ice making process and may be connected to the driver to be spaced apart from the first tray assembly in the ice making process. The refrigerator may further include a heater disposed adjacent to at least one of the first tray assembly or the second tray assembly.

The controller may control at least one of the heater or the driver. The controller may control the cooler so that the cold is supplied to the ice making cell after the second tray assembly moves to an ice making position when the water is completely supplied to the ice making cell. The controller may control the second tray assembly so that the second tray assembly moves in a reverse direction after moving to an ice separation position in a forward direction so as to take out the ice in the ice making cell when the ice is completely made in the ice making cell. The controller may control the second tray assembly so that the supply of the water supply part after the second tray assembly moves to the water supply position in the reverse direction when the ice is completely separated.

Transparent ice will be described. Bubbles are dissolved in water, and the ice solidified with the bubbles may have low transparency due to the bubbles. Therefore, in the process of water solidification, when the bubble is guided to move from a freezing portion in the ice making cell to another portion that is not yet frozen, the transparency of the ice may increase.

A through-hole defined in the tray assembly may affect the making of the transparent ice. The through-hole defined in one side of the tray assembly may affect the making of the transparent ice. In the process of making ice, if the bubbles move to the outside of the ice making cell from the frozen portion of the ice making cell, the transparency of the ice may increase. The through-hole may be defined in one side of the tray assembly to guide the bubbles so as to move out of the ice making cell. Since the bubbles have lower density than the liquid, the through-hole (hereinafter, referred to as an "air exhaust hole") for guiding the bubbles to escape to the outside of the ice making cell may be defined in the upper portion of the tray assembly.

The position of the cooler and the heater may affect the making of the transparent ice. The position of the cooler and the heater may affect an ice making direction, which is a direction in which ice is made inside the ice making cell.

In the ice making process, when bubbles move or are collected from a region in which water is first solidified in the ice making cell to another predetermined region in a liquid state, the transparency of the made ice may increase. The direction in which the bubbles move or are collected may be similar to the ice making direction. The predetermined region may be a region in which water is to be solidified lately in the ice making cell.

The predetermined region may be a region in which the cold supplied by the cooler reaches the ice making cell late. For example, in the ice making process, the through-hole through which the cooler supplies the cold to the ice making cell may be defined closer to the upper portion than the lower portion of the ice making cell so as to move or collect the bubbles to the lower portion of the ice making cell. For another example, a heat absorbing part of the cooler (that is, a refrigerant pipe of the evaporator or a heat absorbing part of the thermoelectric element) may be disposed closer to the upper portion than the lower portion of the ice making cell. According to an embodiment, the upper and lower portions of the ice making cell may be defined as an upper region and a lower region based on a height of the ice making cell.

The predetermined region may be a region in which the heater is disposed. For example, in the ice making process, the heater may be disposed closer to the lower portion than the upper portion of the ice making cell so as to move or collect the bubbles in the water to the lower portion of the ice making cell.

The predetermined region may be a region closer to an outer circumferential surface of the ice making cell than to a center of the ice making cell. However, the vicinity of the center is not excluded. If the predetermined region is near the center of the ice making cell, an opaque portion due to the bubbles moved or collected near the center may be easily visible to the user, and the opaque portion may remain until most of the ice until the ice is melted. Also, it may be difficult to arrange the heater inside the ice making cell containing water. In contrast, when the predetermined region is defined in or near the outer circumferential surface of the ice making cell, water may be solidified from one side of the outer circumferential surface of the ice making cell toward the other side of the outer circumferential surface of the ice making cell, thereby solving the above limitation. The transparent ice heater may be disposed on or near the outer circumferential surface of the ice making cell. The heater may be disposed at or near the tray assembly.

The predetermined region may be a position closer to the lower portion of the ice making cell than the upper portion of the ice making cell. However, the upper portion is also not excluded. In the ice making process, since liquid water having greater density than ice drops, it may be advantageous that the predetermined region is defined in the lower portion of the ice making cell.

At least one of the degree of deformation resistance, the degree of restoration, and the coupling force between the plurality of tray assemblies may affect the making of the transparent ice. At least one of the degree of deformation resistance, the degree of restoration, and the coupling force between the plurality of tray assemblies may affect the ice making direction that is a direction in which ice is made in the ice making cell. As described above, the tray assembly may include a first region and a second region, which define an outer circumferential surface of the ice making cell. For example, each of the first and second regions may be a portion of one tray assembly. For another example, the first region may be a first tray assembly. The second region may be a second tray assembly.

To make the transparent ice, it may be advantageous for the refrigerator to be configured so that the direction in which ice is made in the ice making cell is constant. This is because the more the ice making direction is constant, the more the bubbles in the water are moved or collected in a predetermined region within the ice making cell. It may be advantageous for the degree of deformation resistance of the portion to be greater than the degree of deformation resistance of the other portion so as to induce the ice to be made in the direction of the other portion in a portion of the tray assembly. The ice tends to be grown as the ice is expanded toward a portion at which the degree of deformation resistance is low. To start the ice making again after removing the made ice, the deformed portion has to be restored again to make ice having the same shape repeatedly. Therefore, it may be advantageous that the portion having the low degree of the deformation resistance has a high degree of the restoration than the portion having a high degree of the deformation resistance.

The degree of deformation resistance of the tray with respect to the external force may be less than that of the tray case with respect to the external force, or the rigidity of the tray may be less than that of the tray case. The tray assembly allows the tray to be deformed by the external force, while the tray case surrounding the tray is configured to reduce the deformation. For example, the tray assembly may be configured so that at least a portion of the tray is surrounded by the tray case. In this case, when a pressure is applied to the tray assembly while the water inside the ice making cell is solidified and expanded, at least a portion of the tray may be allowed to be deformed, and the other part of the tray may be supported by the tray case to restrict the deformation. In addition, when the external force is removed, the degree of restoration of the tray may be greater than that of the tray case, or the elastic modulus of the tray may be greater than that of the tray case. Such a configuration may be configured so that the deformed tray is easily restored.

The degree of deformation resistance of the tray with respect to the external force may be greater than that of the gasket of the refrigerator with respect to the external force, or the rigidity of the tray may be greater than that of the gasket. When the degree of deformation resistance of the tray is low, there may be a limitation that the tray is excessively deformed as the water in the ice making cell defined by the tray is solidified and expanded. Such a deformation of the tray may make it difficult to make the desired type of ice. In addition, the degree of restoration of the tray when the external force is removed may be configured to be less than that of the refrigerator gasket with respect to the external force, or the elastic modulus of the tray is less than that of the gasket.

The degree of deformation resistance of the tray case with respect to the external force may be less than that of the refrigerator case with respect to the external force, or the rigidity of the tray case may be less than that of the refrigerator case. In general, the case of the refrigerator may be made of a metal material including steel. In addition, when the external force is removed, the degree of restoration of the tray case may be greater than that of the refrigerator case with respect to the external force, or the elastic modulus of the tray case is greater than that of the refrigerator case.

The relationship between the transparent ice and the degree of deformation resistance is as follows.

The second region may have different degree of deformation resistance in a direction along the outer circumferential surface of the ice making cell. The degree of deformation resistance of the portion of the second region may be greater than that of the another of the second region. Such a configuration may be assisted to induce ice to be made in a direction from the ice making cell defined by the second region to the ice making cell defined by the first region.

The first and second regions defined to contact each other may have different degree of deformation resistances in the direction along the outer circumferential surface of the ice making cell. The degree of deformation resistance of one portion of the second region may be greater than that of one portion of the first region. Such a configuration may be assisted to induce ice to be made in a direction from the ice making cell defined by the second region to the ice making cell defined by the first region.

In this case, as the water is solidified, a volume is expanded to apply a pressure to the tray assembly, which induces ice to be made in the other direction of the second region or in one direction of the first region. The degree of deformation resistance may be a degree that resists to deformation due to the external force. The external force may a pressure applied to the tray assembly in the process of solidifying and expanding water in the ice making cell. The external force may be force in a vertical direction (Z-axis direction) of the pressure. The external force may be force acting in a direction from the ice making cell defined by the second region to the ice making cell defined by the first region.

For example, in the thickness of the tray assembly in the direction of the outer circumferential surface of the ice making cell from the center of the ice making cell, one portion of the second region may be thicker than the other of the second region or thicker than one portion of the first region. One portion of the second region may be a portion at which the tray case is not surrounded. The other portion of the second region may be a portion surrounded by the tray case. One portion of the first region may be a portion at which the tray case is not surrounded. One portion of the second region may be a portion defining the uppermost portion of the ice making cell in the second region. The second region may include a tray and a tray case locally surrounding the tray. As described above, when at least a portion of the second region is thicker than the other part, the degree of deformation resistance of the second region may be improved with respect to an external force. A minimum value of the thickness of one portion of the second region may be greater than that of the thickness of the other portion of the second region or greater than that of one portion of the first region. A maximum value of the thickness of one portion of the second region may be greater than that of the thickness of the other portion of the second region or greater than that of one portion of the first region. When the through-hole is defined in the region, the minimum value represents the minimum value in the remaining regions except for the portion in which the through-hole is defined. An average value of the thickness of one portion of the second region may be greater than that of the thickness of the other portion of the second region or greater than that of one portion of the first region. The uniformity of the thickness of one portion of the second region may be less than that of the thickness of the other portion of the second region or less than that of one of the thickness of the first region.

For another example, one portion of the second region may include a first surface defining a portion of the ice making cell and a deformation resistance reinforcement part extending from the first surface in a vertical direction away from the ice making cell defined by the other of the second region. One portion of the second region may include a first surface defining a portion of the ice making cell and a deformation resistance reinforcement part extending from the first surface in a vertical direction away from the ice making cell defined by the first region. As described above, when at least a portion of the second region includes the deformation resistance reinforcement part, the degree of deformation resistance of the second region may be improved with respect to the external force.

For another example, one portion of the second region may further include a support surface connected to a fixed end of the refrigerator (e.g., the bracket, the storage chamber wall, etc.) disposed in a direction away from the ice making cell defined by the other of the second region from the first surface. One portion of the second region may further include a support surface connected to a fixed end of the refrigerator (e.g., the bracket, the storage chamber wall, etc.) disposed in a direction away from the ice making cell defined by the first region from the first surface. As described above, when at least a portion of the second region includes a support surface connected to the fixed end, the degree of deformation resistance of the second region may be improved with respect to the external force.

For another example, the tray assembly may include a first portion defining at least a portion of the ice making cell and a second portion extending from a predetermined point of the first portion. At least a portion of the second portion may extend in a direction away from the ice making cell defined by the first region. At least a portion of the second portion may include an additional deformation reinforcement part. At least a portion of the second portion may further include a support surface connected to the fixed end. As described above, when at least a portion of the second region further includes the second portion, it may be advantageous to improve the degree of deformation resistance of the second region with respect to the external force. This is because the additional deformation resistance reinforcement part is disposed at in the second portion, or the second portion is additionally supported by the fixed end.

For another example, one portion of the second region may include a first through-hole. As described above, when the first through-hole is defined, the ice solidified in the ice making cell of the second region is expanded to the outside of the ice making cell through the first through-hole, and thus, the pressure applied to the second region may be reduced. In particular, when water is excessively supplied to the ice making cell, the first through-hole may be contributed to reduce the deformation of the second region in the process of solidifying the water.

One portion of the second region may include a second through-hole providing a path through which the bubbles contained in the water in the ice making cell of the second region move or escape. When the second through-hole is defined as described above, the transparency of the solidified ice may be improved.

In one portion of the second region, a third through-hole may be defined to press the penetrating pusher. This is because it may be difficult for the non-penetrating type pusher to press the surface of the tray assembly so as to remove the ice when the degree of deformation resistance of the second region increases. The first, second, and third through-holes may overlap each other. The first, second, and third through-holes may be defined in one through-hole.

One portion of the second region may include a mounting part on which the ice separation heater is disposed. The induction of the ice in the ice making cell defined by the second region in the direction of the ice making cell defined by the first region may represent that the ice is first made in the second region. In this case, a time for which the ice is attached to the second region may be long, and the ice separation heater may be required to separate the ice from the second region. The thickness of a portion of the second region of the tray assembly in which the ice separation heater is mounted in the direction of the outer circumferential surface of the ice making cell from the center of the ice making cell may be less than that of the other portion of the second region. This is because the heat supplied by the ice separation heater increases in amount transferred to the ice making cell. The fixed end may be a portion of the wall defining the storage chamber or a bracket.

The relation between the coupling force of the transparent ice and the tray assembly is as follows.

To induce the ice to be made in the ice making cell defined by the second region in the direction of the ice making cell defined by the first region, it may be advantageous to increase in coupling force between the first and second regions arranged to contact each other. In the process of solidifying the water, when the pressure applied to the tray assembly while expanded is greater than the coupling force between the first and second regions, the ice may be made in a direction in which the first and second regions are separated from each other. In the process of solidifying the water, when the pressure applied to the tray assembly while expanded is low, the coupling force between the first and second regions is low, it also has the advantage of inducing the ice to be made so that the ice is made in a direction of the region having the smallest degree of deformation resistance in the first and second regions.

There may be various examples of a method of increasing the coupling force between the first and second regions. For example, after the water supply is completed, the controller may change a movement position of the driver in the first direction to control one of the first and second regions so as to move in the first direction, and then, the movement position of the driver may be controlled to be additionally changed into the first direction so that the coupling force between the first and second regions increases. For another example, since the coupling force between the first and second regions increase, the degree of deformation resistances or the degree of restorations of the first and second regions may be different from each other with respect to the force applied from the driver so that a change of the shape of the ice making cell by the expanding the ice is reduced after the ice making process is started (or after the heater is turned on). For another example, the first region may include a first surface facing the second region. The second region may include a second surface facing the first region. The first and second surfaces may be disposed to contact each other. The first and second surfaces may be disposed to face each other. The first and second surfaces may be disposed to be separated from and coupled to each other. In this case, surface areas of the first surface and the second surface may be different from each other. In this configuration, the coupling force of the first and second regions may increase while reducing breakage of the portion at which the first and second regions contact each other. In addition, there is an advantage of reducing leakage of water supplied between the first and second regions.

The relationship between transparent ice and the degree of restoration is as follows.

The tray assembly may include a first portion that defines at least a portion of the ice making cell and a second portion extending from a predetermined point of the first portion. The second portion is configured to be deformed by the expansion of the ice made and then restored after the ice is removed. The second portion may include a horizontal extension part provided so that the degree of restoration with respect to the horizontal external force of the expanded ice increases. The second portion may include a vertical extension part provided so that the degree of restoration with respect to the vertical external force of the expanded ice increases. Such a configuration may be assisted to induce ice to be made in a direction from the ice making cell defined by the second region to the ice making cell defined by the first region.

The first region may have different degree of restoration in a direction along the outer circumferential surface of the ice making cell. The first region may have different degree of deformation resistance in a direction along the outer circumferential surface of the ice making cell. The degree of restoration of one portion of the first region may be greater than that of the other portion of the first region. Also, the degree of deformation resistance of one portion may be less than that of the other portion. Such a configuration may be assisted to induce ice to be made in a direction from the ice making cell defined by the second region to the ice making cell defined by the first region.

The first and second regions defined to contact each other may have different degree of restoration in the direction along the outer circumferential surface of the ice making cell. Also, the first and second regions may have different degree of deformation resistances in the direction along the outer circumferential surface of the ice making cell. The degree of restoration of one of the first region may be greater than that of one of the second region. Also, the degree of deformation resistance of one of the first region may be greater than that of one of the second region. Such a configuration may be assisted to induce ice to be made in a direction from the ice making cell defined by the second region to the ice making cell defined by the first region.

In this case, as the water is solidified, a volume is expanded to apply a pressure to the tray assembly, which induces ice to be made in one direction of the first region in which the degree of deformation resistance decreases, or the degree of restoration increases. Here, the degree of restoration may be a degree of restoration after the external force is removed. The external force may a pressure applied to the tray assembly in the process of solidifying and expanding water in the ice making cell. The external force may be force in a vertical direction (Z-axis direction) of the pressure. The external force may be force acting in a direction from the ice making cell defined by the second region to the ice making cell defined by the first region.

For example, in the thickness of the tray assembly in the direction of the outer circumferential surface of the ice making cell from the center of the ice making cell, one portion of the first region may be thinner than the other of the first region or thinner than one portion of the second region. One portion of the first region may be a portion at which the tray case is not surrounded. The other portion of the first region may be a portion that is surrounded by the tray case. One portion of the second region may be a portion that is surrounded by the tray case. One portion of the first region may be a portion of the first region that defines the lowermost end of the ice making cell. The first region may include a tray and a tray case locally surrounding the tray.

A minimum value of the thickness of one portion of the first region may be less than that of the thickness of the other portion of the second region or less than that of one of the second region. A maximum value of the thickness of one portion of the first region may be less than that of the thickness of the other portion of the first region or less than that of the thickness of one portion of the second region. When the through-hole is defined in the region, the minimum value represents the minimum value in the remaining regions except for the portion in which the through-hole is defined. An average value of the thickness of one portion of the first region may be less than that of the thickness of the other portion of the first region or may be less than that of one of the thickness of the second region. The uniformity of the thickness of one portion of the first region may be greater than that of the thickness of the other portion of the first region or greater than that of one of the thickness of the second region.

For another example, a shape of one portion of the first region may be different from that of the other portion of the first region or different from that of one portion of the second region. A curvature of one portion of the first region may be different from that of the other portion of the first region or different from that of one portion of the second region. A curvature of one portion of the first region may be less than that of the other portion of the first region or less than that of one portion of the second region. One portion of the first region may include a flat surface. The other portion of the first region may include a curved surface. One portion of the second region may include a curved surface. One portion of the first region may include a shape that is recessed in a direction opposite to the direction in which the ice is expanded. One portion of the first region may include a shape recessed in a direction opposite to a direction in which the ice is made. In the ice making process, one portion of the first region may be modified in a direction in which the ice is expanded or a direction in which the ice is made. In the ice making process, in an amount of deformation from the center of the ice making cell toward the outer circumferential surface of the ice making cell, one portion of the first region is greater than the other portion of the first region. In the ice making process, in the amount of deformation from the center of the ice making cell toward the outer circumferential surface of the ice making cell, one portion of the first region is greater than one portion of the second region.

For another example, to induce ice to be made in a direction from the ice making cell defined by the second region to the ice making cell defined by the first region, one portion of the first region may include a first surface defining a portion of the ice making cell and a second surface extending from the first surface and supported by one surface of the other portion of the first region. The first region may be configured not to be directly supported by the other component except for the second surface. The other component may be a fixed end of the refrigerator.

One portion of the first region may have a pressing surface pressed by the non-penetrating type pusher. This is because when the degree of deformation resistance of the first region is low, or the degree of restoration is high, the difficulty in removing the ice by pressing the surface of the tray assembly may be reduced.

An ice making rate, at which ice is made inside the ice making cell, may affect the making of the transparent ice. The ice making rate may affect the transparency of the made ice. Factors affecting the ice making rate may be an amount of cold and/or heat, which are/is supplied to the ice making cell. The amount of cold and/or heat may affect the making of the transparent ice. The amount of cold and/or heat may affect the transparency of the ice.

In the process of making the transparent ice, the transparency of the ice may be lowered as the ice making rate is greater than a rate at which the bubbles in the ice making cell are moved or collected. On the other hand, if the ice making rate is less than the rate at which the bubbles are moved or collected, the transparency of the ice may increase. However, the more the ice making rate decreases, the more a time taken to make the transparent ice may increase. Also, the transparency of the ice may be uniform as the ice making rate is maintained in a uniform range.

To maintain the ice making rate uniformly within a predetermined range, an amount of cold and heat supplied to the ice making cell may be uniform. However, in actual use conditions of the refrigerator, a case in which the amount of cold is variable may occur, and thus, it is necessary to allow a supply amount of heat to vary. For example, when a temperature of the storage chamber reaches a satisfaction region from a dissatisfaction region, when a defrosting operation is performed with respect to the cooler of the storage chamber, the door of the storage chamber is in a state such as an opened state, the amount of cold is variable. Also, if an amount of water per unit height of the ice making cell is different, when the same cold and heat per unit height is supplied, the transparency per unit height may vary.

To solve this limitation, the controller may control the heater so that when a heat transfer amount between the cold within the storage chamber and the water of the ice making cell increases, the heating amount of transparent ice heater increases, and when the heat transfer amount between the cold within the storage chamber and the water of the ice making cell decreases, the heating amount of transparent ice heater decreases so as to maintain an ice making rate of the water within the ice making cell within a predetermined range that is less than an ice making rate when the ice making is performed in a state in which the heater is turned off.

The controller may control one or more of a cold supply amount of cooler and a heat supply amount of heater to vary according to a mass per unit height of water in the ice making cell. In this case, the transparent ice may be provided to correspond to a change in shape of the ice making cell.

The refrigerator may further include a sensor measuring information on the mass of water per unit height of the ice making cell, and the controller may control one of the cold supply amount of cooler and the heat supply amount of heater based on the information inputted from the sensor.

The refrigerator may include a storage part in which predetermined driving information of the cooler is recorded based on information on mass per unit height of the ice making cell, and the controller may control the cold supply amount of cooler to be changed based on the information.

The refrigerator may include a storage part in which predetermined driving information of the heater is recorded based on information on mass per unit height of the ice making cell, and the controller may control the heat supply amount of heater to be changed based on the information. For example, the controller may control at least one of the cold supply amount of cooler or the heat supply amount of heater to vary according to a predetermined time based on the information on the mass per unit height of the ice making cell. The time may be a time when the cooler is driven or a time when the heater is driven to make ice. For another example, the controller may control at least one of the cold supply amount of cooler or the heat supply amount of heater to vary according to a predetermined temperature based on the information on the mass per unit height of the ice making cell. The temperature may be a temperature of the ice making cell or a temperature of the tray assembly defining the ice making cell.

When the sensor measuring the mass of water per unit height of the ice making cell is malfunctioned, or when the water supplied to the ice making cell is insufficient or excessive, the shape of the ice making water is changed, and thus the transparency of the made ice may decrease. To solve this limitation, a water supply method in which an amount of water supplied to the ice making cell is precisely controlled is required. Also, the tray assembly may include a structure in which leakage of the tray assembly is reduced to reduce the leakage of water in the ice making cell at the water supply position or the ice making position. Also, it is necessary to increase the coupling force between the first and second tray assemblies defining the ice making cell so as to reduce the change in shape of the ice making cell due to the expansion force of the ice during the ice making. Also, it is necessary to decrease leakage in the tray assembly, precisely supply water and increase in coupling force between the first and second tray assemblies so as to make ice having a shape that is close to the tray shape.

The degree of supercooling of the water inside the ice making cell may affect the making of the transparent ice. The degree of supercooling of the water may affect the transparency of the made ice.

To make the transparent ice, it may be desirable to design the degree of supercooling to be lowered and thereby to maintain a predetermined range of temperature inside an ice making cell. This is because the supercooled liquid has a characteristic in which the solidification rapidly occurs from a time point at which the supercooling is terminated. In this case, the transparency of the ice may decrease.

In the process of solidifying the liquid, the controller of the refrigerator may control the supercooling release part to operate so as to reduce a degree of supercooling of the liquid if the time required for reaching the specific temperature below the freezing point after the temperature of the liquid reaches the freezing point is less than a reference value. After reaching the freezing point, it is seen that the temperature of the liquid is cooled below the freezing point as the supercooling occurs, and no solidification occurs.

An example of the supercooling release part may include an electrical spark generating part. When the spark is supplied to the liquid, the degree of supercooling of the liquid may be reduced. Another example of the supercooling release part may include a driver applying external force so that the liquid moves. The driver may allow the container to move in at least one direction among X, Y, or Z axes or to rotate about at least one axis among X, Y, or Z axes. When kinetic energy is supplied to the liquid, the degree of supercooling of the liquid may be reduced. Further another example of the supercooling release part may include a part supplying the liquid to the container. After supplying the liquid having a first volume less than that of the container, when a predetermined time has elapsed or the temperature of the liquid reaches a certain temperature below the freezing point, the controller of the refrigerator may control an amount of liquid to additionally supply the liquid having a second volume greater than the first volume. When the liquid is divided and supplied to the container as described above, the liquid supplied first may be solidified to act as freezing nucleus, and thus, the degree of supercooling of the liquid to be supplied may be further reduced.

The more the degree of heat transfer of the container containing the liquid increase, the more the degree of supercooling of the liquid may increase. The more the degree of heat transfer of the container containing the liquid decrease, the more the degree of supercooling of the liquid may decrease.

The structure and method of heating the ice making cell in addition to the degree of heat transfer of the tray assembly may affect the making of the transparent ice. As described above, the tray assembly may include a first region and a second region, which define an outer circumferential surface of the ice making cell. For example, each of the first and second regions may be a portion of one tray assembly. For another example, the first region may be a first tray assembly. The second region may be a second tray assembly.

The cold supplied to the ice making cell and the heat supplied to the ice making cell have opposite properties. To increase the ice making rate and/or improve the transparency of the ice, the design of the structure and control of the cooler and the heater, the relationship between the cooler and the tray assembly, and the relationship between the heater and the tray assembly may be very important.

For a constant amount of cold supplied by the cooler and a constant amount of heat supplied by the heater, it may be advantageous for the heater to be arranged to locally heat the ice making cell so as to increase the ice making rate of the refrigerator and/or to increase the transparency of the ice. As the heat transmitted from the heater to the ice making cell is reduced toward an area other than the area on which the heater is disposed, the ice making rate may be improved. As the heater heats only a portion of the ice making cell, the bubbles may be moved or collected to an area adjacent to the heater in the ice making cell, thereby increasing the transparency of the ice.

When the amount of heat supplied by the heater to the ice making cell is large, the bubbles in the water may be moved or collected in the portion to which the heat is supplied, and thus, the made ice may increase in transparency. However, if the heat is uniformly supplied to the outer circumferential surface of the ice making cell, the ice making rate of the ice may decrease. Therefore, as the heater locally heats a portion of the ice making cell, it is possible to increase the transparency of the made ice and minimize the decrease of the ice making rate.

The heater may be disposed to contact one side of the tray assembly. The heater may be disposed between the tray and the tray case. The heat transfer through the conduction may be advantageous for locally heating the ice making cell.

At least a portion of the other side at which the heater does not contact the tray may be sealed with a heat insulation material. Such a configuration may reduce that the heat supplied from the heater is transferred toward the storage chamber.

The tray assembly may be configured so that the heat transfer from the heater toward the center of the ice making cell is greater than that of from the heater in the circumference direction of the ice making cell.

The heat transfer of the tray toward the center of the ice making cell in the tray may be greater than a heat transfer from the tray case to the storage chamber, or the thermal conductivity of the tray may be greater than that of the tray case. Such a configuration may induce the increase in heat transmitted from the heater to the ice making cell via the tray. In addition, it is possible to reduce the heat of the heater is transferred to the storage chamber via the tray case.

The heat transfer of the tray toward the center of the ice making cell in the tray may be less than that of the refrigerator case toward the storage chamber from the outside of the refrigerator case (for example, an inner case or an outer case), or the thermal conductivity of the tray may be less than that of the refrigerator case. This is because the more the heat or thermal conductivity of the tray increases, the more the supercooling of the water accommodated in the tray may increase. The more the degree of supercooling of the water increase, the more the water may be rapidly solidified at the time point at which the supercooling is released. In this case, a limitation may occur in which the transparency of the ice is not uniform or the transparency decreases. In general, the case of the refrigerator may be made of a metal material including steel.

The heat transfer of the tray case in the direction from the storage chamber to the tray case may be greater than the that of the heat insulation wall in the direction from the outer space of the refrigerator to the storage chamber, or the thermal conductivity of the tray case may be greater than that of the heat insulation wall (for example, the insulation material disposed between the inner and outer cases of the refrigerator). Here, the heat insulation wall may represent a heat insulation wall that partitions the external space from the storage chamber. If the degree of heat transfer of the tray case is equal to or greater than that of the heat insulation wall, the rate at which the ice making cell is cooled may be excessively reduced.

The first region may be configured to have a different degree of heat transfer in a direction along the outer circumferential surface. The degree of heat transfer of one portion of the first region may be less than that of the other portion of the first region. Such a configuration may be assisted to reduce the heat transfer transferred through the tray assembly from the first region to the second region in the direction along the outer circumferential surface.

The first and second regions defined to contact each other may be configured to have a different degree of heat transfer in the direction along the outer circumferential surface. The degree of heat transfer of one portion of the first region may be configured to be less than the degree of heat transfer of one portion of the second region. Such a configuration may be assisted to reduce the heat transfer transferred through the tray assembly from the first region to the second region in the direction along the outer circumferential surface. In another aspect, it may be advantageous to reduce the heat transferred from the heater to one portion of the first region to be transferred to the ice making cell defined by the second region. As the heat transmitted to the second region is reduced, the heater may locally heat one portion of the first region. Thus, it may be possible to reduce the decrease in ice making rate by the heating of the heater. In another aspect, the bubbles may be moved or collected in the region in which the heater is locally heated, thereby improving the transparency of the ice. The heater may be a transparent ice heater.

For example, a length of the heat transfer path from the first region to the second region may be greater than that of the heat transfer path in the direction from the first region to the outer circumferential surface from the first region. For another example, in a thickness of the tray assembly in the direction of the outer circumferential surface of the ice making cell from the center of the ice making cell, one portion of the first region may be thinner than the other portion of the first region or thinner than one portion of the second region. One portion of the first region may be a portion at which the tray case is not surrounded. The other portion of the first region may be a portion that is surrounded by the tray case. One portion of the second region may be a portion that is surrounded by the tray case. One portion of the first region may be a portion of the first region that defines the lowest end of the ice making cell. The first region may include a tray and a tray case locally surrounding the tray.

As described above, when the thickness of the first region is thin, the heat transfer in the direction of the center of the ice making cell may increase while reducing the heat transfer in the direction of the outer circumferential surface of the ice making cell. For this reason, the ice making cell defined by the first region may be locally heated.

A minimum value of the thickness of one portion of the first region may be less than that of the thickness of the other portion of the second region or less than that of one of the second region. A maximum value of the thickness of one portion of the first region may be less than that of the thickness of the other portion of the first region or less than that of the thickness of one portion of the second region. When the through-hole is defined in the region, the minimum value represents the minimum value in the remaining regions except for the portion in which the through-hole is defined. An average value of the thickness of one portion of the first region may be less than that of the thickness of the other portion of the first region or may be less than that of a thickness of one portion the second region. The uniformity of the thickness of one portion of the first region may be greater than that of the thickness of the other portion of the first region or greater than that of the thickness of one portion of the second region.

For example, the tray assembly may include a first portion defining at least a portion of the ice making cell and a second portion extending from a predetermined point of the first portion. The first region may be defined in the first portion. The second region may be defined in an additional tray assembly that may contact the first portion. At least a portion of the second portion may extend in a direction away from the ice making cell defined by the second region. In this case, the heat transmitted from the heater to the first region may be reduced from being transferred to the second region.

The structure and method of cooling the ice making cell in addition to the degree of cold transfer of the tray assembly may affect the making of the transparent ice. As described above, the tray assembly may include a first region and a second region, which define an outer circumferential surface of the ice making cell. For example, each of the first and second regions may be a portion of one tray assembly. For another example, the first region may be a first tray assembly. The second region may be a second tray assembly.

For a constant amount of cold supplied by the cooler and a constant amount of heat supplied by the heater, it may be advantageous to configure the cooler so that a portion of the ice making cell is more intensively cooled to increase the ice making rate of the refrigerator and/or increase the transparency of the ice. The more the cold supplied to the ice making cell by the cooler increases, the more the ice making rate may increase. However, as the cold is uniformly supplied to the outer circumferential surface of the ice making cell, the transparency of the made ice may decrease. Therefore, as the cooler more intensively cools a portion of the ice making cell, the bubbles may be moved or collected to other regions of the ice making cell, thereby increasing the transparency of the made ice and minimizing the decrease in ice making rate.

The cooler may be configured so that the amount of cold supplied to the second region differs from that of cold supplied to the first region so as to allow the cooler to more intensively cool a portion of the ice making cell. The amount of cold supplied to the second region by the cooler may be greater than that of cold supplied to the first region.

For example, the second region may be made of a metal material having a high cold transfer rate, and the first region may be made of a material having a cold transfer rate less than that of the metal.

For another example, to increase the degree of cold transfer transmitted from the storage chamber to the center of the ice making cell through the tray assembly, the second region may vary in degree of cold transfer toward the central direction. The degree of cold transfer of one portion of the second region may be greater than that of the other portion of the second region. A through-hole may be defined in one portion of the second region. At least a portion of the heat absorbing surface of the cooler may be disposed in the through-hole. A passage through which the cold air supplied from the cooler passes may be disposed in the through-hole. The one portion may be a portion that is not surrounded by the tray case. The other portion may be a portion surrounded by the tray case. One portion of the second region may be a portion defining the uppermost portion of the ice making cell in the second region. The second region may include a tray and a tray case locally surrounding the tray. As described above, when a portion of the tray assembly has a high cold transfer rate, the supercooling may occur in the tray assembly having a high cold transfer rate. As described above, designs may be needed to reduce the degree of the supercooling.

Figure 2:
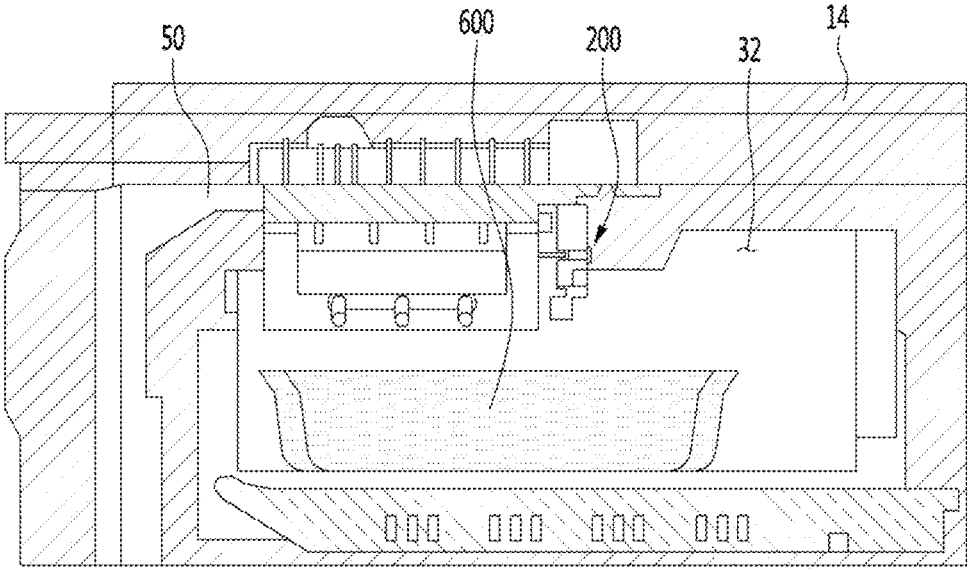
FIG. 2 is a side cross-sectional view of the refrigerator in which an ice maker is installed.

FIG. 1 is a front view of a refrigerator according to an embodiment of the present invention, and FIG. 2 is a side cross-sectional view of the refrigerator in which an ice maker is installed.

As illustrated in FIG. 1(*a*), a refrigerator according to an embodiment of the present invention may include a plurality of doors 10, 20, and 30 opening and closing a storage chamber for food. The doors 10, 20, and 30 may include doors 10 and 20 opening and closing the storage chamber in a rotatable manner and a door 30 for opening and closing the storage chamber in a sliding manner.

FIG. 1(*b*) is a cross-sectional view of the refrigerator when viewed from a rear side. A refrigerator cabinet 14 may include a refrigerating compartment 18 and a freezing compartment 32. The refrigerating compartment 18 is disposed at an upper side, and the freezing compartment 32 is disposed at a lower side so that each of the storage chamber is opened and closed individually by each door. Unlike this embodiment, it may be applied to a refrigerator in which a freezing compartment is disposed on an upper side, and a refrigerating compartment is disposed on a lower side.

The freezing compartment 32 is divided into an upper space and a lower space, and a drawer 40 capable of being withdrawn from and inserted into the lower space is provided in the lower space. The freezing compartment 32 may be provided to be separated into two spaces even though the freezing compartment 32 is opened and closed by one door 30.

An ice maker 200 that is capable of making ice may be provided in the upper space of the freezing compartment 32.

An ice bin 600 in which the ice made by the ice maker 200 falls to be stored may be disposed below the ice maker 200. A user may take out the ice bin 600 from the freezing compartment 32 to use ice stored in the ice bin 600. The ice bin 600 may be mounted at an upper side of a horizontal wall that partitions an upper space and a lower space of the freezing compartment 32 from each other.

Referring to FIG. 2, a duct that supplies cold air, which is an example of cold, to the ice maker 200 may be provided in the cabinet 14. The duct 50 cools the ice maker 200 by discharging cold air supplied from an evaporator through which a refrigerant compressed by a compressor is evaporated. Ice may be generated in the ice maker 200 by the cold air supplied to the ice maker 200.

In FIG. 2, it is possible that a right side is a rear side of the refrigerator, and a left side is a front side of the refrigerator, i.e., a portion on which the door is installed. For example, the duct may be disposed behind the cabinet 14 to discharge the cold air toward a front side of the cabinet 14. The ice maker 200 is disposed in front of the duct 50.

An outlet of the duct 50 may be disposed in a ceiling of the freezing compartment 32 to discharge the cold air to an upper side of the ice maker 200.

Figure 3:
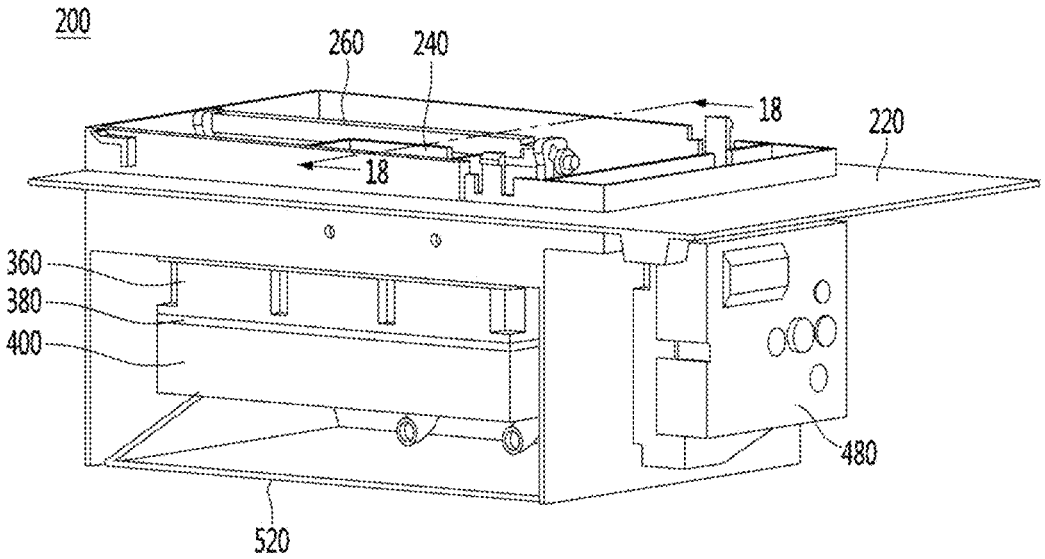
FIGS. 3(*a*) and (*b*) are perspective views of the ice maker according to an embodiment of the present invention.
Figure 3:
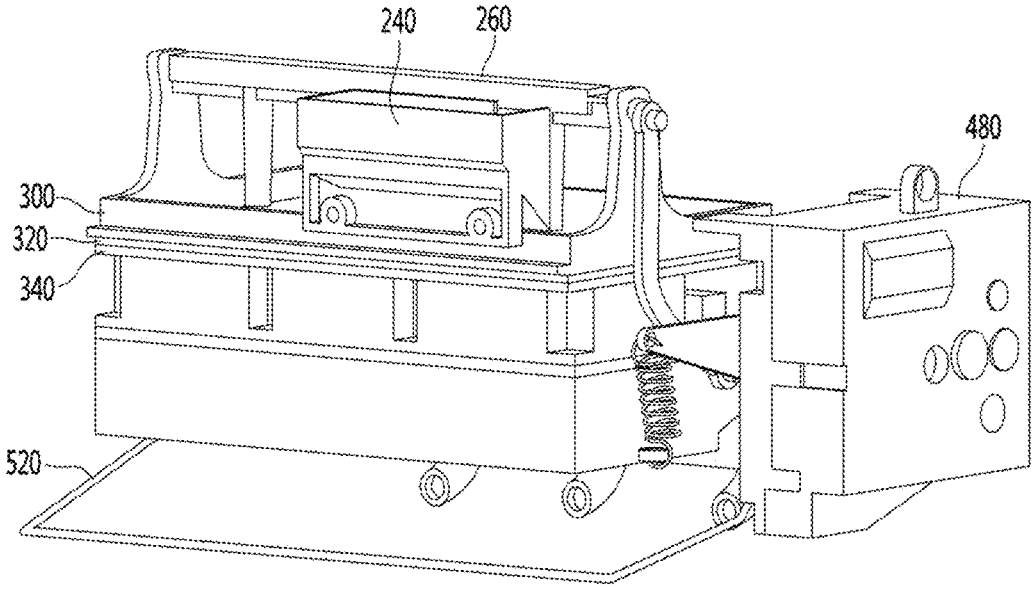
Figure 4:
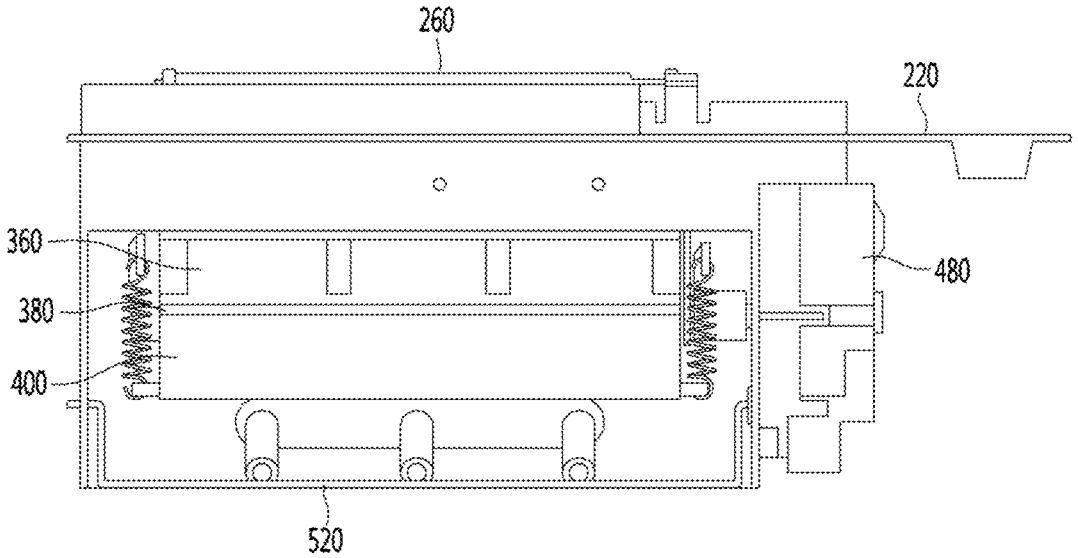
FIGS. 4(*a*) and (*b*) are front views of the ice maker.
Figure 4:
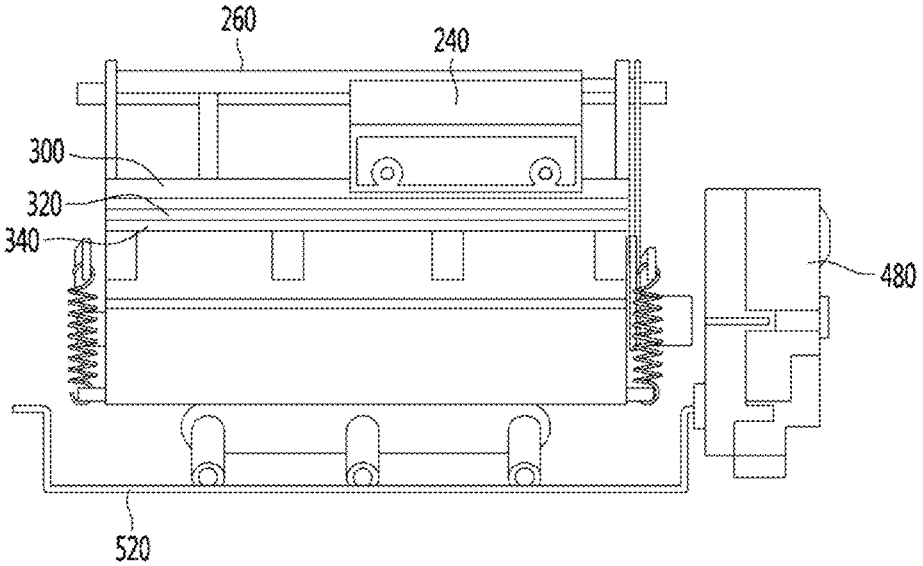
Figure 5:
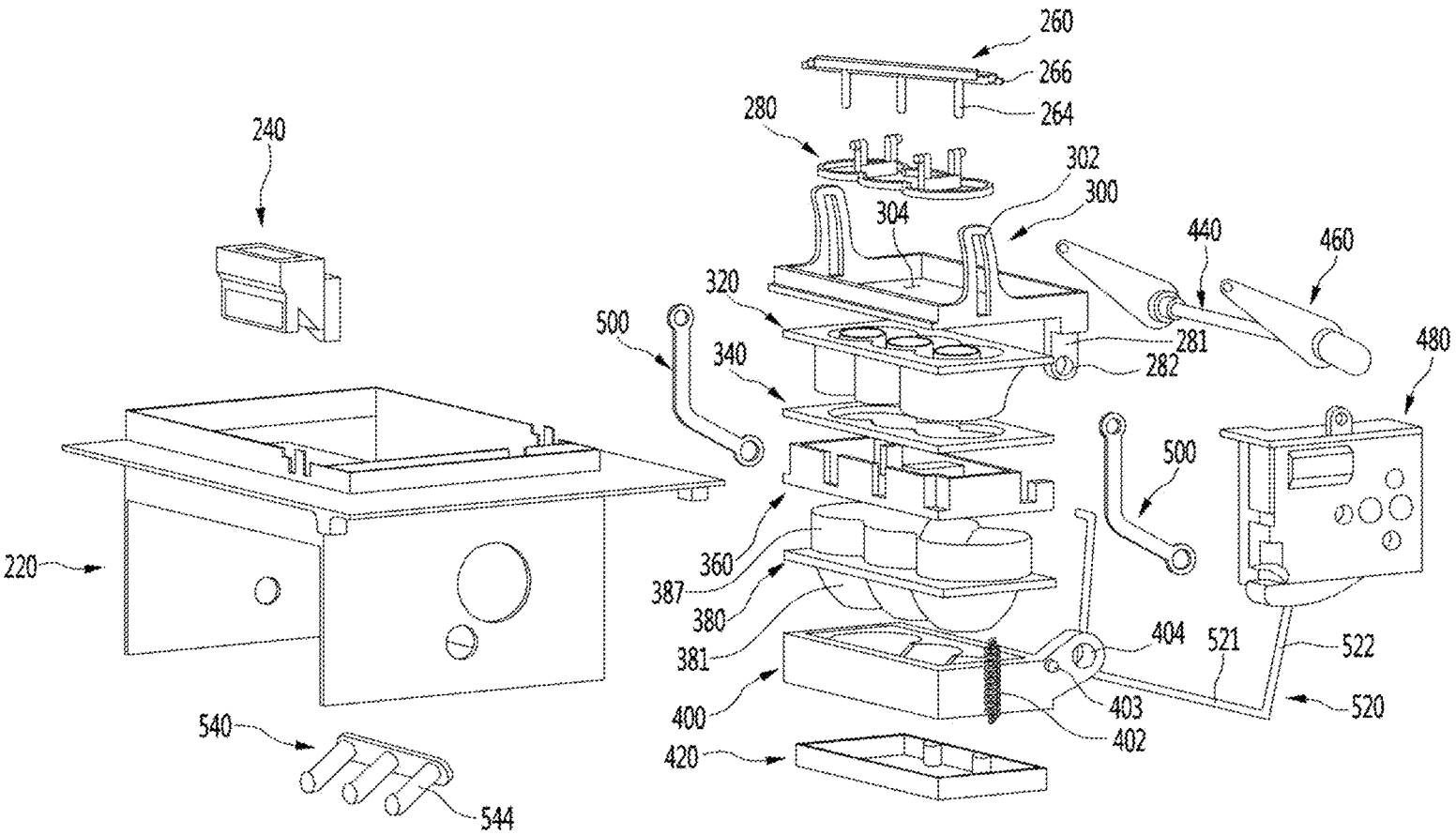
FIG. 5 is an exploded perspective view of the ice maker.

FIG. 3 is a perspective view of the ice maker according to an embodiment of the present invention, FIG. 4 is a front view of the ice maker, and FIG. 5 is an exploded perspective view of the ice maker.

FIGS. 3*a* and 4*a* are views illustrating a structure in which a bracket 220 fixing the ice maker 200 is included in the freezing compartment 32, and FIGS. 3*b* and 4*b* are views illustrating a state in which the bracket 220 is removed. Each component of the ice maker 200 may be provided inside or outside the bracket 220, and thus, the ice maker 200 may constitute one assembly. Thus, the ice maker 200 may be installed on the ceiling of the freezing compartment 32.

A water supply part 240 installed on an upper side of an inner surface of the bracket 200. The water supply part 240 may be provided with an opening in each of an upper side and a lower side to guide water, which is supplied to an upper side of the water supply part 240, to a lower side of the water supply part 240. An upper opening of the water supply part 240 may be greater than a lower opening to limit a discharge range of water guided downward through the water supply part 240.

A water supply pipe through which water is supplied may be installed above the water supply part 240 to supply water to the water supply part, and then, the supplied water may move downward. The water supply part 240 may prevent the water discharged from the water supply pipe from dropping from a high position, thereby preventing the water from splashing. Since the water supply part 240 is disposed below the water supply pipe, the water may be guided without splashing up to the water supply part 240, and an amount of splashing water may be reduced even if the water moves downward due to the lowered height.

Figure 18:
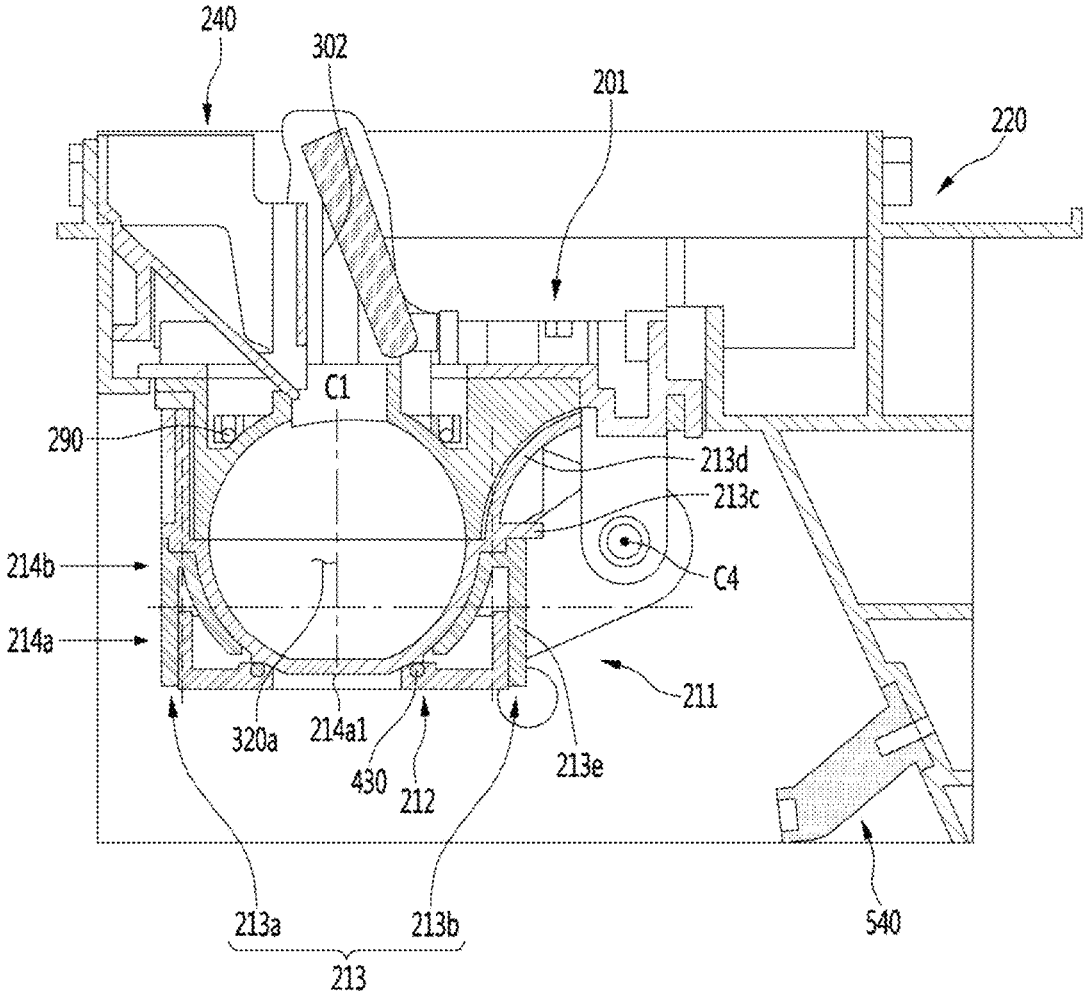
FIG. 18 is a cross-sectional view taken along line 18-18 of (a) of FIG. 4.

The ice maker 200 may include a tray defining an ice making cell 320*a* (see FIG. 18). The tray may include, for example, a first tray 320 defining a portion of the ice making cell 320*a* and a second tray 380 defining the other portion of the ice making cell 320*a*.

The first tray 320 and the second tray 380 may define a plurality of ice making cells 320*a* in which a plurality of ice are generated. A first cell provided in the first tray 320 and a second cell provided in the second tray 380 may form a complete ice making cell 320*a*.

The first tray 320 may have openings in upper and lower sides, respectively, so that water falling from the upper side of the first tray 320 moves downward.

A first tray supporter 340 may be disposed under the first tray 320. The first tray supporter 340 may be provided with an opening corresponding to a shape of each of the cells of the first tray 320 and may be coupled to a bottom surface of the first tray 320.

A first tray cover 300 may be coupled to an upper side of the first tray 320. An outer appearance of the upper side of the first tray 320 may be maintained. A first heater case 280 may be coupled to the first tray cover 300. Alternatively, the first heater case 280 may be integrally formed with the first tray cover 300.

The first heater case 280 is provided with a first heater (a heater for separating ice) to supply heat to an upper portion of the ice maker 200. The first heater may be embedded in the first heater case 280 or installed on one surface of the first heater case 280.

The first tray cover 300 may be provided with a guide slot 302 of which an upper side is inclined, and a lower side vertically extends. The guide slot 302 may be provided in a member extending upward from the first tray cover 300.

A guide protrusion 266 of a first pusher 260 may be inserted into the guide slot 302, and thus, the guide protrusion 266 may be guided along the guide slot 302. The first pusher 260 may be provided with an extension part 264 extending by the same number of cells of each of the first tray 320 to push ice disposed in each cell.

The guide protrusion 266 of the first pusher 260 may be coupled to a pusher link 500. Here, the guide protrusion 266 may be rotatably coupled to the pusher link 500. Thus, when the pusher link 500 moves, the first pusher 260 may also move along the guide slot 302.

A second tray cover 360 may be provided at the upper side of the second tray 380 to maintain an outer appearance of the second tray 380. The second tray 380 may have a shape protruding upward so that the plurality of cells constituting a space in which individual ice is generated are divided, and the second tray cover 360 may surround the cell protruding upward.

A second tray supporter 400 may be provided on a lower portion of the second tray 380 to maintain a shape of the cell protruding from the second tray 380. A spring 402 may be provided at one side of the second tray supporter 400.

A second heater case 420 is provided under the second tray supporter 400. A second heater (transparent ice heater) may be provided in the second heater case 420 to supply heat to the lower portion of the ice maker 200.

The ice maker 200 is provided with a driving part 480 that provides rotational force.

A through-hole 282 is defined in the extension part extending downward from one side of the first tray cover 300. A through-hole 404 is defined in the extension part extending from one side of the second tray supporter 400. The through-hole 282 and a shaft 440 passing through the through-hole 404 are provided, and a rotation arm 460 is provided at each of both ends of the shaft 440. The shaft 440 may rotate by receiving rotational force from the driver 480.

One end of the rotation arm 460 may be connected to one end of the spring 402, and thus, a position of the rotation arm 460 may move to an initial value by restoring force when the spring 402 is tensioned.

A motor and a plurality of gears may be coupled to each other in the driving part 480.

A full ice detection lever 520 may be connected to the driving part 480, and thus, the full ice detection lever 520 may rotate by the rotational force provided from the driving part 480.

The full ice detection lever 520 may have a '⊏' shape as a whole and may include a portion extending vertically at each of both ends and a portion disposed horizontally connecting two portions extending vertically to each other. Any one of the two vertically extending portions may be coupled to the driving part 480, and the other may be coupled to the bracket 220, and thus, the full ice detection lever 520 may rotate to detect ice stored in the ice bin 600.

A second pusher 540 is provided on an inner lower side of the bracket 220. The second pusher 540 is provided with a coupling piece coupled to the bracket 220 and a plurality of extension parts 544 installed on the coupling piece. The plurality of extension parts 544 are provided in the same number as the cells provided in the second tray 380 to push the ice generated in the cells of the second tray 380 so as to be separated from the second tray 380.

The first tray cover 300 may be rotatably coupled to the second tray supporter 400 with respect to the second tray supporter 400 and then be disposed to be changed in angle about the shaft 440.

Each of the first tray 320 and the second tray 380 may be made of a material that is easily deformable, such as silicon. Thus, when pressed by each pusher, each tray may be instantly deformed so that the generated ice is easily separated from the tray.

FIGS. 6 to 11 are views illustrating a state in which some components of the ice maker are coupled to each other.

Figure 6:
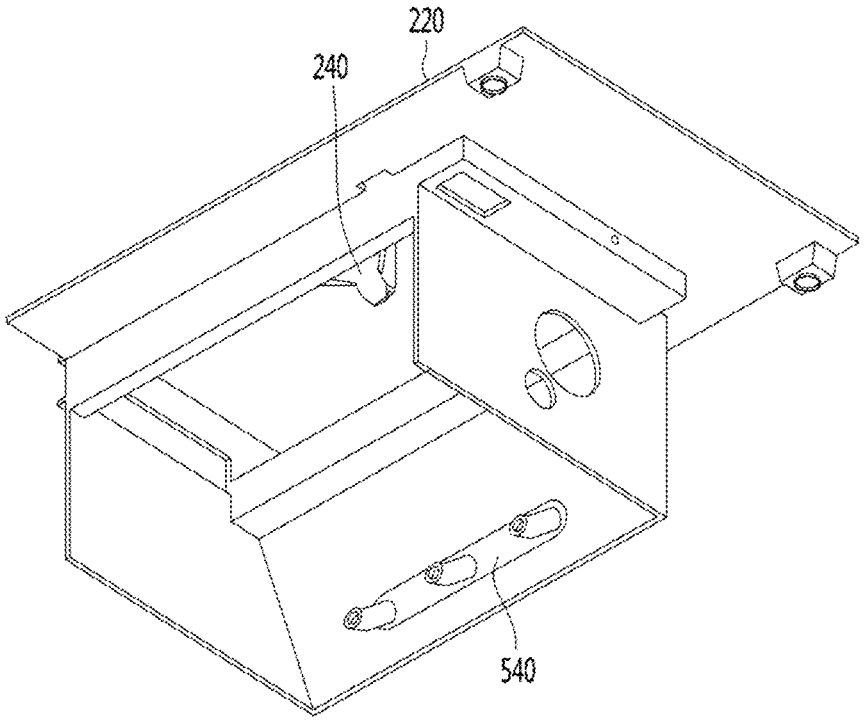
FIGS. 6 to 11 are views illustrating a state in which some components of the ice maker are coupled to each other.

FIG. 6 is a view illustrating a state in which the bracket 220, the water supply part 240, and the second pusher 540 are coupled to each other. The second pusher 540 is installed on an inner surface of the bracket 220, and the extension part of the second pusher 540 is disposed to be inclined downward so that the direction extending from the coupling piece is not vertical.

Figure 7:
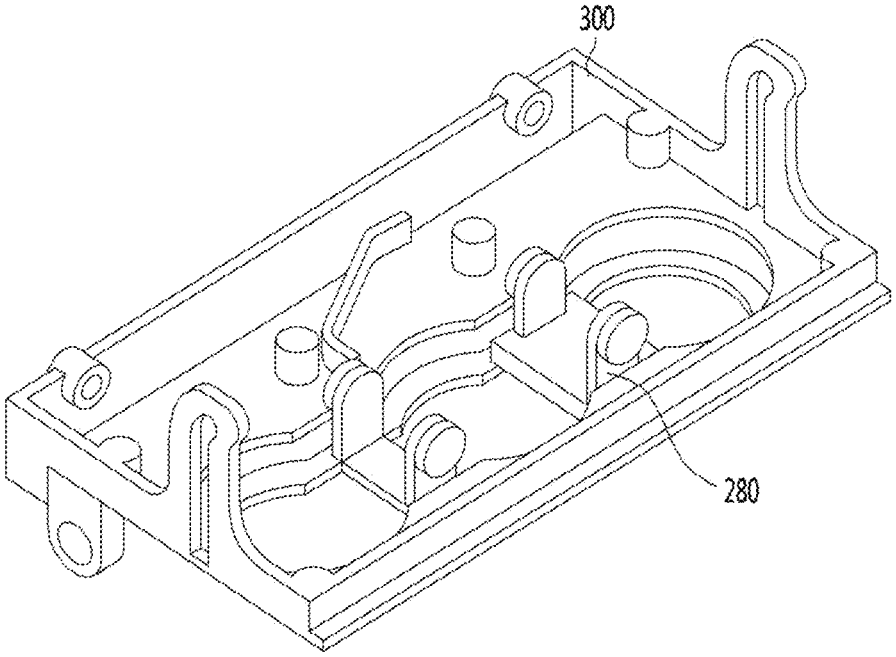

FIG. 7 is a view illustrating a state in which the first heater case 280 and the first tray cover 300 are coupled to each other.

The first heater case 280 may be disposed so that a horizontal surface is spaced downward from a lower surface of the first tray cover 300. Each of the first heater case 280 and the first tray cover 300 have an opening corresponding to each cell of the first tray 320 in an upper side thereof so that water passes therethrough, and the shape of each opening may correspond to that of the corresponding cell.

Figure 8:
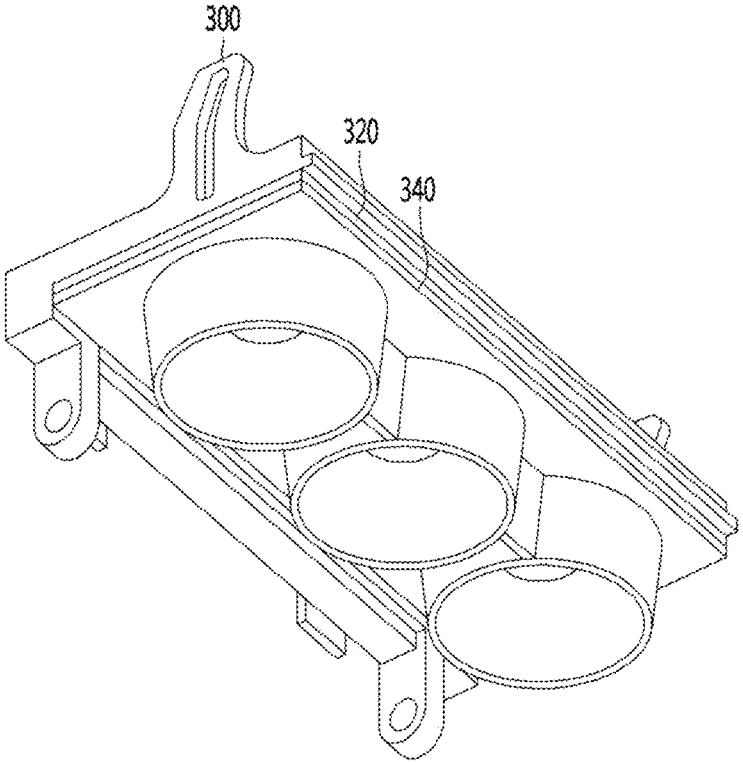

FIG. 8 is a view illustrating a state in which the first tray cover 300, the first tray 320, and the first tray supporter 340 are coupled to each other.

The first tray 320 is disposed between the first tray cover 300 and the first tray supporter 340.

The first tray cover 300, the first tray 320, and the first tray supporter 340 may be coupled as a single module, and the first tray cover 300, the first tray 320, and the first tray supporter 340 may be rotatably disposed together on the shaft 440 as if one member.

Figure 9:
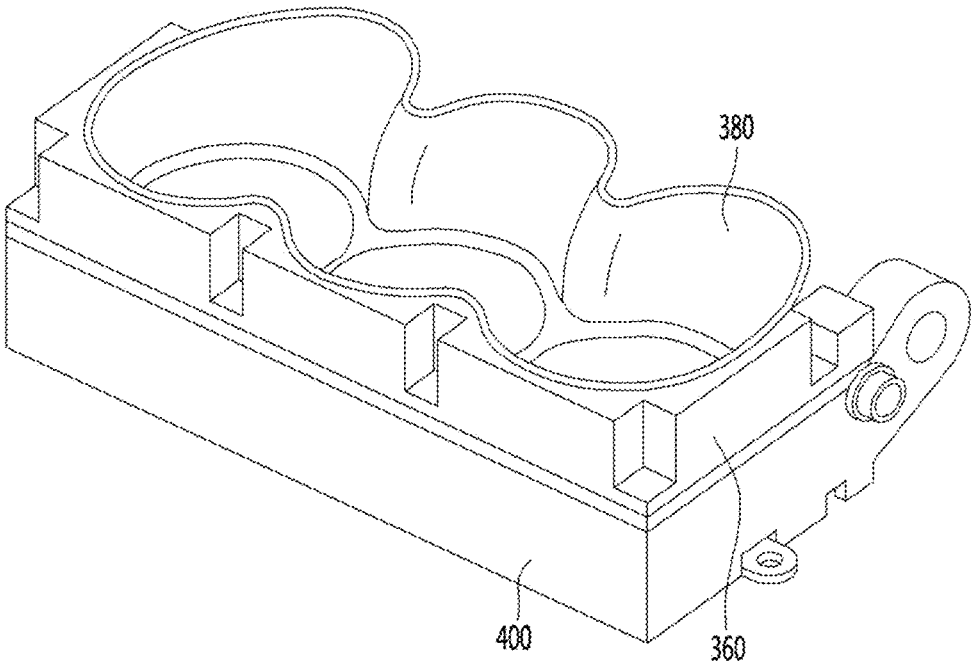

FIG. 9 is a view illustrating a state in which the second tray 380, the second tray cover 360, and the second tray supporter 400 are coupled to each other.

The second tray cover 360 is disposed at an upper side, and the second tray supports 400 is disposed at a lower side with the second tray 380 therebetween.

Each cell of the second tray 380 has a hemispherical shape to form a lower portion of the spherical ice.

Figure 10:
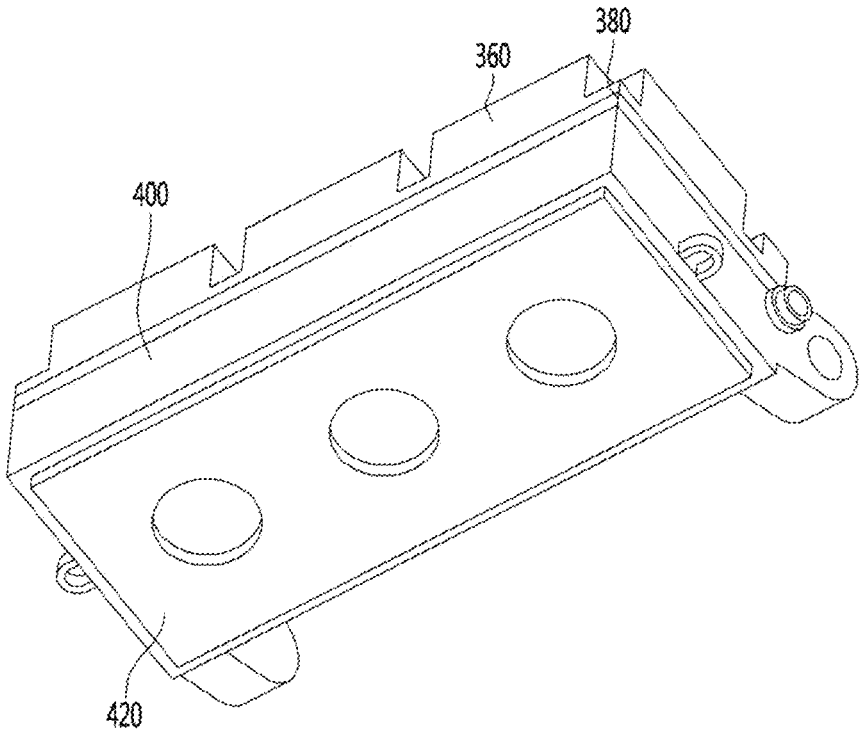

FIG. 10 is a view illustrating a state in which the second tray cover 360, the second tray 380, the second tray supporter 400, and the second heater case 420 are coupled to each other.

The second heater case 420 may be disposed on a lower surface of the second tray case to fix the heater that supplies heat to the second tray 380.

Figure 11:
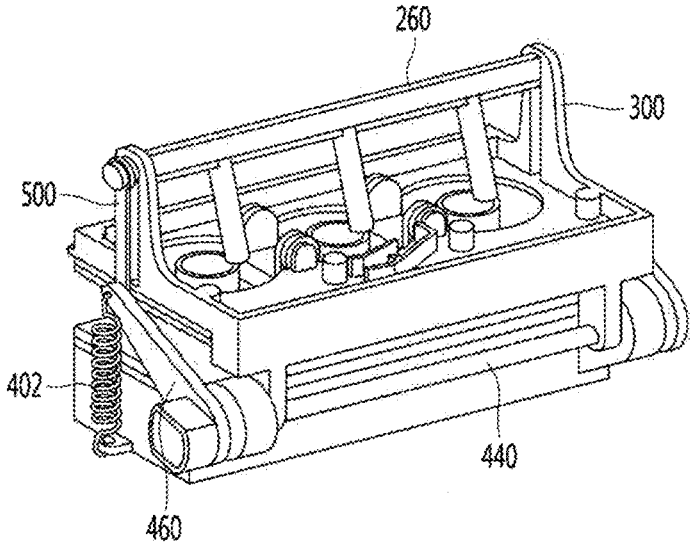

FIG. 11 is a view illustrated a state in which the rotary arm 460, the shaft 440, and the pusher link 500 are coupled to each other in combination with FIGS. 8 and 10.

One end of the rotation arm 460 is coupled to the shaft 440, and the other end is coupled to the spring 402. One end of the pusher link 500 is coupled to the first pusher 260, and the other end is disposed to be rotatable with respect to the shaft 440.

Figure 12:
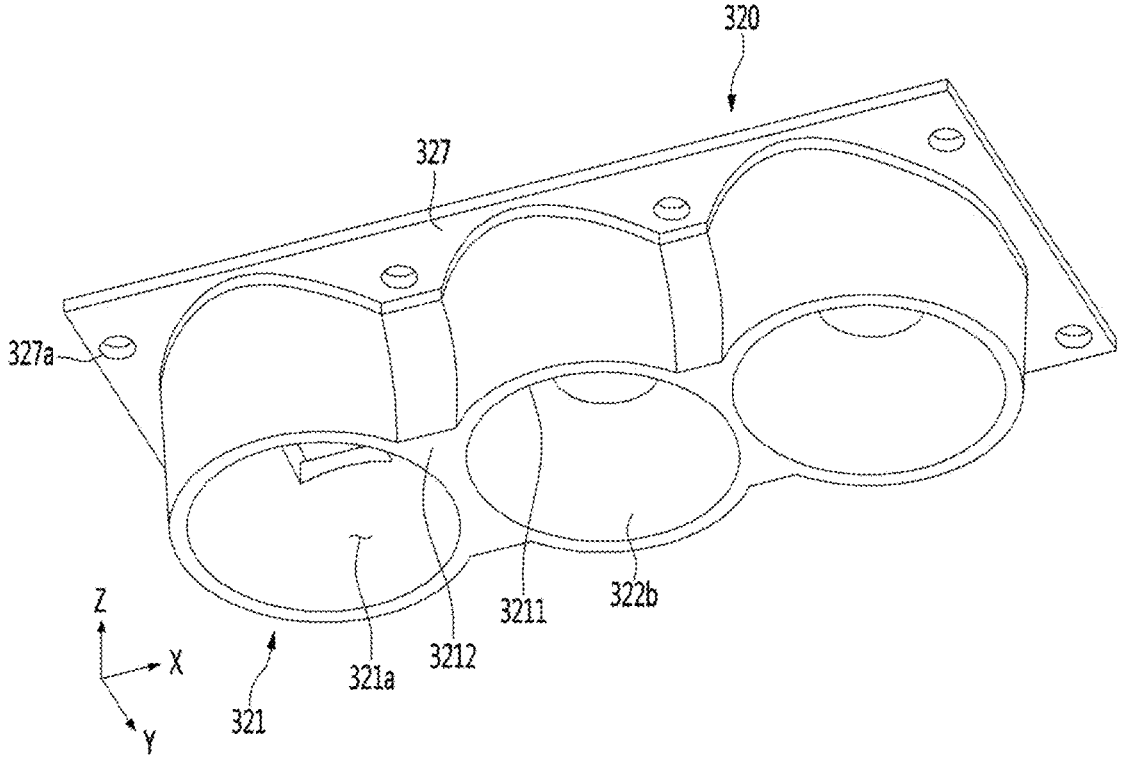
FIG. 12 is a perspective view of a first tray when viewed from a lower side according to an embodiment of the present invention.
Figure 13:
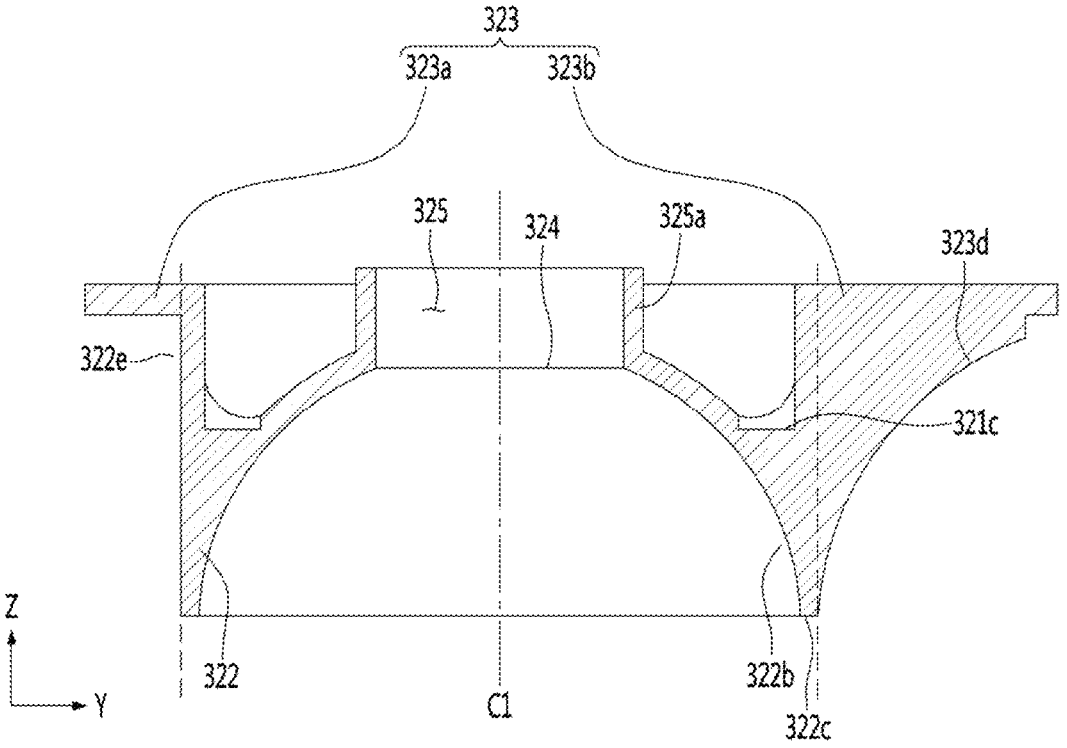
FIG. 13 is a cross-sectional view of the first tray according to an embodiment of the present invention.

FIG. 12 is a perspective view of the first tray when viewed from a lower side according to an embodiment of the present invention, and FIG. 13 is a cross-sectional view of the first tray according to an embodiment of the present invention.

Referring to FIGS. 12 to 13, the first tray 320 may define a first cell 321*a* that is a portion of the ice making cell 320*a*.

The first tray 320 may include a first tray wall 321 defining a portion of the ice making cell 320*a*.

For example, the first tray 320 may define a plurality of first cells 321*a*. For example, the plurality of first cells 321*a* may be arranged in a line. The plurality of first cells 321*a* may be arranged in an X-axis direction in FIG. 12. For example, the first tray wall 321 may define the plurality of first cells 321*a*.

The first tray wall 321 may include a plurality of first cell walls 3211 that respectively define the plurality of first cells 321*a*, and a connection wall 3212 connecting the plurality of first cell walls 3211 to each other. The first tray wall 321 may be a wall extending in the vertical direction.

The first tray 320 may include an opening 324. The opening 324 may communicate with the first cell 321*a*. The opening 324 may allow the cold air to be supplied to the first cell 321*a*. The opening 324 may allow water for making ice to be supplied to the first cell 321*a*. The opening 234 may provide a passage through which a portion of the first pusher 260 passes. For example, in the ice separation process, a portion of the first pusher 260 may be inserted into the ice making cell 320*a* through the opening 234.

The first tray 320 may include a plurality of openings 324 corresponding to the plurality of first cells 321*a*. One of the plurality of openings 324 324*a* may provide a passage of the cold air, a passage of the water, and a passage of the first pusher 260. In the ice making process, the bubbles may escape through the opening 324.

The first tray 320 may further include an auxiliary storage chamber 325 communicating with the ice making cell 320*a*. For example, the auxiliary storage chamber 325 may store water overflowed from the ice making cell 320*a*. The ice expanded in a process of phase-changing the supplied water may be disposed in the auxiliary storage chamber 325. That is, the expanded ice may pass through the opening 304 and be disposed in the auxiliary storage chamber 325. The auxiliary storage chamber 325 may be defined by a storage chamber wall 325*a*. The storage chamber wall 325*a* may extend upwardly around the opening 324. The storage chamber wall 325*a* may have a cylindrical shape or a polygonal shape. Substantially, the first pusher 260 may pass through the opening 324 after passing through the storage chamber wall 325*a*. The storage chamber wall 325*a* may define the auxiliary storage chamber 325 and also reduce deformation of the periphery of the opening 324 in the process in which the first pusher 260 passes through the opening 324 during the ice separation process.

The first tray 320 may include a first contact surface 322*c* contacting the second tray 380.

The first tray 320 may further include a first extension wall 327 extending in the horizontal direction from the first tray wall 321. For example, the first extension wall 327 may extend in the horizontal direction around an upper end of the first extension wall 327. One or more first coupling holes 327*a* may be provided in the first extension wall 327. Although not limited, the plurality of first coupling holes 327*a* may be arranged in one or more axes of the X axis and the Y axis.

In this specification, the "central line" is a line passing through a volume center of the ice making cell 320*a* or a center of gravity of water or ice in the ice making cell 320*a* regardless of the axial direction. The first edge line 327*b* and the second edge line 327*c* may be parallel to each other.

Referring to FIG. 13, the first tray 320 may include a first portion 322 that defines a portion of the ice making cell 320*a*. For example, the first portion 322 may be a portion of the first tray wall 321.

The first portion 322 may include a first cell surface 322*b* (or an outer circumferential surface) defining the first cell 321*a*. The first portion 333 may include the opening 324. Also, the first portion 322 may include a heater accommodation part 321*c*. The ice separation heater may be accommodated in the heater accommodation part 321*c*. The first portion 322 may be divided into a first region defined to be close to the second heater 430 and a second region defined to be far from the second heater 430 in the Z axis direction. The first region may include the first contact surface 322*c*, and the second region may include the opening 324. The first portion 322 may be defined as an area between two dotted lines in FIG. 13.

In a degree of deformation resistance from the center of the ice making cell 320*a* in the circumferential direction, at least a portion of the upper portion of the first portion 322 is greater than at least a portion of the lower portion. The degree of deformation resistance of at least a portion of the upper portion of the first portion 322 is greater than that of the lowermost end of the first portion 322.

The upper and lower portions of the first portion 322 may be divided based on an extension direction of a center line C1 (or a vertical center line) in the Z-axis direction in the ice making cell 320*a*. The lowermost end of the first portion 322 is the first contact surface 322*c* contacting the second tray 380.

The first tray 320 may further include a second portion 323 extending from a predetermined point of the first portion 322. The predetermined point of the first portion 322 may be one end of the first portion 322. Alternatively, the predetermined point of the first portion 322 may be one point of the first contact surface 322*c*. A portion of the second portion 323 may be defined by the first tray wall 321, and the other portion of the second portion 323 may be defined by the first extension wall 327. At least a portion of the second portion 323 may extend in a direction away from the second heater 430. At least a portion of the second portion 323 may extend upward from the first contact surface 322*c*. At least a portion of the second portion 323 may extend in a direction away from the central line C1. For example, the second portion 323 may extend in both directions along the Y axis from the central line C1. The second portion 323 may be disposed at a position higher than or equal to the uppermost end of the ice making cell 320*a*. The uppermost end of the ice making cell 320*a* is a portion at which the opening 324 is defined.

The second portion 323 may include a first extension part 323*a* and a second extension part 323*b*, which extend in different directions with respect to the central line C1.

The first tray wall 321 may include one portion of the second extension part 323*b* of each of the first portion 322 and the second portion 323. The first extension wall 327 may include the other portion of each of the first extension part 323*a* and the second extension part 323*b*.

Referring to FIG. 13, the first extension part 323*a* may be disposed at the left side with respect to the central line C1, and the second extension part 323*b* may be disposed at the right side with respect to the central line C1.

The first extension part 323*a* and the second extension part 323*b* may have different shapes based on the central line C1. The first extension part 323*a* and the second extension part 323*b* may be provided in an asymmetrical shape with respect to the central line C1.

A length of the second extension part 323*b* in the Y-axis direction may be greater than that of the first extension part 323*a*. Therefore, while the ice is made and grown from the upper side in the ice making process, the degree of deformation resistance of the second extension part 323*b* may increase.

The second extension part 323*b* may be disposed closer to the shaft 440 that provides a center of rotation of the second tray than the first extension part 323*a*. In this embodiment, since the length of the second extension part 323*b* in the Y-axis direction is greater than that of the first extension part 323*a*, the second tray 380 contacting the first tray 320 may increase in radius of rotation. When the rotation radius of the second tray increases, centrifugal force of the second tray may increase. Thus, in the ice separation process, separating force for separating the ice from the second tray may increase to improve ice separation performance.

The thickness of the first tray wall 321 is minimized at a side of the first contact surface 322*c*. At least a portion of the first tray wall 321 may increase in thickness from the first contact surface 322*c* toward the upper side. Since the thickness of the first tray wall 321 increases upward, a portion of the first portion 322 defined by the first tray wall 321 serves as an internal deformation reinforcement part (or a first internal deformation reinforcement part). In addition, the second portion 323 extending outward from the first portion 322 also serves as the internal deformation reinforcement part (or a second internal deformation reinforcement part).

The internal deformed reinforcement part may be directly or indirectly supported by the bracket 220. For example, the internal deformation reinforcement part may be connected to the first tray case and supported by the bracket 220. Here, a portion of the first tray case, which is in contact with the internal deformation reinforcement portion of the first tray 320, may also serve as the internal deformation reinforcement portion. The internal deformation reinforcement part may be configured so that ice is generated from the first cell 321*a* formed by the first tray 320 to the second cell 381*a* formed by the second tray 380 during the ice making process.

Figure 14:
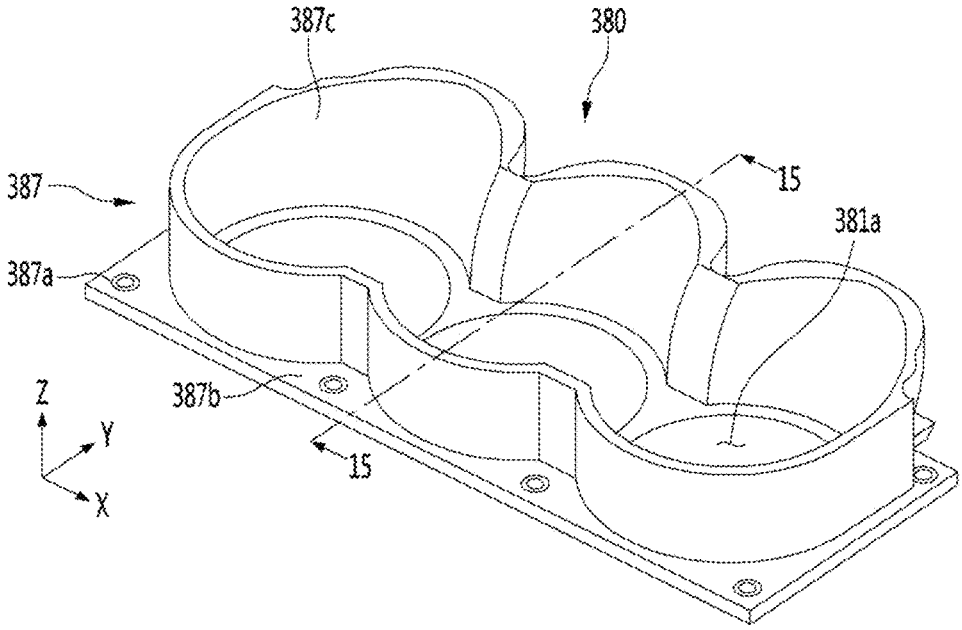
FIG. 14 is a perspective view of a second tray when viewed from an upper side according to an embodiment of the present invention.
Figure 15:
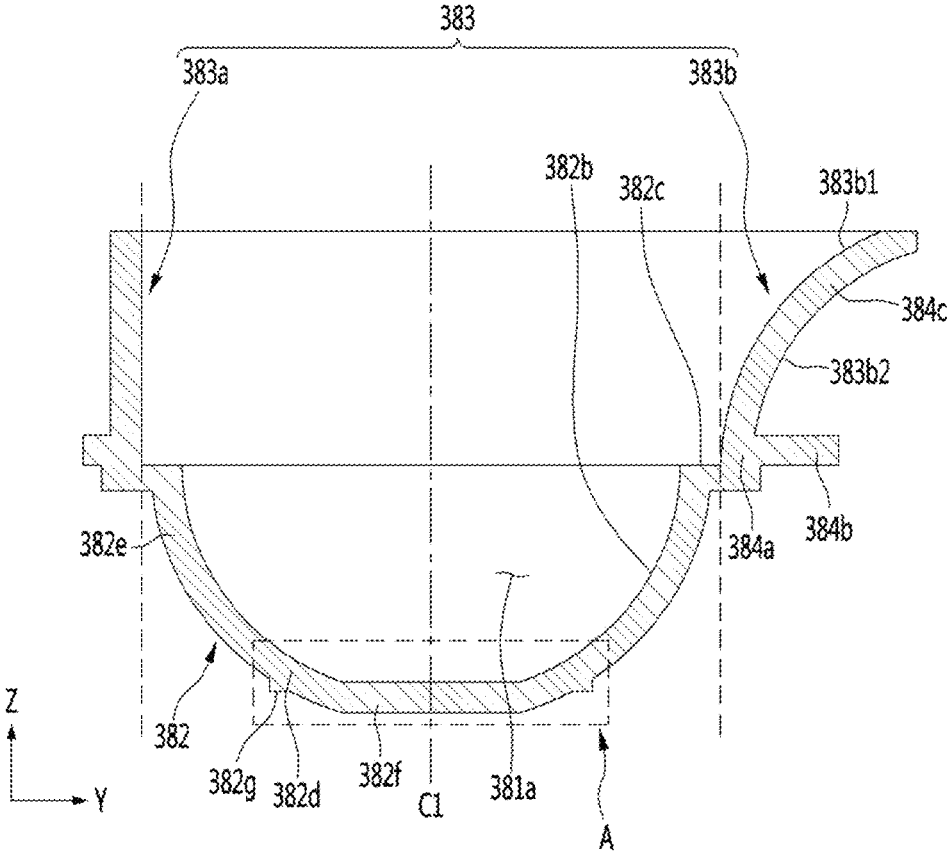
FIG. 15 is a cross-sectional view taken along line 15-15 of FIG. 14.

FIG. 14 is a perspective view of the second tray when viewed from an upper side according to an embodiment of the present invention, and FIG. 15 is a cross-sectional view taken along line 15-15 of FIG. 14.

Referring to FIGS. 14 and 1, the second tray 380 may define a second cell 381*a* which is another portion of the ice making cell 320*a*. The second tray 380 may include a second tray wall 381 defining a portion of the ice making cell 320*a*.

The second tray 380 may include a second tray wall 381 defining a portion of the ice making cell 320*a*.

For example, the second tray 380 may define a plurality of second cells 381*a*. For example, the plurality of second cells 381*a* may be arranged in a line. Referring to FIG. 14, the plurality of second cells 381*a* may be arranged in the X-axis direction. For example, the second tray wall 381 may define the plurality of second cells 381*a*.

The second tray 380 may include a circumferential wall 387 extending along a circumference of an upper end of the second tray wall 381. The circumferential wall 387 may be formed integrally with the second tray wall 381 and may extend from an upper end of the second tray wall 381. For another example, the circumferential wall 387 may be provided separately from the second tray wall 381 and disposed around the upper end of the second tray wall 381. In this case, the circumferential wall 387 may contact the second tray wall 381 or be spaced apart from the third tray wall 381. In any case, the circumferential wall 387 may surround at least a portion of the first tray 320. If the second tray 380 includes the circumferential wall 387, the second tray 380 may surround the first tray 320. When the second tray 380 and the circumferential wall 387 are provided separately from each other, the circumferential wall 387 may be integrally formed with the second tray case or may be coupled to the second tray case. For example, one second tray wall may define a plurality of second cells 381*a*, and one continuous circumferential wall 387 may surround the first tray 250.

The circumferential wall 387 may include a first extension wall 387*b* extending in the horizontal direction and a second extension wall 387*c* extending in the vertical direction. The first extension wall 387*b* may be provided with one or more second coupling holes 387*a* to be coupled to the second tray case. The plurality of second coupling holes 387*a* may be arranged in at least one axis of the X axis or the Y axis.

The second tray 380 may include a second contact surface 382*c* contacting the first contact surface 322*c* of the first tray 320. The first contact surface 322*c* and the second contact surface 382*c* may be horizontal planes. Each of the first contact surface 322*c* and the second contact surface 382*c* may be provided in a ring shape. When the ice making cell 320*a* has a spherical shape, each of the first contact surface 322*c* and the second contact surface 382*c* may have a circular ring shape.

The second tray 380 may include a first portion 382 that defines at least a portion of the ice making cell 320*a*. For example, the first portion 382 may be a portion or the whole of the second tray wall 381.

In this specification, the first portion 322 of the first tray 320 may be referred to as a third portion so as to be distinguished from the first portion 382 of the second tray 380. Also, the second portion 323 of the first tray 320 may be referred to as a fourth portion so as to be distinguished from the second portion 383 of the second tray 380.

The first portion 382 may include a second cell surface 382*b* (or an outer circumferential surface) defining the second cell 381*a* of the ice making cell 320*a*. The first portion 382 may be defined as an area between two dotted lines in FIG. 8. The uppermost end of the first portion 382 is the second contact surface 382*c* contacting the first tray 320.

The second tray 380 may further include a second portion 383. The second portion 383 may reduce transfer of heat, which is transferred from the second heater 430 to the second tray 380, to the ice making cell 320*a* defined by the first tray 320. That is, the second portion 383 serves to allow the heat conduction path to move in a direction away from the first cell 321*a*. The second portion 383 may be a portion or the whole of the circumferential wall 387. The second portion 383 may extend from a predetermined point of the first portion 382. In the following description, for example, the second portion 383 is connected to the first portion 382.

The predetermined point of the first portion 382 may be one end of the first portion 382. Alternatively, the predetermined point of the first portion 382 may be one point of the second contact surface 382*c*. The second portion 383 may include the other end that does not contact one end contacting the predetermined point of the first portion 382. The other end of the second portion 383 may be disposed farther from the first cell 321*a* than one end of the second portion 383.

At least a portion of the second portion 383 may extend in a direction away from the first cell 321*a*. At least a portion of the second portion 383 may extend in a direction away from the second cell 381*a*. At least a portion of the second portion 383 may extend upward from the second contact surface 382*c*. At least a portion of the second portion 383 may extend horizontally in a direction away from the central line C1. A center of curvature of at least a portion of the second portion 383 may coincide with a center of rotation of the shaft 440 which is connected to the driver 480 to rotate.

The second portion 383 may include a first part 384*a* extending from one point of the first portion 382. The second portion 383 may further include a second part 384*b* extending in the same direction as the extending direction with the first part 384*a*. Alternatively, the second portion 383 may further include a third part 384*c* extending in a direction different from the extending direction of the first part 384*a*. Alternatively, the second portion 383 may further include a second part 384*b* and a third part 384*c* branched from the first part 384*a*.

For example, the first part 384*a* may extend in the horizontal direction from the first portion 382. A portion of the first part 384*a* may be disposed at a position higher than that of the second contact surface 382*c*. That is, the first part 384*a* may include a horizontally extension part and a vertically extension part. The first part 384*a* may further include a portion extending in the vertical direction from the predetermined point. For example, a length of the third part 384*c* may be greater than that of the second part 384*b*.

The extension direction of at least a portion of the first part 384*a* may be the same as that of the second part 384*b*. The extension directions of the second part 384*b* and the third part 384*c* may be different from each other. The extension direction of the third part 384*c* may be different from that of the first part 384*a*. The third part 384*a* may have a constant curvature based on the Y-Z cutting surface. That is, the same curvature radius of the third part 384*c* may be constant in the longitudinal direction. The curvature of the second part 384*b* may be zero. When the second part 384*b* is not a straight line, the curvature of the second part 384*b* may be less than that of the third part 384*c*. The curvature radius of the second part 384*b* may be greater than that of the third part 384*c*.

At least a portion of the second portion 383 may be disposed at a position higher than or equal to that of the uppermost end of the ice making cell 320*a*. In this case, since the heat conduction path defined by the second portion 383 is long, the heat transfer to the ice making cell 320*a* may be reduced. A length of the second portion 383 may be greater than the radius of the ice making cell 320*a*. The second portion 383 may extend up to a point higher than the center of rotation of the shaft 440. For example, the second portion 383 may extend up to a point higher than the uppermost end of the shaft 440.

The second portion 383 may include a first extension part 383*a* extending from a first point of the first portion 382 and a second extension part 383*b* extending from a second point of the first portion 382 so that transfer of the heat of the second heater 430 to the ice making cell 320*a* defined by the first tray 320 is reduced. For example, the first extension part 383*a* and the second extension part 383*b* may extend in different directions with respect to the central line C1.

Referring to FIG. 15, the first extension part 383*a* may be disposed at the left side with respect to the central line C1, and the second extension part 383*b* may be disposed at the right side with respect to the central line C1. The first extension part 383*a* and the second extension part 383*b* may have different shapes based on the central line C1. The first extension part 383*a* and the second extension part 383*b* may be provided in an asymmetrical shape with respect to the central line C1. A length (horizontal length) of the second extension part 383*b* in the Y-axis direction may be longer than the length (horizontal length) of the first extension part 383*a*. The second extension part 383*b* may be disposed closer to the shaft 440 that provides a center of rotation of the second tray than the first extension part 383*a*.

In this embodiment, a length of the second extension part 383*b* in the Y-axis direction may be greater than that of the first extension part 383*a*. In this case, the heat conduction path may increase while reducing the width of the bracket 220 relative to the space in which the ice maker 200 is installed.

Since the length of the second extension part 383*b* in the Y-axis direction is greater than that of the first extension part 383*a*, the second tray 380 contacting the first tray 320 may increase in radius of rotation. When the rotation radius of the second tray increases centrifugal force of the second tray may increase. Thus, in the ice separation process, separating force for separating the ice from the second tray may increase to improve ice separation performance. The center of curvature of at least a portion of the second extension part 383*b* may be a center of curvature of the shaft 440 which is connected to the driver 480 to rotate.

A distance between an upper portion of the first extension part 383*a* and an upper portion of the second extension part 383*b* may be greater than that between a lower portion of the first extension part 383*a* and a lower portion of the second extension part 383*b* with respect to the Y-Z cutting surface passing through the central line C1. For example, a distance between the first extension part 383*a* and the second extension part 383*b* may increase upward. Each of the first extension part 383*a* and the second extension part 383*b* may include first to third parts 384*a*, 384*b*, and 384*c*. In another aspect, the third part 384*c* may also be described as including the first extension part 383*a* and the second extension part 383*b* extending in different directions with respect to the central line C1.

The first portion 382 may include a first region 382*d* (see region A in FIG. 15) and a second region 382*e* (a region except for the region A). The curvature of at least a portion of the first region 382*d* may be different from that of at least a portion of the second region 382*e*. The first region 382*d* may include the lowermost end of the ice making cell 320*a*. The second region 382*e* may have a diameter greater than that of the first region 382*d*. The first region 382*d* and the second region 382*e* may be divided vertically. The second heater 430 may contact the first region 382*d*. The first region 382*d* may include a heater contact surface 382*g* contacting the second heater 430. The heater contact surface 382*g* may be, for example, a horizontal plane. The heater contact surface 382*g* may be disposed at a position higher than that of the lowermost end of the first portion 382. The second region 382*e* may include the second contact surface 382*c*. The first region 382*d* may have a shape recessed in a direction opposite to a direction in which ice is expanded in the ice making cell 320*a*.

A distance from the center of the ice making cell 320*a* to the second region 382*e* may be less than that from the center of the ice making cell 320*a* to the portion at which the shape recessed in the first region 382*d* is disposed.

For example, the first region 382*d* may include a pressing part 382*f* that is pressed by the second pusher 540 during the ice separation process. When pressing force of the second pusher 540 is applied to the pressing part 382*f*, the pressing part 382*f* is deformed, and thus, ice is separated from the first portion 382. When the pressing force applied to the pressing part 382*f* is removed, the pressing part 382*f* may return to its original shape. The central line C1 may pass through the first region 382*d*. For example, the central line C1 may pass through the pressing part 382*f*. The heater contact surface 382*g* may be disposed to surround the pressing part 382*f*. The heater contact surface 382*g* may be disposed at a position higher than that of the lowermost end of the pressing part 382*f*.

At least a portion of the heater contact surface 382*g* may be disposed to surround the central line C1. Accordingly, at least a portion of the second heater 430 that is contact with the heater contact surface 382*g* may be disposed to surround the central line C1. Therefore, the second heater 430 may be prevented from interfering with the second pusher 540 while the second pusher 540 presses the pressing part 382*f*. A distance from the center of the ice making cell 320*a* to the pressing part 382*f* may be different from that from the center of the ice making cell 320*a* to the second region 382*e*.

Figure 16:
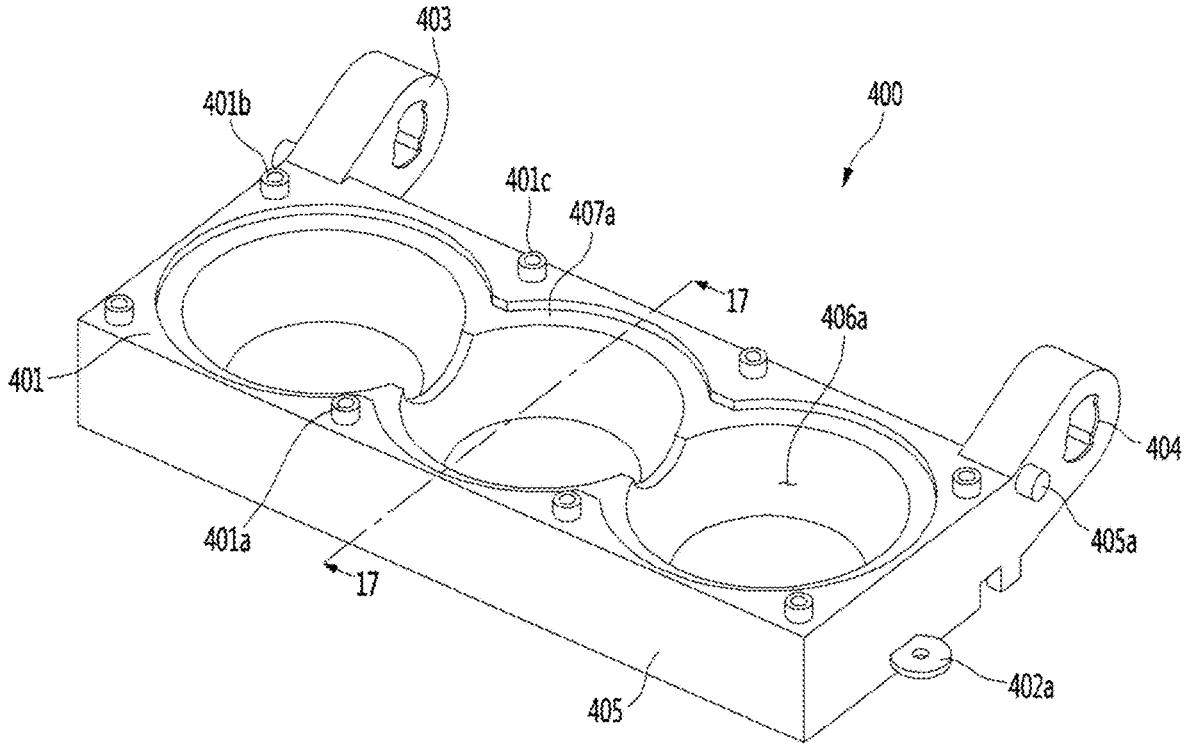
FIG. 16 is a top perspective view of a second tray supporter.
Figure 17:
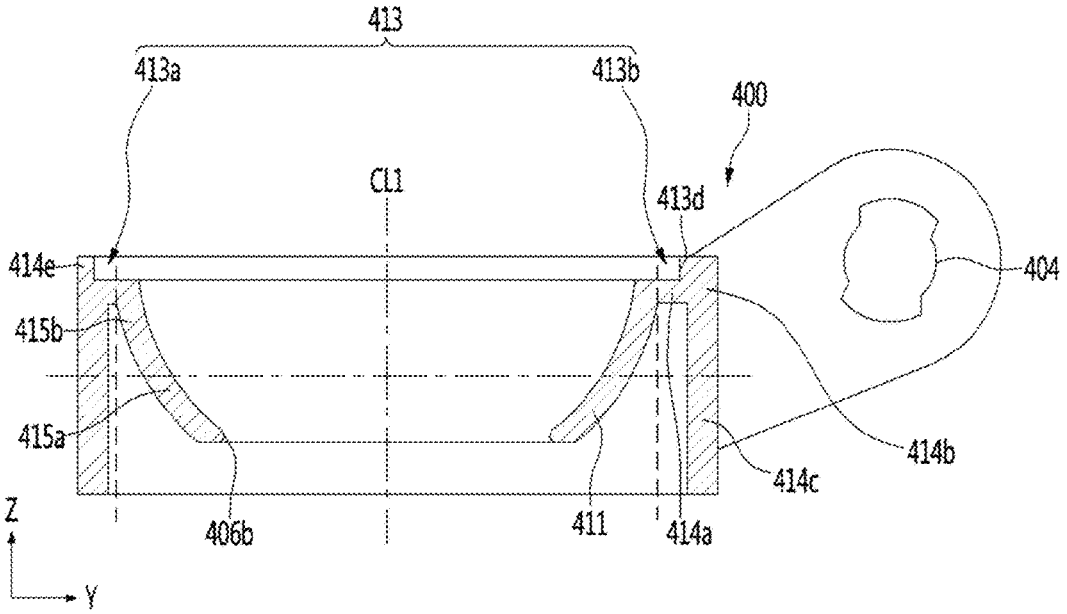
FIG. 17 is a cross-sectional view taken along line 17-17 of FIG. 16.

FIG. 16 is a top perspective view of the second tray supporter, and FIG. 17 is a cross-sectional view taken along line 17-17 of FIG. 16.

Referring to FIGS. 16 and 17, the second tray supporter 400 may include a support body 407 on which a lower portion of the second tray 380 is seated. The support body 407 may include an accommodation space 406*a* in which a portion of the second tray 380 is accommodated. The accommodation space 406*a* may be defined corresponding to the first portion 382 of the second tray 380, and a plurality of accommodation spaces 406*a* may be provided.

The support body 407 may include a lower opening 406*b* (or a through-hole) through which a portion of the second pusher 540 passes. For example, three lower openings 406*b* may be provided in the support body 407 to correspond to the three accommodation spaces 406*a*. A portion of the lower portion of the second tray 380 may be exposed by the lower opening 406*b*. At least a portion of the second tray 380 may be disposed in the lower opening 406*b*. Atop surface 407*a* of the support body 407 may extend in the horizontal direction.

The second tray supporter 400 may include a lower plate 401 that is stepped with a top surface 407*a* of the support body 407. The lower plate 401 may be disposed at a position higher than that of the top surface 407*a* of the support body 407. The lower plate 401 may include a plurality of coupling parts 401*a*, 401*b*, and 401*c* to be coupled to the second tray cover 360. The second tray 380 may be inserted and coupled between the second tray cover 360 and the second tray supporter 400.

For example, the second tray 380 may be disposed below the second tray cover 360, and the second tray 380 may be accommodated above the second tray supporter 400.

The first extension wall 387*b* of the second tray 380 may be coupled to the coupling parts 361*a*, 361*b*, and 361*c* of the second tray cover 360 and the coupling parts 401*a*, 401*b*, and 401*c* of the second tray supporter 400.

The second tray supporter 400 may further include a vertical extension wall 405 extending vertically downward from an edge of the lower plate 401. One surface of the vertical extension wall 405 may be provided with a pair of extension parts 403 coupled to the shaft 440 to allow the second tray 380 to rotate. The pair of extension parts 403 may be spaced apart from each other in the X-axis direction. Also, each of the extension parts 403 may further include a through-hole 404. The shaft 440 may pass through the through-hole 404, and the extension part 281 of the first tray cover 300 may be disposed inside the pair of extension parts 403.

The second tray supporter 400 may further include a spring coupling part 402*a* to which a spring 402 is coupled. The spring coupling part 402*a* may provide a ring to be hooked with a lower end of the spring 402.

The second tray supporter 400 may further include a link connection part 405*a* to which the pusher link 500 is coupled. For example, the link connection part 405*a* may protrude from the vertical extension wall 405.

Referring to FIG. 17, the second tray supporter 400 may include a first portion 411 supporting the second tray 380 defining at least a portion of the ice making cell 320*a*. In FIG. 17, the first portion 411 may be an area between two dotted lines. For example, the support body 407 may define the first portion 411.

The second tray supporter 400 may further include a second portion 413 extending from a predetermined point of the first portion 411. The second portion 413 may reduce transfer of heat, which is transfer from the second heater 430 to the second tray supporter 400, to the ice making cell 320*a* defined by the first tray 320. At least a portion of the second portion 413 may extend in a direction away from the first cell 321*a* defined by the first tray 320. The direction away from the first cell 321 may be a horizontal direction passing through the center of the ice making cell 320*a*. The direction away from the first cell 321 may be a downward direction with respect to a horizontal line passing through the center of the ice making cell 320*a*.

The second portion 413 may include a first part 414*a* extending in the horizontal direction from the predetermined point and a second part 414*b* extending in the same direction as the first part 414*a*.

The second portion 413 may include a first part 414*a* extending in the horizontal direction from the predetermined point, and a third part 414*c* extending in a direction different from that of the first part 414*a*.

The second portion 413 may include a first part 414*a* extending in the horizontal direction from the predetermined point, and a second part 414*b* and a third part 414*c*, which are branched from the first part 414*a*.

Atop surface 407*a* of the support body 407 may provide, for example, the first part 414*a*. The first part 414*a* may further include a fourth part 414*d* extending in the vertical line direction. The lower plate 401 may provide, for example, the fourth part 414*d*. The vertical extension wall 405 may provide, for example, the third part 414*c*.

A length of the third part 414*c* may be greater than that of the second part 414*b*. The second part 414*b* may extend in the same direction as the first part 414*a*. The third part 414*c* may extend in a direction different from that of the first part 414*a*. The second portion 413 may be disposed at the same height as the lowermost end of the first cell 321*a* or extend up to a lower point. The second portion 413 may include a first extension part 413*a* and a second extension part 413*b* which are disposed opposite to each other with respect to the center line CL1 corresponding to the center line C1 of the ice making cell 320*a*.

Referring to FIG. 17, the first extension part 413*a* may be disposed at a left side with respect to the center line CL1, and the second extension part 413*b* may be disposed at a right side with respect to the center line CL1.

The first extension part 413*a* and the second extension part 413*b* may have different shapes with respect to the center line CL1. The first extension part 413*a* and the second extension part 413*b* may have shapes that are asymmetrical to each other with respect to the center line CL1.

A length of the second extension part 413*b* may be greater than that of the first extension part 413*a* in the horizontal direction. That is, a length of the thermal conductivity of the second extension part 413*b* is greater than that of the first extension part 413*a*. The second extension part 413*b* may be disposed closer to the shaft 440 that provides a center of rotation of the second tray assembly than the first extension part 413*a*.

In this embodiment, since the length of the second extension part 413*b* in the Y-axis direction is greater than that of the first extension part 413*a*, the second tray assembly including the second tray 380 contacting the first tray 320 may increase in radius of rotation.

A center of curvature of at least a portion of the second extension part 413*a* may coincide with a center of rotation of the shaft 440 which is connected to the driver 480 to rotate.

The first extension part 413*a* may include a portion 414*e* extending upwardly with respect to the horizontal line. The portion 414*e* may surround, for example, a portion of the second tray 380.

In another aspect, the second tray supporter 400 may include a first region 415*a* including the lower opening 406*b* and a second region 415*b* having a shape corresponding to the ice making cell 320*a* to support the second tray 380. For example, the first region 415*a* and the second region 415*b* may be divided vertically. In FIG. 11, for example, the first region 415*a* and the second region 415*b* are divided by a dashed-dotted line that is extended in a horizontal direction. The first region 415*a* may support the second tray 380. The controller controls the ice maker to allow the second pusher 540 to move from a first point outside the ice making cell 320*a* to a second point inside the second tray supporter 400 via the lower opening 406*b*. A degree of deformation resistance of the second tray supporter 400 may be greater than that of the second tray 380. A degree of restoration of the second tray supporter 400 may be less than that of the second tray 380.

In another aspect, the second tray supporter 400 includes a first region 415*a* including a lower opening 406*b* and a second region 415*b* disposed farther from the second heater 430 than the first region 415*a*.

Figure 19:
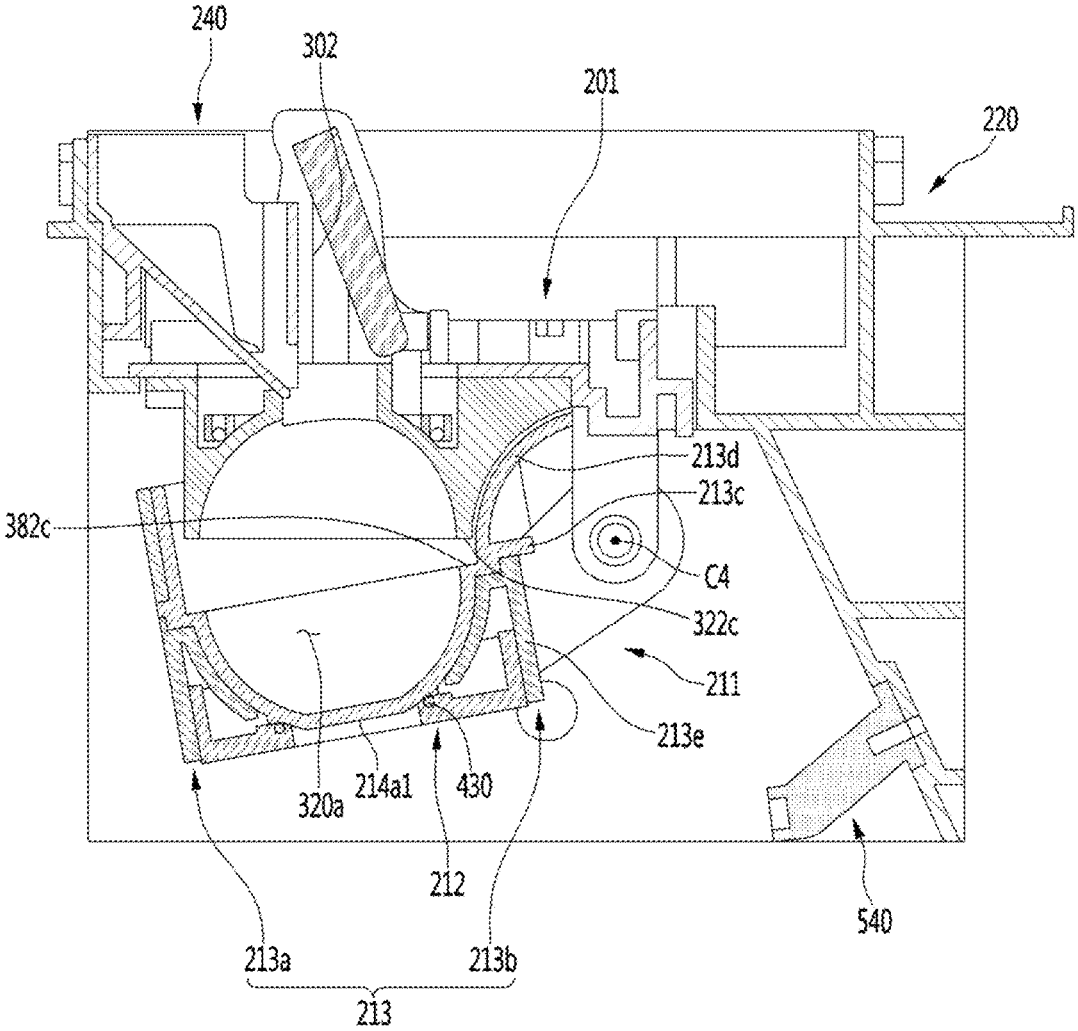
FIG. 19 is a view illustrating a state in which a second tray moves to a water supply position in FIG. 18.

FIG. 18 is a cross-sectional view taken along line 18-18 of (a) of FIG. 4, and FIG. 19 is a view illustrating a state in which the second tray moves to a water supply position in FIG. 18.

Referring to FIGS. 18 and 19, the ice maker 200 may include a first tray assembly 201 and a second tray assembly 211, which are connected to each other.

The first tray assembly 201 may include a first portion forming at least a portion of the ice making cell 320*a* and a second portion connected from the first portion to a predetermined point.

The first portion of the first tray assembly 201 may include a first portion 322 of the first tray 320, and the second portion of the first tray assembly 201 may include a second portion 323 of the first tray 320. Thus, the first tray assembly 201 includes deformation resistance reinforcement parts of the first tray 320.

The first tray assembly 201 may include a first region and a second region disposed to be farther from the second heater 430 than the first region. The first region of the first tray assembly 201 may include a first region of the first tray 320, and the second region of the first tray assembly 201 may include a second region of the first tray 320.

The second tray assembly 211 may include a first portion 212 defining at least a portion of the ice making cell 320*a* and a second portion 213 extending from a predetermined point of the first portion 212. The second portion 213 may reduce transfer of heat from the second heater 430 to the ice making cell 320*a* defined by the first tray assembly 201. The first portion 212 may be an area disposed between two dotted lines in FIG. 18.

The predetermined point of the first portion 212 may be an end of the first portion 212 or a point at which the first tray assembly 201 and the second tray assembly 211 meet each other. At least a portion of the first portion 212 may extend in a direction away from the ice making cell 320*a* defined by the first tray assembly 201. At least two portions of the second portion 213 may be branched to reduce heat transfer in the direction extending to the second portion 213. A portion of the second portion 213 may extend in the horizontal direction passing through the center of the ice making cell 320*a*. A portion of the second portion 213 may extend in an upward direction with respect to a horizontal line passing through the center of the ice making chamber 320*a*.

The second portion 213 includes a first part 213*c* extending in the horizontal direction passing through the center of the ice making cell 320*a*, a second part 213*d* extending upward with respect to the horizontal line passing through the center of the ice making cell 320*a*, a third part 213*e* extending downward.

The first portion 212 may have different degree of heat transfer in a direction along the outer circumferential surface of the ice making cell 320*a* to reduce transfer of heat, which is transferred from the second heater 430 to the second tray assembly 211, to the ice making cell 320*a* defined by the first tray assembly 201. The second heater 430 may be disposed to heat both sides with respect to the lowermost end of the first portion 212.

The first portion 212 may include a first region 214*a* and a second region 214*b*. In FIG. 18, the first region 214*a* and the second region 214*b* are divided by a dashed-dotted line that is extended in a horizontal direction. The second region 214*b* may be a region defined above the first region 214*a*. The degree of heat transfer of the second region 214*b* may be greater than that of the first region 214*a*.

The first region 214*a* may include a portion at which the second heater 430 is disposed. That is, the first region 214*a* may include the second heater 430.

The lowermost end 214*a*1 of the ice making cell 320*a* in the first region 214*a* may have a heat transfer rate less than that of the other portion of the first region 214*a*. A distance from the center of the ice making cell 320*a* to the outer circumferential surface is greater in the second region 214*b* than in the first region 214*a*.

The second region 214*b* may include a portion in which the first tray assembly 201 and the second tray assembly 211 contact each other. The first region 214*a* may provide a portion of the ice making cell 320*a*. The second region 214*b* may provide the other portion of the ice making cell 320*a*. The second region 214*b* may be disposed farther from the second heater 430 than the first region 214*a*.

Part of the first region 214*a* may have the degree of heat transfer degree less than that of the other part of the first region 214*a* to reduce transfer of heat, which is transferred from the second heater 430 to the first region 214*a*, to the ice making cell 320*a* defined by the second region 214*b*.

To make ice in the direction from the ice making cell 320*a* defined by the first region 214*a* to the ice making cell 320*a* defined by the second region 214*b*, a portion of the first region 214*a* may have a degree of deformation resistance less than that of the other portion of the first region 214*a* and a degree of restoration greater than that of the other portion of the first region 214*a*.

A portion of the first region 214*a* may be thinner than the other portion of the first region 214*a* in the thickness direction from the center of the ice making cell 320*a* to the outer circumferential surface direction of the ice making cell 320*a*.

For example, the first region 214*a* may include a second tray case surrounding at least a portion of the second tray 380 and at least a portion of the second tray 380. For example, the first region 214*a* may include the pressing part 382*f* of the second tray 380. The rotation center C4 of the shaft 440 may be disposed closer to the second pusher 540 than to the ice making cell 320*a*. The second portion 213 may include a first extension part 213*a* and a second extension part 213*b*, which are disposed at sides opposite to each other with respect to the central line C1.

The first extension part 213*a* may be disposed at a left side of the center line C1 in FIG. 18, and the second extension part 213*b* may be disposed at a right side of the center line C1. The water supply part 240 may be disposed close to the first extension part 213*a*. The first tray assembly 201 may include a pair of guide slots 302, and the water supply part 240 may be disposed in a region between the pair of guide slots 302.

The ice maker 200 according to this embodiment may be designed so that a position of the second tray 380 is different from the water supply position and the ice making position. In FIG. 19, as an example, a water supply position of the second tray 380 is illustrated. For example, in the water supply position as illustrated in FIG. 19, at least a portion of a first contact surface 322*c* of the first tray 320 and a second contact surface 382*c* of the second tray 380 may be spaced apart from each other. In FIG. 19, for example, a shape in which the entire first contact surface 322*c* is spaced apart from the entire second contact surface 382*c*. Thus, at the water supply position, the first contact surface 322*c* may be inclined at a predetermined angle with respect to the second contact surface 382*c*.

Although not limited thereto, at the water supply position, the first contact surface 322*c* may be substantially maintained horizontally, and the second contact surface 382*c* may be disposed to be inclined with respect to the first contact surface 322*c* under the first tray 320.

At the ice making position (see FIG. 18), the second contact surface 382*c* may be in contact with at least a portion of the first contact surface 322*c*. The angle defined by the second contact surface 382*c* of the second tray 380 and the first contact surface 322*c* of the first tray 320 at the ice making position is less than that defined by the second contact surface of the second tray 380 and the first contact surface 322*c* of the first tray 320 at the water supply position.

At the ice making position, the entire first contact surface 322*c* may be in contact with the second contact surface 382*c*. At the ice making position, the second contact surface 382*c* and the first contact surface 322*c* may be disposed to be substantially horizontal.

In this embodiment, the water supply position of the second tray 380 and the ice making position are different from each other. This is done for uniformly distributing the water to the plurality of ice making cells 320*a* without providing a water passage for the first tray 320 and/or the second tray 380 when the ice maker 200 includes the plurality of ice making cells 320*a*.

If the ice maker 200 includes the plurality of ice making cells 320*a*, when the water passage is provided in the first tray 320 and/or the second tray 380, the water supplied into the ice maker 200 may be distributed to the plurality of ice making cells 320*a* along the water passage. However, when the water is distributed to the plurality of ice making cells 320*a*, the water also exists in the water passage, and when ice is made in this state, the ice made in the ice making cells 320*a* may be connected by the ice made in the water passage portion. In this case, there is a possibility that the ice sticks to each other even after the completion of the ice, and even if the ice is separated from each other, some of the plurality of ice includes ice made in a portion of the water passage. Thus, the ice may have a shape different from that of the ice making cell.

However, like this embodiment, when the second tray 380 is spaced apart from the first tray 320 at the water supply position, water dropping to the second tray 380 may be uniformly distributed to the plurality of second cells 381*a* the second tray 380.

The water supply part 240 may supply water to one opening of the plurality of openings 324. In this case, the water supplied through the one opening 324 falls to the second tray 380 after passing through the first tray 320. In the water supply process, water may fall into any one second cell 381*a* of the plurality of second cells 381*a* of the second tray 380. The water supplied to any one second cell 361*a* may overflow from any one second cell 381*a*.

In this embodiment, since the second contact surface 382*c* of the second tray 380 is spaced apart from the first contact surface 322*c* of the first tray 320, the water overflowed from any one second cells 381*a* may move to the other adjacent second cell 381*c* along the second contact surface 382*c* of the second tray 380. Therefore, the plurality of second cells 381*a* the second tray 380 may be filled with water.

Also, in the state in which water supply is completed, a portion of the water supplied may be filled in the second cell 381*a*, and the other portion of the water supplied may be filled in the space between the first tray 320 and the second tray 380. When the second tray 380 move from the water supply position to the ice making position, the water in the space between the first tray 320 and the second tray 380 may be uniformly distributed to the plurality of first cells 321*a*.

When water passages are provided in the first tray 320 and/or the second tray 380, ice made in the ice making cell 320*a* may also be made in a portion of the water passage.

In this case, when the controller of the refrigerator controls one or more of the cooling power of the cooler and the heating amount of the second heater 430 to vary according to the mass per unit height of the water in the ice making cell 320*a*, one or more of the cooling power of the cooler and the heating amount of the second heater 430 may be abruptly changed several times or more in the portion at which the water passage is provided.

This is because the mass per unit height of the water increases more than several times in the portion at which the water passage is provided. In this case, reliability problems of components may occur, and expensive components having large maximum output and minimum output ranges may be used, which may be disadvantageous in terms of power consumption and component costs. As a result, the present invention may require the technique related to the aforementioned ice making position to make the transparent ice.

Figure 20:
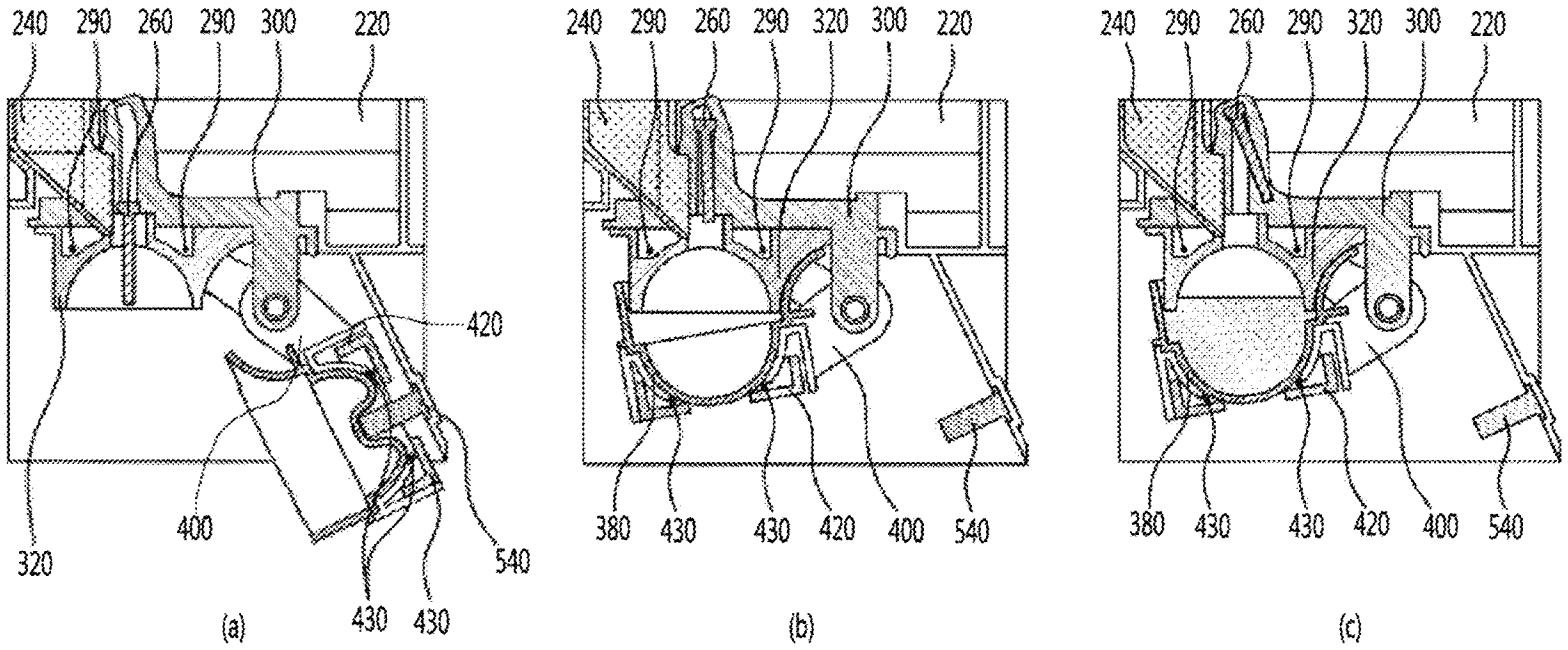
FIGS. 20(*a*) to (*c*) and 21(*a*) and (*b*) are views illustrating a process of supplying water to the ice maker.
Figure 21:
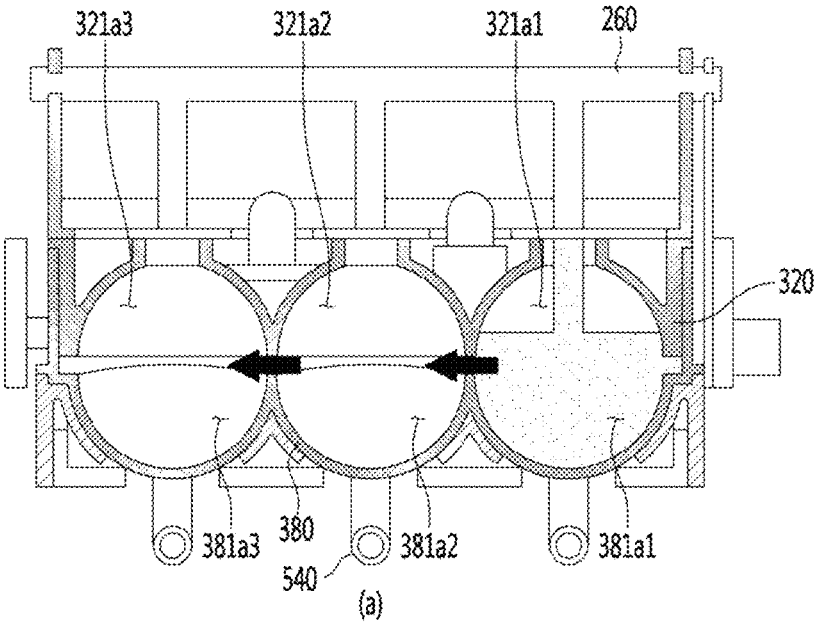
Figure 21:
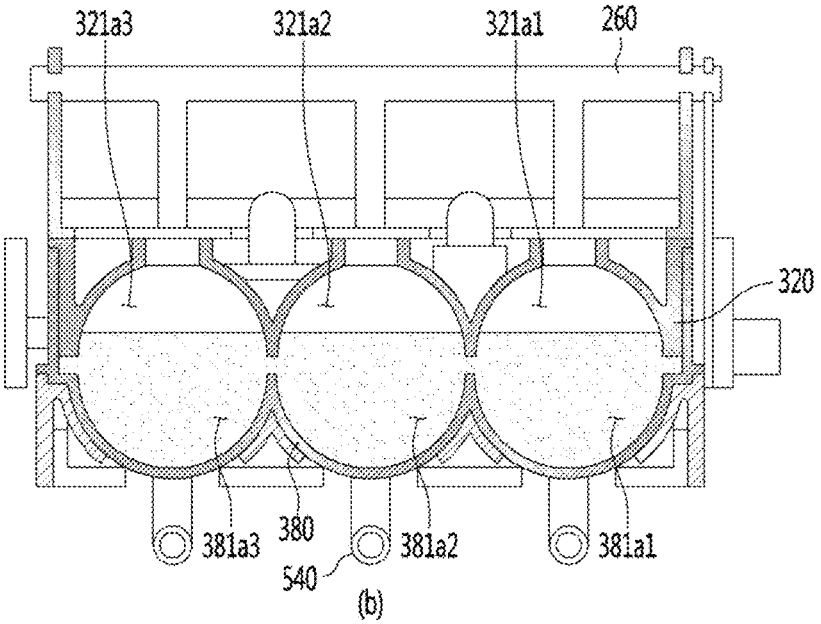

FIGS. 20 and 21 are views illustrating a process of supplying water to the ice maker.

FIG. 20 is a view illustrating a process of supplying water when the ice maker is viewed from the side, and FIG. 21 is a view illustrating a process of supplying water when the ice maker is viewed from the front.

As illustrated in (a) of FIG. 20, the first tray 320 and the second tray 380 are disposed in a state of being spaced apart from each other, and then, as illustrated in (b) of FIG. 20, the second tray 380 rotates in a reverse direction toward the tray 320. Here, although the first tray 320 and the second tray 380 partially overlap each other, the first tray 320 and the second tray 380 are completely engaged so as not to form an inner space having a spherical shape.

As illustrated in (c) of FIG. 20, water is supplied into the tray through the water supply part 240. Since the first tray 320 and the second tray 380 are not completely engaged with each other, a portion of the water overflows out of the first tray 320. However, since the second tray 380 includes a circumferential wall surrounding the upper side of the first tray 320 so as to be spaced apart from each other, the water does not overflow from the second tray 380.

FIG. 21 is a view specifically explaining (c) of FIG. 20. Here, the state is changed in order of (a) FIG. 21 and (b) of FIG. 21.

As illustrated in (c) of FIG. 20, when the water is supplied to the first tray 320 and the second tray 380 through the water supply part 240, the water supply part 240 is disposed to be biased toward one side of the tray.

That is, the first tray 320 is provided with a plurality of cells 321*a*1, 321*a*2, 321*a*3 for generating a plurality of independent ices. The second tray 380 is also provided with a plurality of cells 381*a*1, 381*a*2, 381*a*3 for generating a plurality of independent ices. As the cell disposed in the first tray 320 and the cell disposed in the second tray 380 are combined with each other to generate one spherical ice.

In FIG. 21, the first tray 320 and the second tray 380 are not in completely contact with each other as illustrated in (c) of 20, but front sides of the first tray 320 and the second tray 380 are separated from each other so that the water filled in each cell moves between the cells.

As illustrated in (a) of FIG. 21, when water is supplied to the upper side of the cells 321*a*1 and 381*a*1 disposed at one side, the water moves into the cells 321*a*1 and 381*a*1. Here, when water overflows from the cell 381*a*1 disposed at a lower side, the water may move to the adjacent cells 321*a*2 and 381*a*2. Since the plurality of cells are not completely isolated from each other, when a level of water in the cell increases above a certain level, the water may move to the surrounding cells and be fully filled into each cell.

When predetermined water is supplied from a water supply valve disposed in a water supply pipe provided outside the ice maker 200, a flow path may be closed so that water is no longer supplied to the ice maker 200.

Figure 22:
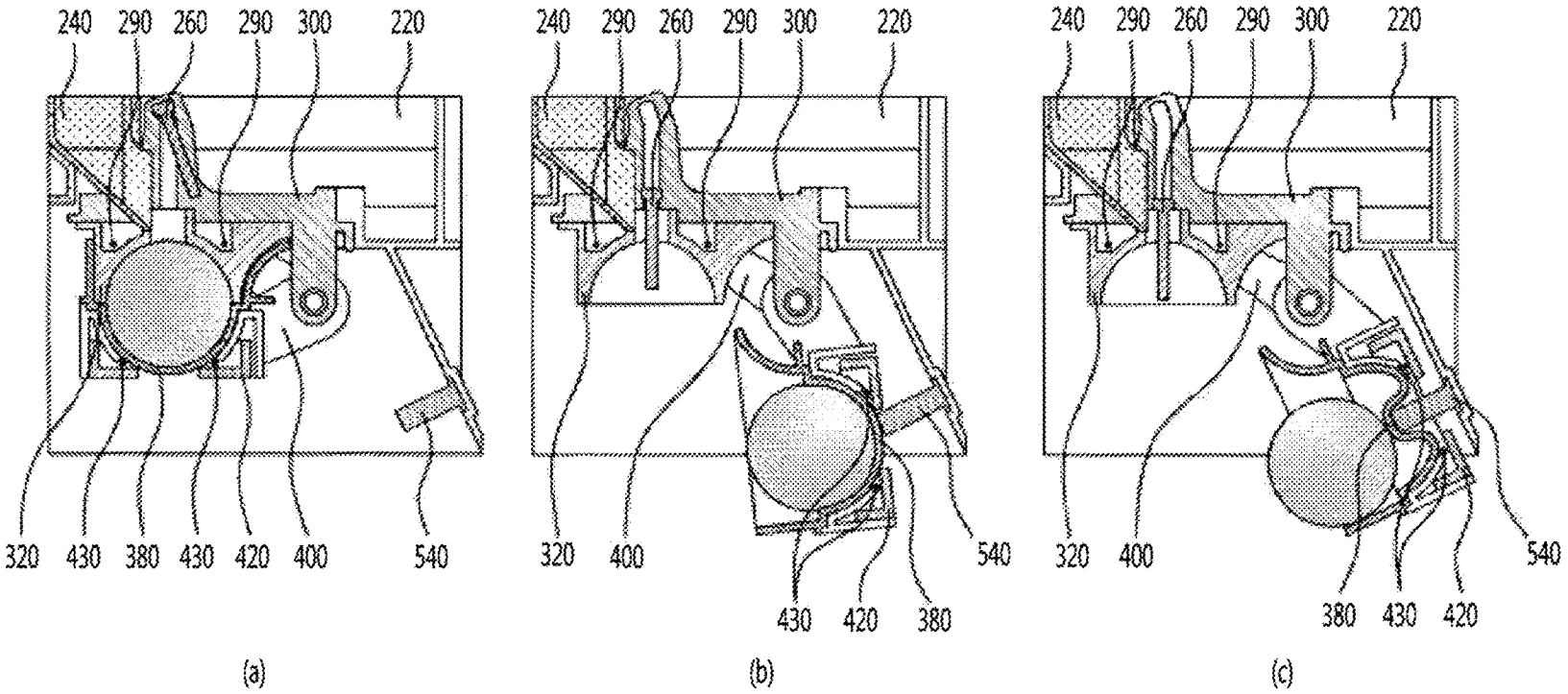
FIG. 22(*a*) to (*c*) are views illustrating a process of separating ice from the ice maker.

FIG. 22 is a view illustrating a process of separating ice from the ice maker.

Referring to FIG. 22, when the second tray 380 further rotates in the reverse direction in (c) of FIG. 20, as illustrated in (a) FIG. 21, the first tray 320 and the second tray 380 may be disposed to form the cell having a spherical shape. The second tray 380 and the first tray 320 are completely coupled to each other so that water is separately filled in each cell.

When cold air is supplied for a predetermined time in the state of (a) of FIG. 22, ice is generated in the ice making cell of the tray. While the water is changed into ice by cold air, the first tray 320 and the second tray 380 are engaged with each other so that the water does not move, as illustrated in (a) of FIG. 22.

When ice is generated in the ice making cell of the tray, as illustrated in (b) of FIG. 22, while the first tray 320 is stopped, the second tray 380 rotates in the forward direction.

Here, since ice has its own weight, the ice may fall from the first tray 320. Since the first pusher 260 presses the ice while descending, it is possible to prevent ice from adhering to the first tray 320.

Since the second tray 380 supports a lower portion of the ice, even if the second tray 380 moves in the forward direction, the state in which the ice is mounted on the second tray 380 is maintained. As illustrated in (b) of FIG. 22, even when the second tray 380 rotates at an angle exceeding a vertical angle, there may be a case in which ice adheres to the second tray 380.

Therefore, in this embodiment, the second pusher 540 deforms the pressing part of the second tray 380, and as the second tray 380 is deformed, the adhesion between the ice and the second tray 380 is weakened, and thus, ice may fall from the second tray 380.

Thereafter, although not shown in FIG. 22, the ice may fall into the ice bin 600.

Figure 23:
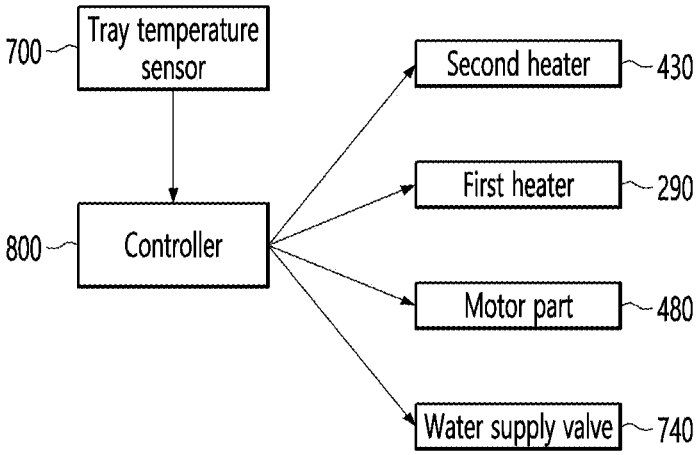
FIG. 23 is a control block diagram according to an embodiment.

FIG. 23 is a control block diagram according to an embodiment.

Referring to FIG. 23, in an embodiment of the present invention, a tray temperature sensor 700 measuring a temperature of the first tray 320 or the second tray 380 is provided.

The temperature measured by the tray temperature sensor 700 is transmitted to a controller 800.

The controller 800 may control the driving part 480 so that the motor rotates in the driving part 480.

The controller 800 may control the water supply valve 740 that opens and closes the flow path of water supplied to the ice maker 200 so that the water is supplied to the ice maker 200, or the supply of the water to the ice maker 200 is stopped.

When the driving part 480 operates, the second tray 380 or the full ice detection lever 520 may rotate.

A second heater 430 may be installed in the second heater case 420. The second heater 430 may supply heat to the second tray 380. Since the second heater 430 is disposed under the second tray 380, the second heater 430 may be referred to as a lower heater.

A first heater 290 may be provided in the first heater case 280. The first heater 290 may supply heat to the first tray 320. Since the first heater 290 is disposed above the second heater 430, the second heater 290 may be referred to as an upper heater.

Power may be supplied to the first heater 290 and the second heater 430 according to a command of the controller 800 to generate heat.

Figure 24:
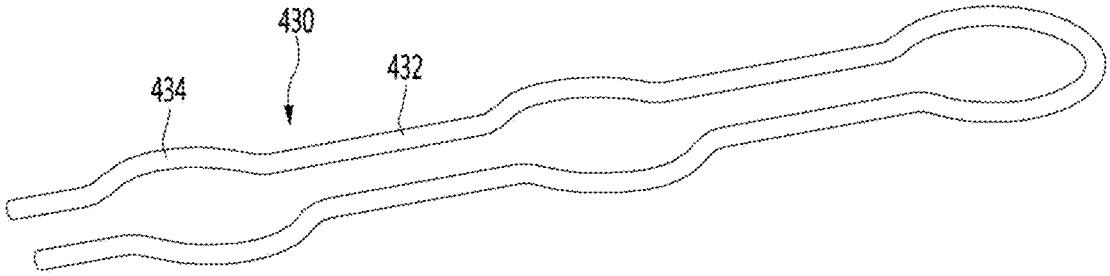
FIG. 24 is a view illustrating an example of a heater applied to an embodiment.

FIG. 24 is a view illustrating an example of the heater applied to an embodiment.

The second heater 430 illustrated in FIG. 24 is installed in the second heater case 420. The second heater 430 may be installed on a top surface of the second heater case 420. The second heater 430 may be exposed above the second heater case 420.

Of course, the second heater 430 may be installed to be embedded in the second heater case 420.

The second heater 430 may include a straight portion 432 and a curved portion 434. Both the straight portion 432 and the curved portion 434 are provided as elements capable of generating heat. When current flows through the straight portion 432 and the curved portion 434, heat may be entirely generated by resistance.

The straight portion 432 means a portion extending in a linear direction. The curved portion 434 may have a trajectory of a generally semicircular arc in a shape that is spread outward and then pursed inward. The second heater 430 may be formed in the form of a single line. Here, the second heater 430 may have a shape in which the straight portion 432 and the curved portion 434 are alternately arranged to be symmetrical to each other.

In the second heater 430, the curved portion 434 may be disposed at a position at which each cell of the second tray 380 is disposed. Since the cell has a hemispherical shape, and the planar cross-section is circular, the two curved portions 434 facing each other are disposed to form a portion of a circular arc.

The second heater 430 may have an approximately circular cross-section.

In FIG. 24, only the second heater 430 has been described, but the above descriptions are equally applied to the first heater 290. That is, the first heater 290 may also be provided with a curved portion and a straight portion, which are alternately disposed, like the second heater 430. However, unlike the second heater 430, the first heater 290 is installed in the first heater case 280 and is disposed above the tray.

Figure 25:
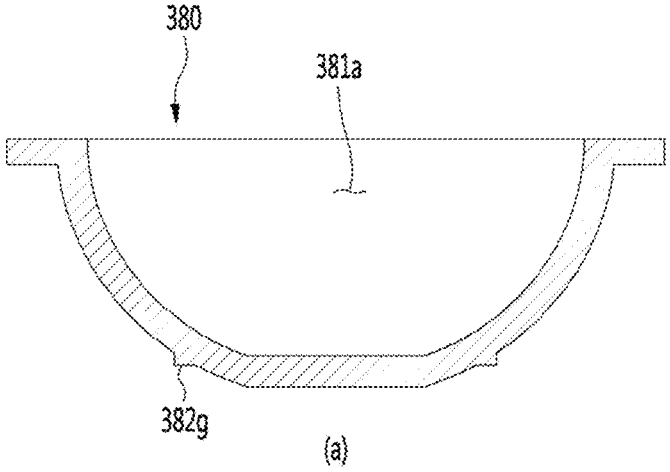
FIGS. 25(*a*) and (*b*) are views of a second tray.
Figure 25:
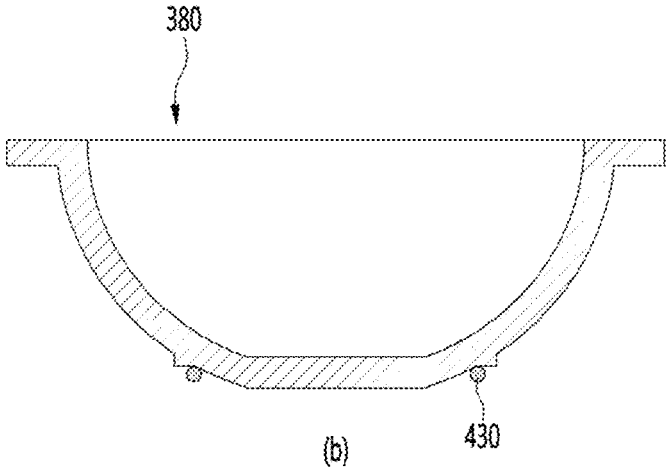

FIG. 25 is a schematic view illustrating a state in which the second heater is in contact with the second tray.

FIG. 25 illustrates a cross-section of one cell of the plurality of cells 381*a* of the second tray 380. The cells of the second tray 380 may have a substantially hemispherical shape, and thus, when water is filled in the cell and changed into ice, the hemispherical shape may be maintained by the second tray 380. The upper hemispherical shape is implemented by the first tray 320.

A heater contact part 382*g* is provided on an outer surface of each cell of the second tray 380. The heater contact part 382*g* may form a surface that is in contact with the second heater 430, as illustrated in (b) of FIG. 25.

The heater contact part 382*g* may have a flat surface, and thus, the second heater 430 may be in stable contact with the heater contact part 382*g*. Also, since the second heater 430 includes a curved portion having an approximately circular shape, the heater contact part 382*g* may be disposed to partially overlap each other by the second heater 430. Thus, the second heater 430 may compress the heater contact part 382*g*. Since it is installed in the compressed manner, the second tray 380 may be maintained in contact with the second heater 430 even if a tolerance occurs during assembly and mass production.

Figure 26:
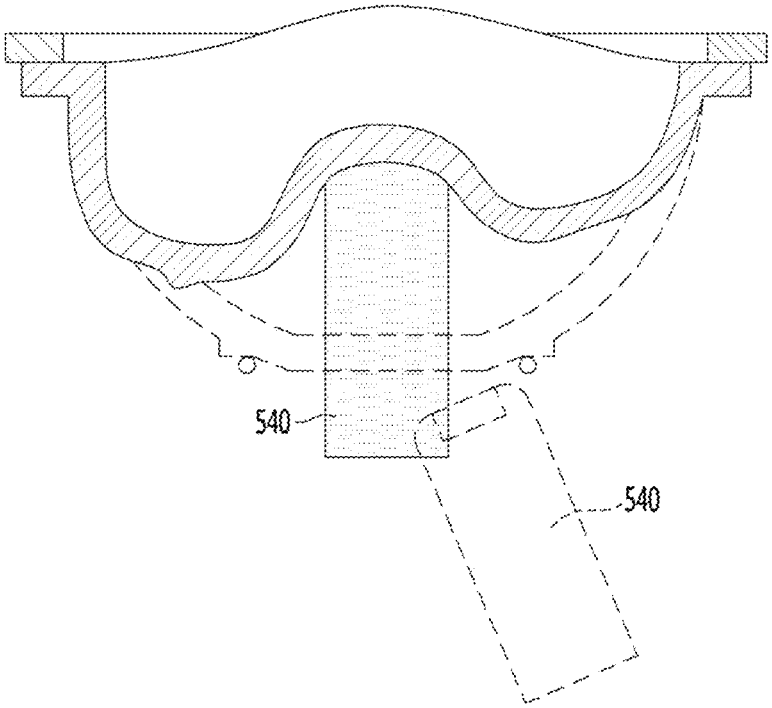
FIG. 26 is a view illustrating an operation of the second tray and the heater.

FIG. 26 is a view illustrating operations of the second tray and the heater.

Referring to FIG. 26, a portion expressed by a dotted line represents a state before the second pusher 540 presses the second tray 380, and a portion expressed by a solid line represents a state in which the second pusher 540 presses the second tray 380.

Since the second heater 430 is in contact with the second tray 380, but is not fixed so as to be attached, the second heater 430 may be disposed at the same position regardless of the state in which the second pusher 540 presses or does not press the second tray 380.

The second heater 430 is fixed to the second heater case 420, and in FIG. 26, the second heater case 420 is omitted for convenience of description.

The second tray 380 may be made of a silicon material. When external force is applied, the second tray 380 may be deformed around a portion to which the force is applied. Therefore, when ice is frozen in the cell of the second tray 380, if the second pusher 540 deforms the second tray 380, the ice may be separated from the second tray 380.

Specifically, the second heater 430 is compressed to the second tray 380 to maintain a state in contact with the second tray 380. Then, in order to separate the ice frozen in the second tray 380 from the second tray 380, the second pusher 540 may press the second tray 380. As the second tray 380 is deformed, the second heater 430 is separated from the second tray 380 without contacting. This is because the second heater 430 is not integrally attached to the second tray 380. Therefore, when compared to the method in which the second heater 430 is attached to the second tray 380, even if the second tray 380 is deformed to separate ice from the second tray 420, the second heater 430 may be prevented from being damaged, such as disconnection thereof.

This embodiment may be applied equally to a tray capable of generating spherical ice, as well as an ice maker generating square-shaped ice. That is, in addition to the form in which the upper side and the second tray are provided together in the ice maker, it is possible to apply the same concept to the ice maker provided with only the second tray. In this embodiment, when the heater applies heat to the tray, that is, when ice is generated, the heater and the tray are in contact with each other. On the other hand, when ice is separated from the tray, that is, when ice is separated, the heater and the tray may be separated from each other to prevent the heater from being damaged even if the shape of the tray is deformed.

In this embodiment a brief description will be given of a process in which ice is finally made after water is supplied to the ice maker, and ice is made.

As illustrated in (b) of FIG. 20, the second tray 380 is disposed so as not to be horizontal but inclined at a predetermined angle. Here, the second tray 380 may rotate about an angle of about 6 degrees with respect to the horizontal plane so as to be maintained in the inclined state.

As illustrated in (c) of FIG. 20, since the second tray 380 is inclined when water is supplied to the tray, water supplied to one cell may be spread to other cells.

When ice making is in progress after the water supply is completed, the second tray 380 rotate so that the second contact surface 382*c* of the second tray 380 is parallel to the horizontal plane, as illustrated in FIG. 22A. Here, the first tray 320 and the second tray 380 are completely coupled to each other, and each cell is disposed to form a spherical shape.

When ice is made, the second heater 430 may be turned on so that ice is grown from the upper portion of the ice making cell.

That is, power may be supplied to the second heater 430 so that heat is generated by the second heater 430. The second heater 430 is disposed closer to a lower end than an upper end of the ice making cell. On the other hand, at the upper side of the ice making cell, a temperature is lowered by the cold air supplied from a duct. That is, the upper side has a low temperature while the lower side has a high temperature based on the ice making cell, and thus, conditions in which ice is generated on the upper side are satisfied.

Since the upper side of the ice making cell has a low temperature, ice is getting bigger. However, bubbles contained in the water are not collected in the ice, but are gradually escaped downward so that the bubbles are not collected in the ice.

Therefore, almost no air bubbles exist in the generated ice, and transparent ice may be made. In this embodiment, the ice is grown from the upper side to the lower side. This is done because the temperature is maintained at the lower side than the upper side. Therefore, a direction of ice formation is constantly maintained to made transparent ice.

When the temperature of the tray is measured by the tray temperature sensor 700 so that the temperature falls below a certain temperature, it may be determined that ice generation is completed as illustrated in FIG. 22A. Thus, it may be determined that ice is in a state of being provided to the user, and the first heater 290 may operate.

The first heater 290 supplies heat after the ice generation is completed to create the conditions in which ice is easily separated from the tray. The first heater 290 applies heat to the first tray 320 to separate the ice from the first tray 320.

When heat is applied by the first heater 290, a portion of the first tray 320, which is in contact with ice, is heated to melt the ice so as to be changed into water, and the ice is separated from the first tray 320.

The tray temperature sensor 700 measures a temperature of the tray. When the temperature of the tray increases by a predetermined temperature, it may be determined that the portion of the ice, which is in contact with the first tray 320, has melted. In this case, when the second tray 380 rotates in the forward direction as illustrated in (b) of FIG. 22 and (c) of FIG. 22, ice is separated from the first tray 320 and the second tray 380. In this case, since ice may not be separated from the first tray 320, the first pusher 260 pushes the ice from the first tray 320. Since an opening is provided above the first tray 320, the first pusher 260 may be disposed in each cell through the opening. The upper side of the first tray 320 is exposed to external air through the respective openings, and cold air supplied through the duct may be guided to the inside of the first tray 320 through the openings. Therefore, when the water is into contact with the cold air, a temperature of the water decreases to make ice.

As the rotation angle of the second tray 380 increases, the second pusher 540 presses the second tray 380 to deform the second tray 380. The ice may be separated from the second tray 380 to drop downward and then finally stored in the ice bin.

Figure 27:
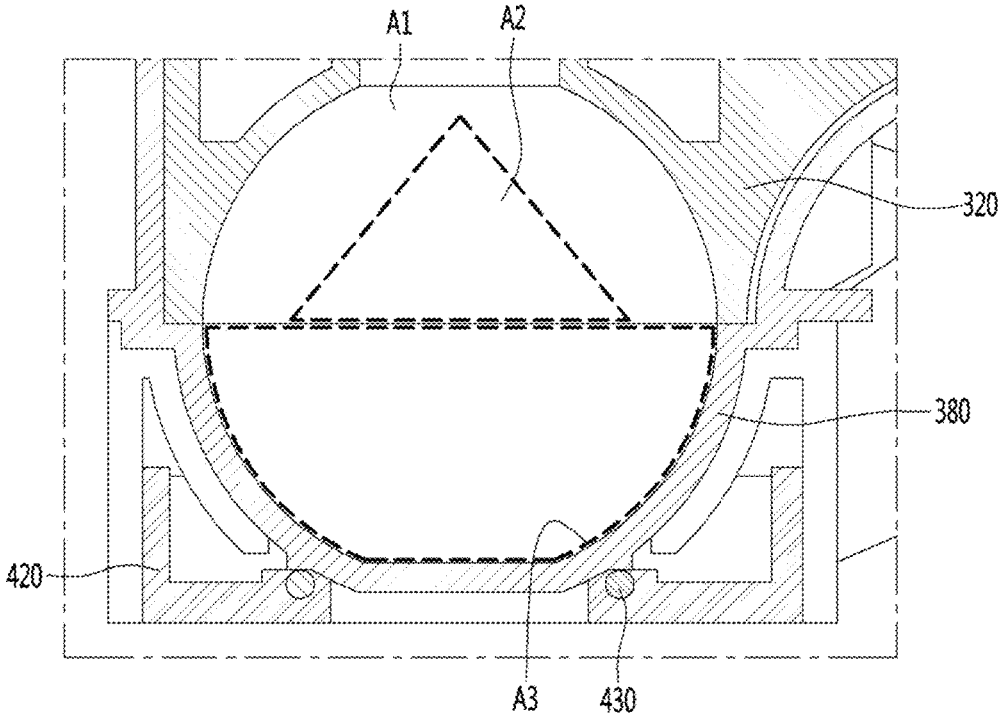
FIG. 27 is a view illustrating a process of making ice.
Figure 28:
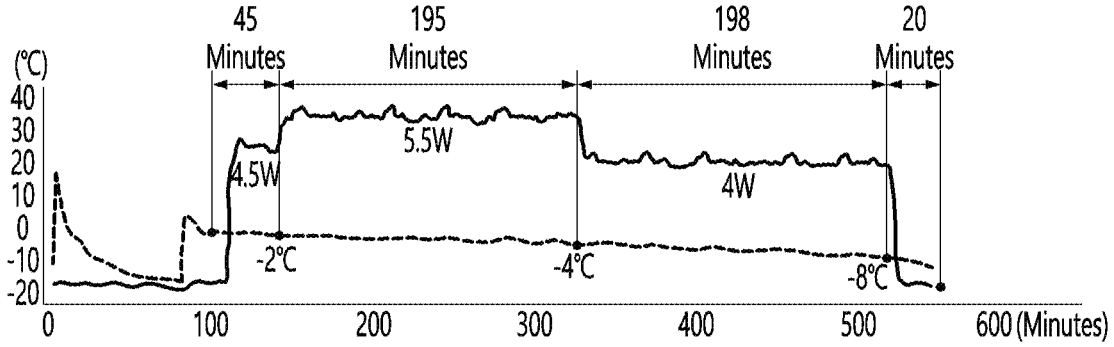
FIG. 28 is a view illustrating a temperature of the second tray and a temperature of the heater.

FIG. 27 is a view illustrating a process of making ice, and FIG. 28 is a view illustrating a temperature of the second tray and a temperature of the heater.

In order to make transparent ice, the heater may be disposed on a lower portion of the tray. If an intensity of heating of the heater is constantly maintained, ice is made at a high speed when ice is made at the initial stage of the ice making, i.e. when ice is made at the upper portion. On the other hand, ice is made at a slower speed at a lower end, resulting in relatively opaque ice at the upper portion.

Also, if an amount of heat of the heater increases to make ice having a transparent upper portion, a rate at which ice is generated at the upper portion may be slowed to generate the transparent ice. However, since a time taken to generate the lower end of the ice increases, the ice making time may increase, and an amount of ice making may be reduced.

If the amount of heat of the heater is constantly controlled while making ice, there is a difference between the rate at which ice is made at the upper and lower portions.

Therefore, in this embodiment, the transparent ice may be generated by changing the amount of heat generated by the heater.

In order to make the transparent ice, it is necessary to adjust a freezing rate from the upper portion to the lower end through the second heater 430 installed at the lower end. If ice is frozen quickly, air scratches occur to generate opaque ice. Therefore, in order to generate the transparent ice, the ice has to be slowly frozen using the heater so that air is not collected in the ice.

Since the cold air is supplied from the upper side, when the upper ice is grown, the ice is grown rapidly, and the lower ice is frozen slowly when compared to the upper ice. If the heater generates heat according to the growth rate of the upper ice, the ice making time increases because the ice is frozen too slowly when the lower ice is generated, and when the heater generates heat at a lower freezing rate, ice having an opaque upper side is generated.

Therefore, in this embodiment, in order to make transparent ice while securing the ice making rate, the heater capacity may vary in stages.

The ice generated by the ice maker according to this embodiment may be divided into three regions as a whole. As illustrated in FIG. 27, the spherical ice may be divided into a first region A1, a second region A2, and a third area A3 as a whole.

The first region A1 may mean a portion at which the transparent ice is generated even without controlling the heater. The first region is a portion at which water is in contact with the first tray 320 and also is a portion at which the spherical ice is initially generated. Since the portion that is in contact with the first tray 320, initially has a similar temperature distribution to the first tray 320, a temperature may be relatively low.

The second region A2 is not adjacent to the first tray 320, but is disposed within the cell formed in the first tray 320. Since the second region is a portion disposed close to a center of the spherical ice, it may be difficult for air to escape and thus maintain transparency. The second region is a portion surrounded by the first region and may mean a region similar to a triangular pyramid having a triangular cross-section based on the drawing.

The third region A3 is a space in which ice is generated in the cell provided in the second tray 380. Since the third region has a hemispherical shape as a whole and is a portion disposed close to the second heater 430, heat generated by the second heater 430 may be easily transferred.

In this embodiment, when ice is generated in the portion corresponding to the third area A3, an amount of heat generated by the heater is changed. Furthermore, even when ice is generated in the portion corresponding to the third area A3, an amount of heat of the second heater 430 is changed because the conditions under which ice is generated are different in the first region A1 or the second region A2. That is, a temperature of the second heater 430 may be changed to adjust a rate at which ice is frozen.

In FIG. 28, a dotted line indicates a temperature measured by the tray temperature sensor 700, and a solid line indicates a temperature of the second heater 430.

Water is supplied to the ice maker 200, and the second heater 430 is not driven for a predetermined time period. That is, since the second heater 430 does not generate heat, the tray is not heated. However, when water is supplied, since a temperature of the water is higher than a temperature of the freezing compartment in which the ice maker is disposed, the temperature of the tray measured by the tray temperature sensor 700 may temporarily increase.

When the water supply is completed, and a predetermined time elapses, the second heater 430 is driven. At this time, the second heater 430 may be driven with a first capacity for a first set time. At this time, ice may be generated in the first region A1. Here, the second heater 430 generates heat in a first temperature range. For example, the first set time may mean approximately 45 minutes, and the first capacity may mean 4.5 W.

Also, after the first set time elapses, the second heater 430 may be driven with the second capacity for a second set time. At this time, ice may be generated in the second region A2. Here, the second heater 430 generates heat in a second temperature range. For example, the second set time may mean approximately 195 minutes, and the second capacity may mean 5.5 W.

After the second set time elapses, the second heater 430 may be driven with a third capacity for a third set time. At this time, ice may be generated in the third area A3. Here, the second heater 430 generates heat in a third temperature range. For example, the third set time may mean approximately 198 minutes, and the third capacity may mean 4 W.

In this embodiment, the heater may be controlled in a manner in which the water supply starts and stands by during a certain time period after the heater is turned off, and then, when the first heating is performed to reach a predetermined time, second heating is performed, and then, the first heating reaches a next temperature, third heating is performed, and finally, the heater is turned off.

When comparing the first temperature range, the second temperature range, and the third temperature range, the second temperature range is the highest, the first temperature range is the next highest, and the third temperature range is the lowest. While ice is being generated in the first region A1, the second heater 430 is driven in the second highest temperature range.

While ice is being frozen in the first region A1, since there are many flow paths through which air contained in water is capable of being escaped, possibility of collection of air is relatively low. Thus, the transparent ice may be generated in the first region even if the second heater 430 is not driven at the highest temperature.

In the second region A2, since the flow path through which air is capable of being escaped is relatively small, and a cross-sectional area of frozen ice based on the spherical shape is large, the second heater 430 is driven at the highest temperature.

In the third area A3, ice may be generated at a position relatively close to the second heater 430, and heat generated from the second heater 430 may be easily transferred, and thus, the second heater 430 may be driven at the lowest temperature.

A time when the second heater 430 is driven with the first capacity may be shorter than a time when the second heater 430 is driven with the second capacity or the third capacity. When driven with the first capacity, since ice is generated in the first region A1, an amount of ice generated is relatively small when compared to the second region A2 or the third area A3. Thus, a driving time with the first capacity is less than with the second capacity or the third capacity, and thus, an overall ice freezing rate may be maintained constantly.

As illustrated in FIG. 28, when the temperature measured by the tray temperature sensor 700 during the ice making after the water supply is finished, it is seen that the temperature gradually decreases from about 0 degrees to about −8 degrees at a constant inclination. As the temperature of the tray decreases at a constant rate, ice generated in the tray may also be grown at a constant rate. Therefore, air contained in the water is not collected by the ice and is discharged to the outside to make the transparent ice.

It is also possible to control the heater by dividing the heater into more stages than in this embodiment.

Referring to FIG. 22, a process of separating ice from the first tray and the second tray after the spherical ice is generated will be described.

In this embodiment, heat may be supplied to the first tray 320 by using the first heater 290 installed in the first tray 320. When heat is supplied from the first heater 290 provided in the first tray 320, an outer surface of the ice made in the first tray 320 (a surface that is in contact with the first tray 320) is heated to be changed into water.

The ice may be separated from the first tray 320. Of course, the first pusher 260 may allow ice to be separated from the first tray 320, thereby improving reliability of ice separation.

Also, ice may be pressed at a lower side by the second pusher 540 so as to be separated from the second tray 380.

In order to separate the ice after the ice is completely made, the first heater 290 disposed above the first tray 320 is first driven in the state of (a) of FIG. 22. The temperature of the first tray 320 may increase by supplying heat from the first heater 290. The first heater 290 is driven until the tray temperature measured by the tray temperature sensor 700 increases, or a predetermined time elapses.

While the first heater 290 is driven, the first tray 320 and the second tray 380 do not move, and ice is maintained in a state of being engaged with the first tray 320 and the second tray 380. That is, while ice is filled in the ice making cell formed in the first tray 320 and the second tray 380, the first heater 290 is driven to heat the ice that is attached to the first tray 320 and the first tray 320.

After driving the first heater 290, when a certain time elapses, or a certain temperature is reached, it is determined that a surface of the ice that is in contact with the first tray 320 is melted, and thus, the second tray 380 rotates at a set angle.

At this time, it is preferable that the rotation angle is approximately 10 degrees to 45 degrees, at which the second tray 380 is disposed in the middle of the state that is not as illustrated in (b) of FIG. 22, but (a) of FIG. 22 (a state in which the second tray does not rotate) and (b) of FIG. 22 (the second tray rotates at an angle of 90 degrees or more). In this case, the set angle is an angle at which ice is not escaped from the second tray 380. When the second tray 380 rotate at the set angle, ice that remains in the first tray 320 may fall to the second tray 380.

Even if the first heater 290 is driven while the second tray 380 rotates at the set angle (approximately 10 degrees to 45 degrees), since ice disposed in the second tray 380 is far from the first heater 290 and is in a state of being separated from the first tray 320, the ice may be prevented from being excessively melted.

In this embodiment, the second tray 380 rotates at a set angle, and the first heater 290 is driven even in a state in which the possibility of separation of ice from the first tray 320 is high. As a result, if the ice is not in a state of being separated from the first tray 320, the ice may be additionally heated. That is, when ice is maintained in contact with the first tray 320, a surface of ice, which is in contact with the first tray 320, is changed into water by heat supplied from the first heater 290 to improve reliability of separation of the ice from the first tray 320.

However, if the ice is already separated from the first tray 320, since the heat supplied from the first heater 290 is difficult to be transferred to the ice in a conduction manner, the ice that is already separated may be separated from being melted by the first heater 290.

When the first heater 290 is driven while the second tray 380 rotates at the set angle from the first tray 320, and the set time elapses, the driving of the first heater 290 is stopped.

Even after the first heater 290 is turned off, and after standing by a certain time period (approximately 1 minute to 10 minutes), the second tray 380 rotates up to a position (ice separation position) at which the second tray 380 is pressed by the second pusher 540, as illustrated in (c) of FIG. 22. That is, even in a state in which heat is not supplied by the first heater 290, when the second tray 380 rotates at the set angle, ice is separated from the second tray 380 by the second pusher 540.

Figure 29:
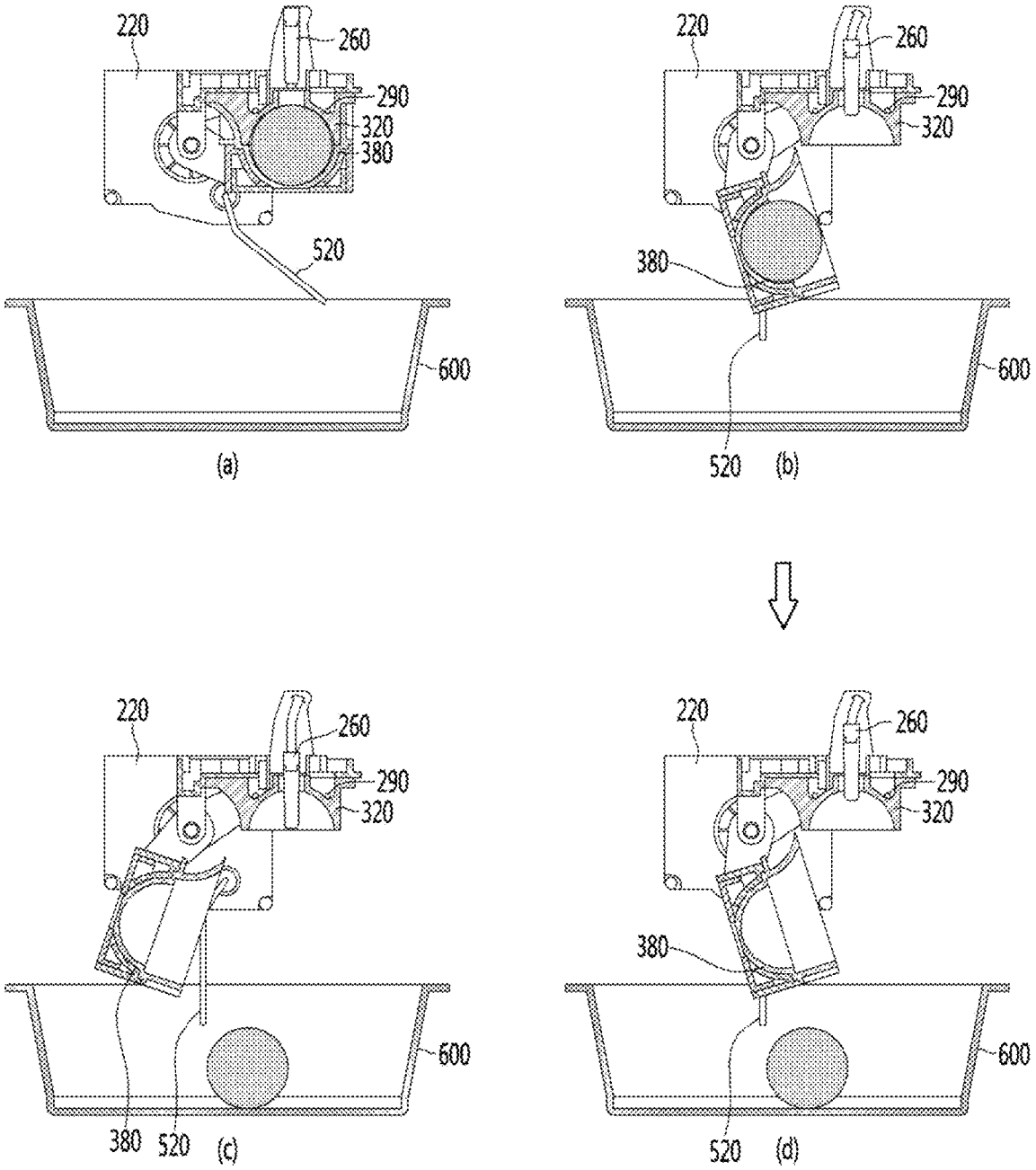
FIG. 29(*a*) to (*d*) are views illustrating an operation when full ice is not detected according to an embodiment of the present invention.
Figure 30:
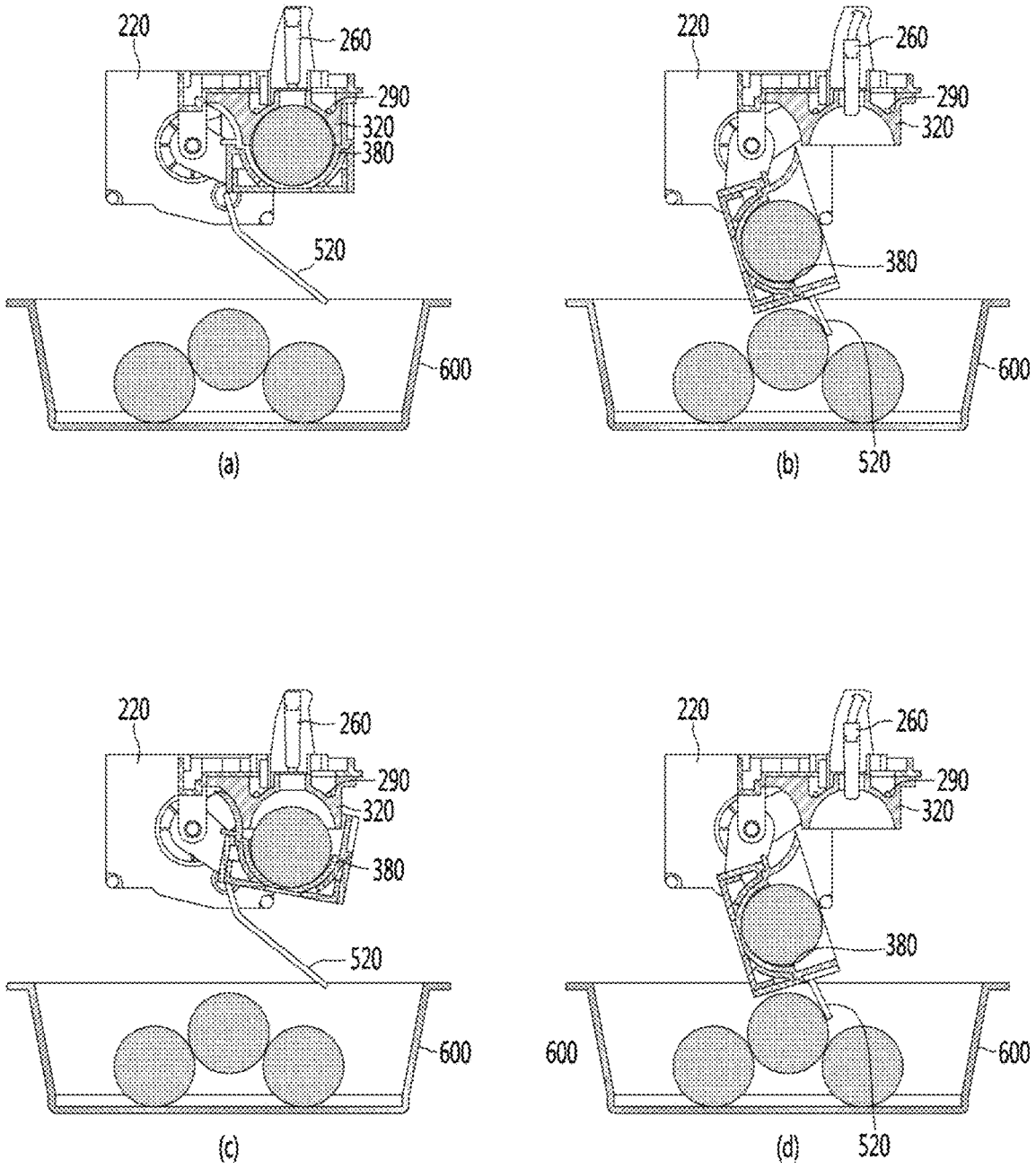
FIG. 30(*a*) to (*d*) are views illustrating an operation when the full ice is detected according to an embodiment of the present invention.

FIG. 29 is a view illustrating an operation when full ice is not detected according to an embodiment of the present invention, and FIG. 30 is a view illustrating an operation when the full ice is detected according to an embodiment of the present invention.

There is a method in which a full ice detection part operates vertically as a typical technique for detecting full ice in the ice maker that makes ice. A twisting type ice maker, which uses a method of discharging ice from the tray by twisting the tray after supplying water into the tray, detects whether ice is full by driving a lever vertically. That is, as the lever descends, whether ice exists may be detected. When the lever is sufficiently lowered, it is determined that ice is not sufficiently stored in the lower portion of the tray, and when the lever is not sufficiently lowered, it is determined that ice is stored in the lower portion of the tray. As a result, the ice is discharged from the tray.

However, in this embodiment, since the tray is constituted by the first tray and the second tray, a space occupied by the trays is larger than that of the twisting type ice maker. Therefore, the space in which the ice bin for storing ice is disposed may also be reduced. Also, in a case using the lever that moves vertically to determine whether ice is stored, there is a problem that ice disposed under the lever is detected, but ice disposed on the side surface out of the lower portion of the lever is not detected.

FIG. 29 is a diagram illustrating an operation when there is a space for additional ice storage in the ice bin 600 (when full ice is not detected).

As illustrated in (a) of FIG. 29, after ice is completely made, the first heater 290 may be driven before the second tray 380 rotates to melt a surface of ice adhering to the first tray 320, thereby separating the ice from the first tray 320.

When the first heater 290 is driven for a predetermined time, the second tray 380 starts to rotate as illustrated in (b) of FIG. 29. At this time, the first pusher 260 passes through the upper side of the first tray 320 to press the ice, thereby separating the ice from the first tray 320.

Even when ice is not sufficiently separated from the first tray 320 by the first heater 290, the ice may be reliably separated by the first pusher 260.

As the second tray 380 rotates, the full ice detection lever 520 also rotates. If the movement of the full ice detection lever 520 is not disturbed by ice while the full ice detection lever 520 rotates to the position of (b) of FIG. 29, as illustrated in (c) of FIG. 29, the second tray 380 may continuously rotate in a clockwise direction so that the second tray 380 additionally rotates to separate the ice from the second tray 380.

At this time, the full ice detection lever 520 is maintained in a stopped state at the position of (b) of FIG. 29. The position of (b) of FIG. 29 may be called as a stopping position of the full ice detection lever 520. That is, initially, the second tray 380 and the full ice detection lever 520 rotate together, but when the full ice detection lever 520 sufficiently rotates, the full ice detection lever 520 does not rotate, but only the second tray 380 further rotates. An angle at which the full ice detection lever 520 rotates may be approximately an angle disposed perpendicular to a bottom surface of the ice bin 600, that is, a horizontal plane. That is, the full ice detection lever 520 rotates in the clockwise direction at an approximately vertical angle with respect to the horizontal plane, and an angle at which the rotation of the full ice detection lever 520 is stopped is disposed at a position at which one end of the full ice detection lever 520 descends up to the lowermost portion while rotating.

The full ice detection lever 520 and the second tray 380 may rotate together or individually by rotational force provided by the driving part 480. The full ice detection lever 520 and the second tray 380 are connected to one rotation shaft provided by the driving part 480 to rotate while drawing one rotation radius.

Since the second tray 380 rotates by a rotation shaft, a trajectory in which the second tray 380 moves has to be secured unlike when the second tray 380 is stopped. Also, since the full ice detection lever 520 also detects full ice in a rotational manner, the full ice detection lever 520 has to rotate up to a height lower than that of the second tray 380.

Therefore, a length of the full ice detection lever 520 extends longer than one end of the second tray 380 to essentially detect whether ice exists in the ice bin 600. That is, the full ice detection lever 520 may be connected to the rotation shaft provided in the driving part 480 to rotate.

The full ice detection lever 520 starts to rotate when the second tray 380 rotates, and since the second tray 380 rotates after the ice is completely made, whether the ice is full may be detected.

The full ice detection lever 520 is a swing type that rotates about a rotation axis rather than a vertical movement manner. Thus, whether ice is stored in the ice bin 600 may be detected while moving along a rotation trajectory.

After the ice moves from the second tray 380 to the ice bin 600, as illustrated in (d) of FIG. 29, the second tray 380 rotates in the counterclockwise again. Before the full ice detection lever 520 rotates up to the position illustrated in (b) of FIG. 29, the full ice detection lever 520 is maintained in the stopped state. When the second tray 380 reaches the rotation angle as illustrated in (b) of FIG. 29, the full ice detection lever 520 may rotate in the counterclockwise direction together with the second tray 380 and then may return to the position of (a) of FIG. 29, which is the initial position.

As illustrated in (a) of FIG. 30, since ice is stored in the lower portion of the ice bin 600, when it is difficult to additionally store ice in the ice bin 600, it is determined that ice is full, and thus, the ice does not move to the ice bin 600.

First, when ice is completely made, the first heater 290 is driven to separate the ice from the first tray 320. This process is the same as the content described in (a) of FIG. 29, and thus, duplicated descriptions will be omitted.

Subsequently, as illustrated in (a) of FIG. 30, the second tray 380 and the full ice detection lever 520 rotate together in the clockwise direction to detect whether the ice bin 600 is filled with ice.

As illustrated in (b) of FIG. 30, before the full ice detection lever 520 rotates to (b) of FIG. 29, when the full ice detection lever 520 is in contact with ice so as not to rotate any more, it is determined that the ice bin 600 is fully filled with ice.

Thus, the full ice detection lever 520 and the second tray 380 do not rotate any more to return to a water supply position (see (c) of FIG. 30) at which water is supplied to the tray. At this time, the second tray 380 and the full ice detection lever 520 rotate together to return to their original positions.

As illustrated in (d) of FIG. 30, after a predetermined time period elapses, whether the ice is filled is detected again. That is, the second tray 380 and the full ice detection lever 520 rotate again in the clockwise direction to determine whether the ice bin 600 is full.

Figure 31:
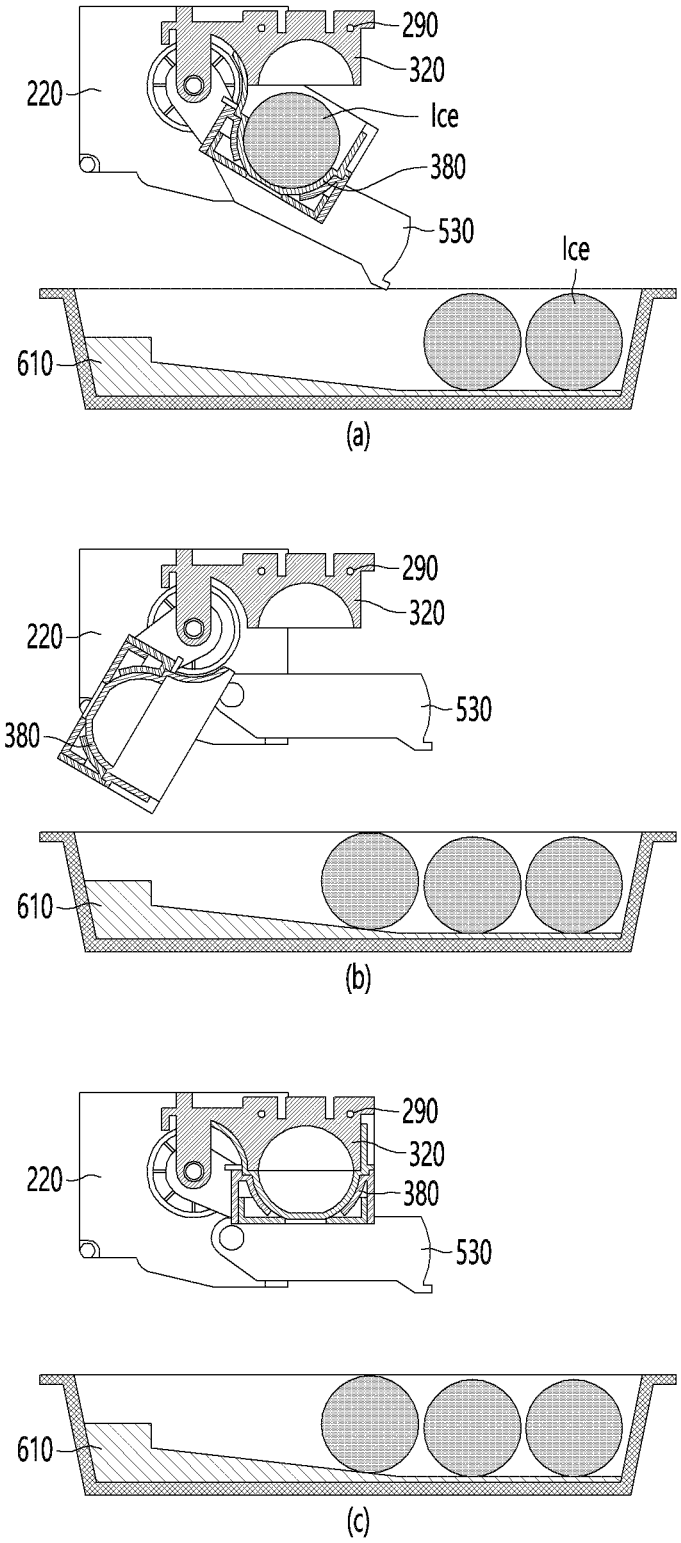
FIG. 31(*a*) to (*c*) are views illustrating an operation when full ice is not detected according to another embodiment of the present invention.
Figure 32:
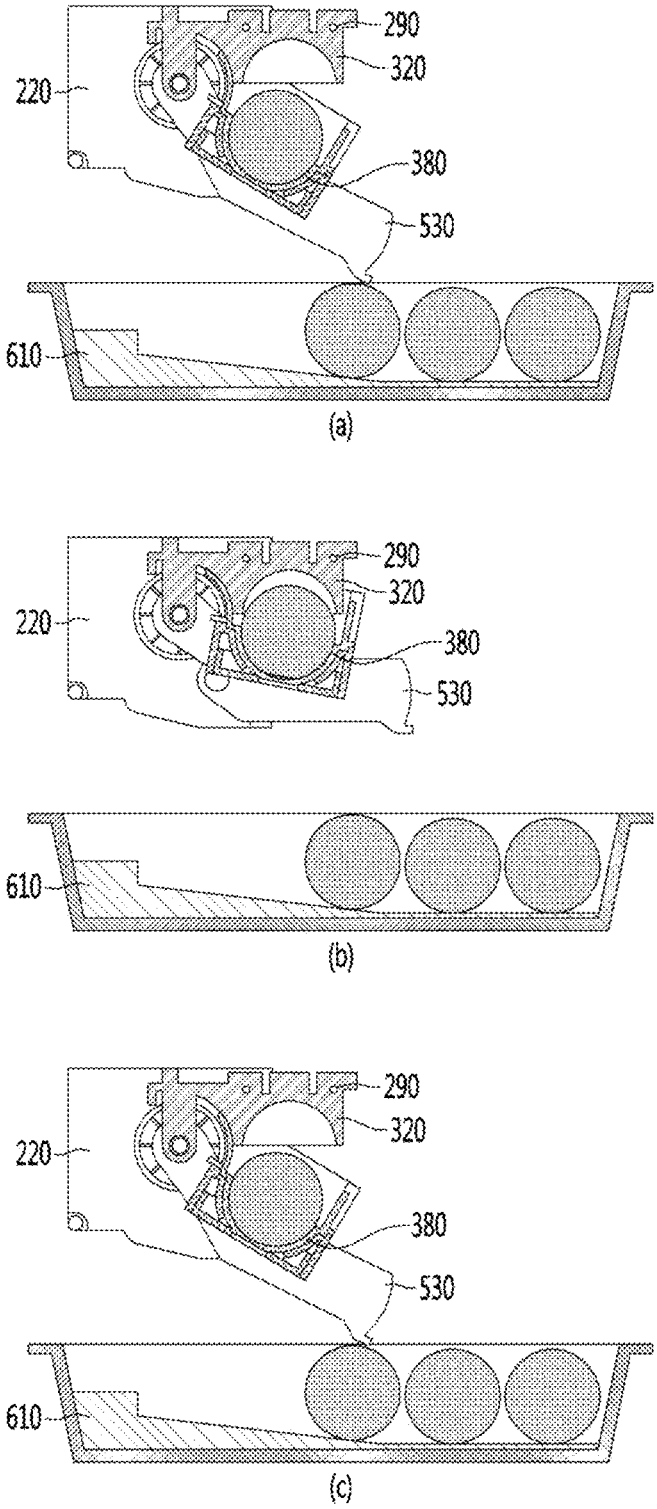
FIG. 32(*a*) to (*c*) are views illustrating an operation when full ice is detected according to another embodiment of the present invention.

FIG. 31 is a view illustrating an operation when full ice is not detected according to another embodiment of the present invention, and FIG. 32 is a view illustrating an operation when full ice is detected according to another embodiment of the present invention.

In another embodiment, unlike FIGS. 29 and 30, a full ice detection lever increases in thickness. The full ice detection lever may be provided in a bar shape rather than a wire shape to detect ice contained in an ice bin 600.

In FIGS. 31 and 32, unlike the previous embodiment, an inclined plate 610 is disposed on a bottom surface of the ice bin 600. The inclined plate 610 is disposed on the bottom of the ice bin 600 so as to be inclined at a predetermined angle, thereby serving to guide ice stored in the ice bin 600 to be collected in a predetermined direction.

The inclined plate 610 is disposed so that a portion that is close to the second tray 380 has a high height, and a portion that is far from the second tray 380 has a low height. Thus, ice separated from the second tray 380 to drop into the ice bin 600 is guided away from the second tray 380.

The description will be made with reference to FIGS. 31 and 32, but the content duplicated with the description of the foregoing embodiment will be omitted, and the differences will be mainly described.

As illustrated in FIG. 31, when the full ice detection lever 530 and the second tray 380 rotate, if ice is not detected in the full ice detection lever 530 by the full ice detection lever 530, it is determined that the ice bin 600 is not filled with ice. Thus, as illustrated in (b) of FIG. 31, the full ice detection lever 530 returns to an initial position while rotating in a counterclockwise direction, and the second tray 380 further rotates so that ice drops and moves into the ice bin 600.

The ice collected in the ice bin 600 is collected at a position that is away from the second tray 380 due to a difference in height of the inclined plate 610.

As illustrated in FIG. 32, when the full ice detection lever 530 and the second tray 380 rotate, if ice is detected in the full ice detection lever 530 by the full ice detection lever 530, it is determined that the ice bin 600 is filled with ice. Therefore, as illustrated in (a) of FIG. 32, when the full ice detection lever 530 is in contact with the ice, the full ice detection lever 530 and the second tray 380 rotate no longer in the clockwise direction, but rotate in a counterclockwise direction to return to their original positions.

After a predetermined time elapses, the full ice detection lever 530 rotates again to detect ice in the ice bin 600. The reason why the full ice detection lever 530 rotates again is because a user withdraws ice from the ice bin 600, or an error in detecting whether the ice is full in the ice bin 600 occurs.

The inclined plate 610 applied in another embodiment may be applied in the same manner to the foregoing embodiment. In a case of making spherical ice, if a depth of the ice bin 600 is large, ice may be damaged when the ice falls from the tray to the ice bin 600. Therefore, it is preferable that the ice bin 600 has a sufficient thin thickness at which spherical ice is capable of stored, if possible. When this condition is satisfied, since the depth of the ice bin 600 is inevitably shallow, a storage space for ice may be insufficient. Therefore, the ice stored in the ice bin 600 sequentially moves to a certain place so that the ice is spread evenly in the ice bin 600 to widely utilize the ice storage space.

It is to be understood that the invention is not limited to the disclosed embodiment of the present invention, but, on the contrary, is intended to cover various modifications and equivalent arrangements included within the spirit and scope of the appended claims.

What is claimed is:

1. An ice maker comprising:

a cell having a space in which a liquid introduced into the space is phase-changed into ice, the cell being formed in the ice maker;

a first tray configured to form a first portion of the cell;

a second tray configured to form a second portion of the cell;

a heater configured to provide a heat to the cell, the heater being positioned outside of the cell;

a pusher having at least one column configured to press the second tray during an ice separation process, the column having an end with at least an edge and configured to press against the second tray to deform of the second portion of the cell, wherein the heater is disposed in a first distance away from the second tray during an ice making process, and when the second tray is capable of being pressed by the edge of the pusher, the heater is disposed in a second distance away from the second tray, the first distance being shorter than the second distance.

2. The ice maker of claim 1, wherein the heater is in contact with the second tray during the ice making process, and when the second tray is capable of being pressed by the edge of the pusher, the heater is spaced apart from the second tray.

3. The ice maker of claim 1, wherein the first tray has a plurality of the first portions and the second tray has a plurality of the second portions, and the first portions of the first tray and the second portions of the second tray are configured to form a plurality of the cells, and the liquid is provided to a first subset of the second portions of the second tray and is distributed to a second subset of the second portions of the second tray through a gap between the first tray and the second tray.

4. The ice maker of claim 1, wherein the second tray includes a wall configured to contact at least a portion of the first tray when the second tray is positioned at a liquid supply position.

5. The ice maker of claim 1, wherein, after the ice making process is performed at an ice making position where the first portion of the first tray and the second portion of the second tray are in contact with each other to form the cell, the ice separation process is performed.

6. The ice maker of claim 1, wherein at least one portion of the first tray and at least one portion of the second tray are spaced apart from each other after the ice is formed.

7. The ice maker of claim 1, further comprising a tray case configured to support the second tray and having an opening.

8. The ice maker of claim 7, wherein in the ice separation process, the pusher passes through the opening of the tray case.

9. The ice maker of claim 1, wherein the column has a prescribed length and width, where the length is greater than the width.

10. The ice maker of claim 9, wherein
the column has a cylindrical profile, or
the end of the column is flat, or
the edge has a circular shape.

11. A refrigerator having the ice maker of claim 1, wherein the refrigerator includes a cabinet having a storage space and a door,
the ice maker is provided in the storage space or the door.

12. An ice maker comprising:
a cell having a space in which a liquid introduced into the space is phase-changed into ice, the cell being formed in the ice maker;
a first tray configured to form a first portion of the cell;
a second tray configured to form a second portion of the cell; and
a heater configured to provide a heat to the cell, the heater being positioned outside of the cell;
wherein, while cold air is supplied to the space by a cooler to make the ice, the heater is driven to supply the heat to the space, and
wherein the heater, when capable of being turned on to supply the heat to the space while the ice is being formed, operates to:
supply a first amount of heat when the liquid in the space is capable of being phase-changed into the ice in a section of the cell,
supply a second amount of heat, after the first amount of heat is supplied, when the liquid in the space is capable of being phase-changed into the ice in another section of the cell, and
supply a third amount of heat, after the second amount of heat is supplied, when the liquid in the space is capable of being phase-changed into the ice in further-another section of the cell.

13. The ice maker of claim 12, wherein the heater, when capable of being turned on to supply the heat to the space while the ice is being formed, operates to:
supply the first amount of heat during a first period when the liquid in the space is capable of being phase-changed into the ice in a section of the cell,
supply the second amount of heat during a second period, after the first period, when the liquid in the space is capable of being phase-changed into the ice in another section of the cell, and
supply the third amount of heat during a third period, after the first and second periods, when the liquid in the space is capable of being phase-changed into the ice in further another section of the cell.

14. The ice maker of claim 13, wherein
the first period is different from the second period and the second period is different from the third period, or
the first period is shorter than the second period and the first period is shorter than the third period.

15. The ice maker of claim 14, wherein the second amount of heat is greater than the first amount of heat, and the third amount of heat is less than the second amount of heat.

16. The ice maker of claim 12, wherein the cooler includes a duct that supplies the cold air to the space.

17. The ice maker of claim 12, wherein, after the ice is formed in the space, the heater is capable of being turned on when removing the ice from at least one of the first portion of the first tray or the second portion of second tray.

18. The ice maker of claim 12, wherein the first amount of heat is different from the second amount of heat, and the second amount of heat is different from the third amount of heat, or
wherein the first amount of heat is less than the second amount of heat, and the first amount of heat is greater than the third amount of heat.

19. An ice maker comprising:
a cell having a space in which liquid introduced into the space is phase-changed into ice, the cell being formed in the ice maker;
a first tray configured to form a first portion of the cell;
a second tray configured to form a second portion of the cell;
a first tray case configured to support the first tray and formed as a separate component to the first tray;
a first pusher having at least one column configured to separate the ice from the first portion of the cell during an ice separation process, the column having an end with at least an edge;
a cooler configured to heat-exchange with the cell, the cooler being positioned outside of the cell; and
a heater configured to provide a heat to the cell, the heater being positioned outside of the cell;
wherein:
the heater is configured to be driven to supply heat to the space to slow formation of the ice, and
in the ice separation process, the first pusher is configured to pass through the first tray case to separate ice from the first portion of the cell.

20. The ice maker of claim 19, further comprising
a second tray case configured to support the second tray; and
a second pusher having at least one column configured to separate the ice from the second portion of the cell during the ice separation process, the column of the second pusher having an end with at least an edge,
wherein the second pusher is configured to pass through the second tray case to separate the ice from the second portion of the cell.

* * * * *